US008939448B2

(12) United States Patent
Hashimoto

(10) Patent No.: US 8,939,448 B2
(45) Date of Patent: Jan. 27, 2015

(54) IMAGE FORMING APPARATUS

(71) Applicant: Yohei Hashimoto, Nagakute (JP)

(72) Inventor: Yohei Hashimoto, Nagakute (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/228,538

(22) Filed: Mar. 28, 2014

(65) Prior Publication Data

US 2014/0291923 A1 Oct. 2, 2014

(30) Foreign Application Priority Data

Mar. 29, 2013 (JP) ..... 2013-075318
Mar. 29, 2013 (JP) ..... 2013-075319

(51) Int. Cl.
*B65H 39/10* (2006.01)
*B65H 5/26* (2006.01)
*B65H 29/58* (2006.01)
*B65H 85/00* (2006.01)

(52) U.S. Cl.
CPC ..... *B65H 5/26* (2013.01); *B65H 29/58* (2013.01); *B65H 85/00* (2013.01)
USPC ..... 271/291; 271/10.13; 271/10.04; 271/184; 271/186; 271/301; 271/304

(58) Field of Classification Search
USPC ..... 271/10.04, 10.13, 225, 291, 301, 304, 271/184–186
See application file for complete search history.

(56) References Cited

U.S. PATENT DOCUMENTS

| | | | | |
|---|---|---|---|---|
| 8,272,641 | B2 | 9/2012 | Tokoro | |
| 8,783,682 | B2 * | 7/2014 | Iijima | 271/225 |
| 2011/0024965 | A1 | 2/2011 | Tokoro | |
| 2014/0063162 | A1 * | 3/2014 | Iijima | 347/104 |

FOREIGN PATENT DOCUMENTS

| | | | |
|---|---|---|---|
| JP | 2003-292221 | A | 10/2003 |
| JP | 2005-202090 | A | 7/2005 |
| JP | 2011-048328 | A | 3/2011 |
| JP | 2011-140980 | A | 7/2011 |

OTHER PUBLICATIONS

Co-Pending U.S. Appl. No. 14/228,520, filed Mar. 28, 2014.

* cited by examiner

*Primary Examiner* — Prasad Gokhale
(74) *Attorney, Agent, or Firm* — Banner & Witcoff, Ltd.

(57) ABSTRACT

There is provided an image forming apparatus including a driving source, a switchback roller which switches between a normal rotation direction and a reverse rotation direction, first and second gear train for rotating the switchback roller in the normal and reverse rotation directions, respectively, a switching mechanism which switches among a first mode for transmitting driving force to the first gear train, a second mode for transmitting the driving force to the second gear train, and a third mode for not to transmit the driving force, a switching element which switches between a first state allowing switching of the switching mechanism into the first or third mode and a second state allowing switching of the switching mechanism into the second mode; and a controller which controls a state change of the switching element between the first state and the second state.

15 Claims, 22 Drawing Sheets

UPPER
FRONT
REAR
LOWER
141(140)
135(133)
131
144
143
138 (134)
101
137 (134)
126
142 (140)
130
136(133)
125

UPPER
RIGHT
LEFT
LOWER
146(147)
127
125
145(147)
135(133)
126
137 (134)
130
101
138 (134)
144
142(140)
141(140)
131

UPPER
REAR
FRONT
LOWER
146(147)
127
101
145(147)
135(133)
125
126

UPPER
RIGHT
REAR
FRONT
LEFT
LOWER
131
136(133)
126
145
146
147
143
141(140)
130
101
138 (134)
125

IMAGE FORMING APPARATUS

CROSS-REFERENCE TO RELATED APPLICATION

This application claims priority from Japanese Patent Application Nos. 2013-075318 and 2013-075319, both filed on Mar. 29, 2013, the entire subject matter of which is incorporated herein by reference.

TECHNICAL FIELD

Aspects of the present invention relate to an image forming apparatus employing an electro-photographic system.

BACKGROUND

There have been known a printer which consecutively prints both sides of a plurality of sheets.

As such printer, there has been proposed a printer in which after an image is formed on one side of a sheet, a discharge roller is rotated in a reverse direction such that the sheet is re-conveyed into a main body casing (switchback conveyance), and an image is formed on the other side of the sheet (for example, JP-A-2011-048328).

Further, in this printer, in order to perform switchback conveyance, a dedicated motor is provided for controlling three states, that is, a state in which the discharge roller and an intermediate discharge roller rotate in their normal rotation directions, a state in which they rotate in their reverse directions, and a state in which they do not rotate. Therefore, at power-on of the printer, an initial mode of the dedicated motor is set, and then an image forming operation is performed.

However, in JP-A-2011-048328, since a plurality of dedicated motors are provided respectively for a discharge unit, an image forming unit, and a conveying unit, the driving sounds of the motors may be generated, and the driving sound of the printer may become louder. In order to reduce the driving sound of the printer, it has been proposed to remove dedicated motors. However, if the dedicated motors are removed, setting of an initial mode by dedicated motors cannot be set, and in order to set an initial mode of a mechanism for performing switchback conveyance at power-on of the printer, it is needed to add a member for detecting an initial mode.

Further, in the printer disclosed in JP-A-2011-048328, as a driving source for various rollers, in addition to a motor for rotating photosensitive drums and developing rollers in one direction and a motor for rotating rollers for conveying sheets toward the image forming unit in one direction, there would be necessary to provide a motor for rotating the discharge roller which switches between a normal rotation and a reverse rotation. Therefore, cost may increase and noise may be generated from the motor sounds.

SUMMARY

Accordingly, an aspect of the present invention provides an image forming apparatus capable of setting an initial mode to be a reference of control while reducing cost and noise. Further, another aspect of the present invention provides an image forming apparatus capable of switching a conveyance direction of a recording medium by a simple configuration so as to form images on one side and the other side of the recording medium while reducing cost and noise.

According to an illustrative embodiment of the present invention, there is provided an image forming apparatus comprising: a driving source configured to generate one-direction rotational driving force; a switchback roller configured to be switched between a normal rotation direction and a reverse rotation direction for switching a conveyance direction of a recording medium having an image formed thereon by an image forming unit; a first gear train configured to transmit the one-direction rotational driving force of the driving source to the switchback roller such that a rotation direction of the switchback roller becomes the normal rotation direction; a second gear train configured to transmit the one-direction rotational driving force of the driving source to the switchback roller such that the rotation direction of the switchback roller becomes the reverse rotation direction; a switching mechanism configured to be switchable among a first mode for transmitting the one-direction rotational driving force of the driving source to the first gear train, a second mode for transmitting the one-direction rotational driving force of the driving source to the second gear train, and a third mode for not transmitting the one-direction rotational driving force of the driving source to any of the first gear train and the second gear train; a switching element configured to selectively change between a first state allowing switching of the switching mechanism into the first mode or the third mode, and a second state allowing switching of the switching mechanism into the second mode; and a controller configured to control a state change of the switching element between the first state and the second state. The switching mechanism is configured to be switched from the second mode only to the third mode. The controller is configured to perform first control to control the switching element to hold the first state for a first time period; and second control to control the switching element to hold the second state for a second time period. The controller is configured to, after performing the second control to cause the switching mechanism to switch into the second mode, switch to perform the first control.

According to this configuration, since it is not necessary to switch the rotation direction of the rotational driving force of the driving source for switching the rotation direction of the switchback roller, it is possible to use one driving source not only as a driving source for generating a rotational driving force for rotating rotary bodies which are in the image forming apparatus and rotate in one direction, but also as a driving source for generating a rotational driving force to be transmitted to the switchback roller.

Further, the switching element is configured to selectively change between the first state allowing switching of the switching mechanism to the first mode or the third mode and the second state allowing switching of the switching mechanism to the second mode, and this state change of the switching element between the first state and the second state is controlled by the controller.

Further, since the switching mechanism can be switched from the second mode only to the third mode, in a case of controlling the switching mechanism by the controller, thereby performing an image forming operation, first, the switching mechanism is set to the second mode, and then, the switching mechanism is switched from the second mode to the third mode. Accordingly, it is possible to set the timing of the switching from the second mode to the third mode as the reference of control.

As a result, it is possible to perform an image forming operation using switching of the switching mechanism from the second mode to the third mode as the reference of control while reducing cost and noise.

According to another aspect of the present invention, there is provided an image forming apparatus comprising: a driving source configured to generate one-direction rotational driving force; a switchback roller configured to be switched between a normal rotation direction and a reverse rotation direction for switching a conveyance direction of a recording medium having an image formed thereon by an image forming unit; a first gear train configured to transmit the one-direction rotational driving force of the driving source to the switchback roller such that a rotation direction of the switchback roller becomes the normal rotation direction; a second gear train configured to transmit the one-direction rotational driving force of the driving source to the switchback roller such that the rotation direction of the switchback roller becomes the reverse rotation direction; a switching mechanism configured to be switchable among a first mode for transmitting the one-direction rotational driving force of the driving source to the first gear train, a second mode for transmitting the one-direction rotational driving force of the driving source to the second gear train, and a third mode for not transmitting the one-direction rotational driving force of the driving source to any of the first gear train and the second gear train; a switching element configured to selectively change between a first state allowing switching of the switching mechanism into the first mode or the third mode, and a second state allowing switching of the switching mechanism into the second mode; and a controller configured to control a state change of the switching element between the first state and the second state. The controller is configured to perform: first control to control the switching element to hold the first state for a first time period; second control to control the switching element to hold the second state for a second time period; third control to control the switching element to hold the second state for a third time period shorter than the second time period. The switching mechanism is configured to: selectively hold the first mode or the third mode based on the first control of the controller; hold the second mode based on the second control of the controller; and interchange the first mode and the third mode before and after the third control of the controller.

According to this configuration, since it is not necessary to switch the rotation direction of the rotational driving force of the driving source for switching the rotation direction of the switchback roller, it is possible to use one driving source not only as a driving source for generating a rotational driving force for rotating rotary bodies which are in the image forming apparatus and rotate in one direction, but also as a driving source for generating a rotational driving force to be transmitted to the switchback roller.

Further, the switching element is configured to selectively change between the first state allowing switching of the switching mechanism to the first mode or the third mode and the second state allowing switching of the switching mechanism to the second mode, and this state change of the switching element between the first state and the second state is controlled by the controller.

The controller is configured to perform: first control to control the switching element to hold the first state for a first time period; second control to control the switching element to hold the second state for a second time period; third control to control the switching element to hold the second state for a third time period shorter than the second time period.

As a result, it is possible to perform the third control with respect to the switching mechanism having become the first mode or the third mode by the first control of the controller, thereby interchanging the first mode and the third mode.

Therefore, before performing the second control, if performing the first control and the third control, it is possible to necessarily perform the first mode before performing the second mode.

Accordingly, it is possible to use one driving source not only as a driving source for generating rotational driving force for rotating rotary bodies which are in the image forming apparatus and rotate in one direction, but also as a driving source for generating rotational driving force for rotating the switchback roller. Therefore, it is possible to discharge a recording medium by rotating the switchback roller in the normal rotation direction by causing the switching mechanism to surely become the first mode before the second mode, while reducing cost and noise.

BRIEF DESCRIPTION OF THE DRAWINGS

The above and other aspects of the present invention will become more apparent and more readily appreciated from the following description of illustrative embodiments of the present invention taken in conjunction with the attached drawings, in which:

FIGS. 2A and 2B are block diagrams showing a drive transmission system of the printer shown in FIG. 1, wherein FIG. 2A shows a block diagram of a main motor, and FIG. 2B shows a block diagram of a process motor;

FIGS. 7A and 7B are views showing a partially toothed gear of a sector gear, a lever, and a drive gear shown in FIG. 3, in the first mode, wherein FIG. 7A is a cross-sectional view taken along a line C-C shown in FIG. 3, and FIG. 7B is a perspective view as seen from the upper rear side;

FIGS. 8A to 8D are views showing the sector gear of FIG. 4, wherein FIG. 8A is a right side view, and FIG. 8B is a rear view, and FIG. 8C is a left side view, and FIG. 8D is a perspective view as seen from the upper front side, and wherein for the sake of convenience, directions are based on the posture of the sector gear in a normal rotation mode;

FIGS. 12A and 12B are views showing the partially toothed gear, the lever, and the drive gear of the sector gear of FIG. 3 in the second mode, wherein FIG. 12A is a cross-sectional view taken along a line D-D shown in FIG. 3, and FIG. 12B is a perspective view as seen from the upper rear side;

FIGS. 16A and 16B are views showing the partially toothed gear of the sector gear, the lever, and the drive gear shown in FIG. 3, in the third mode, wherein FIG. 16A is a cross-sectional view taken along the line C-C shown in FIG. 3, and FIG. 16B is a perspective view as seen from the upper rear side;

FIG. 18 is a timing chart for explaining the operation of each unit immediately after power-on;

DETAILED DESCRIPTION

1. Overall Configuration of Printer

Figure 1:
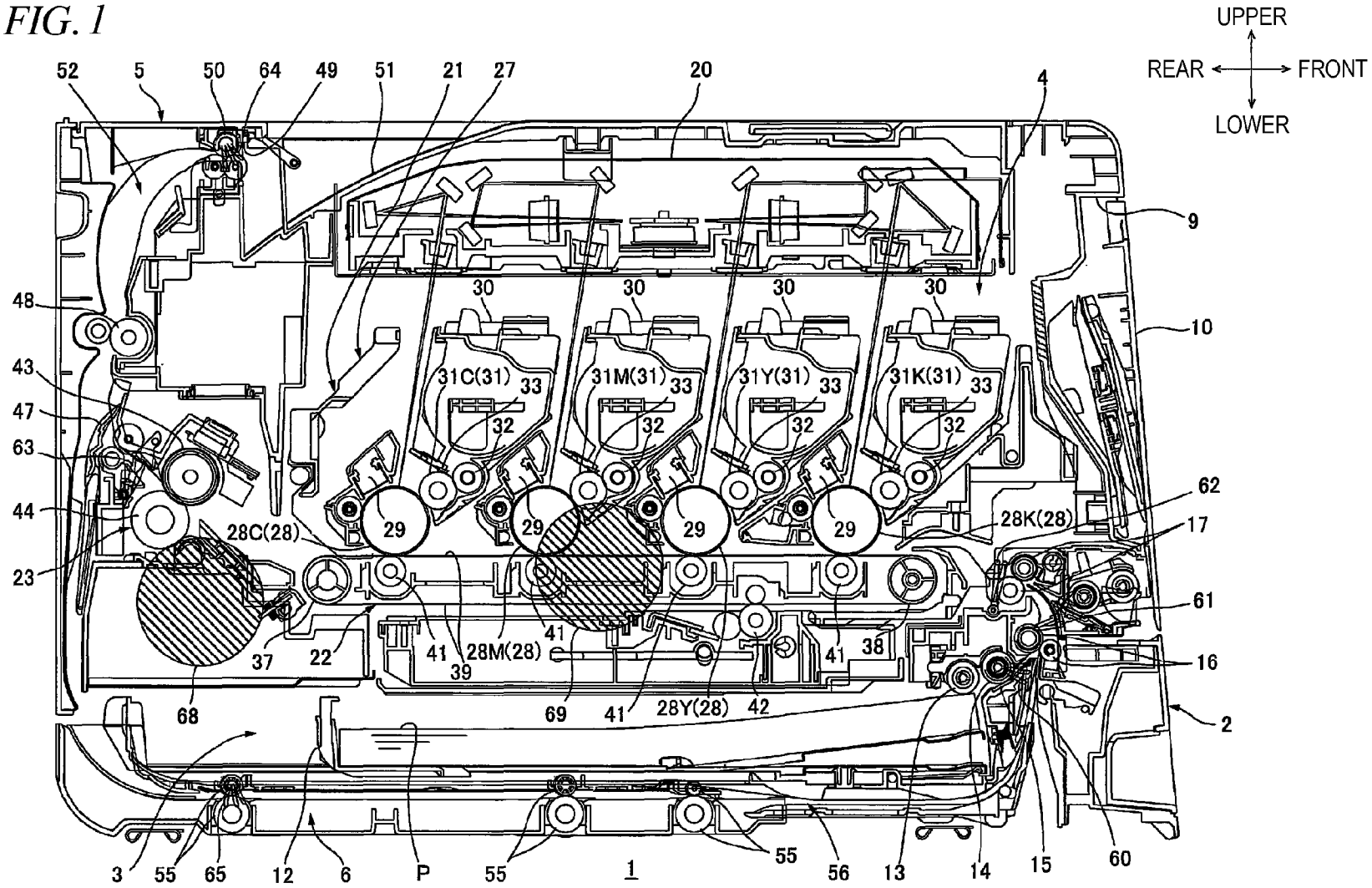
FIG. 1 is a center cross-sectional view showing a printer which is an example of an image forming apparatus according to an illustrative embodiment of the present invention.

As shown in FIG. 1, a printer 1 (an example of an image forming apparatus) is a direct tandem type color laser printer. The printer 1 includes, inside a main body casing 2, a sheet feeding unit 3 for feeding a sheet P (an example of a recording medium), an image forming unit 4 for forming an image on the fed sheet P, a sheet discharge unit 5 for discharging the sheet P having the image formed thereon, and a reverse conveyance unit 6 for re-conveying the sheet P having the image formed thereon into the image forming unit 4.

In the following description, in case of referring to directions of the printer 1, the upper side and the lower side of the printer are based on a state where the printer 1 is installed horizontally. That is, the upper side of the sheet of FIG. 1 is the upper side of the printer, and the lower side of the sheet of FIG. 1 is the lower side of the printer. Further, the right side of the sheet of FIG. 1 is the front side of the printer, and the left side of the sheet of FIG. 1 is the rear side of the printer. Also, the left and right of the printer 1 are based on directions as the printer 1 is viewed from the front side. That is, a direction toward a viewer of FIG. 1 is the left side of the printer, and a direction away from the viewer of FIG. 1 is the right side of the printer.

(1) Main Body Casing

The main body casing 2 is formed in a box shape having a substantially rectangular shape as seen in a side view, and accommodates the sheet feeding unit 3, the image forming unit 4, the sheet discharge unit 5, and the reverse conveyance unit 6. The main body casing 2 has a front wall having a main body opening 9, and a front cover 10. The front cover 10 is configured to be able to swing around its lower end portion, so as to open or close the main body opening 9.

(2) Sheet Feeding Unit

The sheet feeding unit 3 is configured to convey sheets P toward the image forming unit 4. The sheet feeding unit 3 includes a sheet feeding tray 12, a pickup roller 13, a sheet feeding roller 14, a sheet feeding pad 15, a conveying roller 16, and a registration roller 17.

The sheet feeding tray 12 accommodates sheets P and is removably set at a lower portion of the inside of the main body casing 2. The sheets P on the sheet feeding tray 12 are sent into a space between the sheet feeding roller 14 and the sheet feeding pad 15 by rotation of the pickup roller 13, and are separated one by one by rotation of the sheet feeding roller 14.

The conveying roller 16 is positioned in a substantially U-shaped conveyance path extending from the sheet feeding roller 14 to the image forming unit 4, and conveys a sheet P having been conveyed from the sheet feeding roller 14, toward the registration roller 17.

The registration roller 17 is positioned on the downstream side from the conveying roller 16 in the conveyance direction of the sheet P and on the upstream side from the image forming unit 4 in the conveyance direction of the sheet P. The registration roller 17 contacts the sheet P having been conveyed from the conveying roller 16, thereby correcting skew of the sheet P. Thereafter, the registration roller 17 is rotated in a normal rotation direction, so that the sheet P is conveyed at a predetermined timing toward between photosensitive drums 28 (to be described below) and a conveyor belt 39 (to be described below) provided in the image forming unit 4.

(3) Image Forming Unit

The image forming unit 4 includes a scanner unit 20, a drawer unit 21, a transfer unit 22, and a fixing unit 23.

(3-1) Scanner Unit

The scanner unit 20 is disposed at an upper portion of the main body casing 2. The scanner unit 20 emits laser beams toward a plurality of photosensitive drums 28 (to be described below), that is, four photosensitive drums 28, respectively, based on image data, thereby exposing the photosensitive drums 28 (to be described below).

(3-2) Drawer Unit

The drawer unit 21 is disposed below the scanner unit 20 substantially at the center of the main body casing 2 in a vertical direction. The drawer unit 21 is configured to be slidable in a front-rear direction, and be able to be pulled out from the main body casing 2 through the main body opening 9. The drawer unit 21 includes one process unit 27, and a plurality of developing cartridges 30, that is, four developing cartridges 30.

The process unit 27 includes a plurality of photosensitive drums 28, that is, four photosensitive drums 28, and a plurality of scorotron type chargers 29, that is, four scorotron type chargers 29, corresponding to respective colors.

The plurality of photosensitive drums 28 are disposed in parallel at intervals in the front-rear direction. Specifically, from the front side toward rear side of the process unit 27, a black photosensitive drum 28K, a yellow photosensitive drum 28Y, a magenta photosensitive drum 28M, and a cyan photosensitive drum 28C are sequentially arranged.

The photosensitive drums 28 are formed in a substantially cylindrical shape long in a left-right direction, and are rotatably supported at a lower end portion of the process unit 27 such that the photosensitive drums 28 are exposed from below.

The plurality of scorotron type chargers 29 are provided correspondingly to the plurality of photosensitive drums 28, respectively. The scorotron type chargers 29 are positioned on the upper rear sides of corresponding photosensitive drums 28 with gaps from the photosensitive drums 28, respectively.

The plurality of developing cartridges 30 are provided correspondingly to the plurality of photosensitive drums 28, respectively. The developing cartridges 30 are removably installed into the process unit 27 so as to be positioned above corresponding photosensitive drums 28, respectively. Each developing cartridge 30 includes a developing roller 31, a supply roller 32, and a layer-thickness regulating blade 33.

The developing rollers 31 of the plurality of developing cartridges 30 correspond to the colors of the plurality of photosensitive drums 28, respectively. A black developing roller 31K, a yellow developing roller 31Y, a magenta developing roller 31M, and a cyan developing roller 31C are sequentially arranged from the front side toward the rear side.

The developing rollers 31 are formed in a substantially columnar shape long in the left-right direction, and are in contact with the upper front sides of the photosensitive drums 28.

The supply rollers 32 are formed in a substantially columnar shape long in the left-right direction, and are in contact with the upper front sides of the developing rollers 31.

The layer-thickness regulating blades 33 are in contact with the upper sides of the developing rollers 31.

The plurality of developing cartridges 30 accommodate toner corresponding to the respective colors inside their upper spaces, respectively.

The toner in the developing cartridges 30 is fed to the supply rollers 32, and is supplied to the developing rollers 31, and is positively and friction-electrically charged between the supply rollers 32 and the developing rollers 31.

The thickness of the toner having been supplied to the developing rollers 31 is regulated by the layer-thickness regulating blades 33 according to rotation of the developing rollers 31, so that the toner is carried on the surfaces of the developing rollers 31 as thin layers having a constant thickness.

Incidentally, the surfaces of the photosensitive drums 28 are uniformly and positively charged by the scorotron type chargers 29 according to rotation of the photosensitive drums 28, and then are exposed by high-speed scanning with laser beams from the scanner unit 20. As a result, electrostatic latent images corresponding to an image to be formed on the sheet P are formed on the surfaces of the photosensitive drums 28, respectively.

When the photosensitive drums 28 further rotate, the toner having been carried on the surfaces of the developing rollers 31 and having been positively charged is supplied to the electrostatic latent images formed on the surfaces of the photosensitive drums 28. As a result, toner images are carried on the surfaces of the photosensitive drums 28 by reversal development.

(3-3) Transfer Unit

The transfer unit 22 is disposed along the front-rear direction at an internal portion of the main body casing 2 which is above the sheet feeding unit 3 and below the drawer unit 21. This transfer unit 22 includes a driving roller 37 and a driven roller 38 which are positioned with an interval in the front-rear direction, the conveyor belt 39 which is wound around the driving roller 37 and the driven roller 38, a plurality of transfer rollers 41, that is, four transfer rollers 41 which are positioned to sandwich the upper portion of the conveyor belt 39 with the plurality of photosensitive drums 28, respectively, and a belt cleaning roller 42 which faces the lower portion of the conveyor belt 39.

The sheet P having been fed from the sheet feeding unit 3 is conveyed from the front side toward the rear side by the conveyor belt 39, so as to pass transfer positions sequentially where the photosensitive drums 28 and the transfer rollers 41 face each other. Further, the toner images of the respective colors having been carried on the photosensitive drums 28 are sequentially transferred onto the sheet P during the conveyance of the sheet P.

The residual toner on the conveyor belt 39 is cleaned by the belt cleaning roller 42.

(3-4) Fixing Unit

The fixing unit 23 is positioned at the rear of the transfer unit 22, and includes a heating roller 43, and a pressing roller 44 which abuts on the lower rear side of the heating roller 43. In the transfer unit 22, while the sheet P passes between the heating roller 43 and the pressing roller 44, the color image having been transferred on the sheet P is heated and pressed, thereby being thermally fixed on the sheet P.

(4) Sheet Discharge Unit

The sheet discharge unit 5 is configured to convey a sheet P having an image formed in the image forming unit 4 toward the outside of the main body casing 2, or to convey a sheet P having been switched by a switchback roller 50 toward the reverse conveyance unit 6. The sheet discharge unit 5 includes a flapper 47, an intermediate sheet discharge roller 48, the switchback roller 50, a discharge opening 49, and a sheet discharge tray 51.

The intermediate sheet discharge roller 48 is supported on the main body casing 2 at a rear portion substantially at the center of the main body casing 2 in the vertical direction such that the rotation direction of the intermediate sheet discharge roller can be switched between a normal rotation direction and a reverse rotation direction.

The switchback roller 50 is supported on the main body casing 2 at an upper rear portion of the main body casing 2 such that the rotation direction of the switchback roller 50 can be switched between a normal rotation direction and a reverse rotation direction. Specifically, the switchback roller 50 is configured such that the rotation direction of the switchback roller 50 can be switched between the normal rotation direction for conveying a sheet P toward the sheet discharge tray 51 through the discharge opening 49, and the reverse rotation direction for drawing a sheet P having been conveyed toward the sheet discharge tray 51 into the main body casing 2, by a switching unit 83 (to be described below).

The discharge opening 49 is an opening for discharging a sheet P having an image formed in the image forming unit 4 and having been conveyed by the switchback roller 50 rotating in the normal rotation direction to the outside of the main body casing 2.

The sheet discharge tray 51 is formed at an upper portion of the main body casing 2, substantially in a letter "V" shape having an open upper side as seen in a side view.

The flapper 47 is configured on the downstream side of the fixing unit 23 in the conveyance direction of the sheet P such that the flapper 47 can be switched between a sheet discharge position and a re-conveyance position. The flapper 47 positioned at the sheet discharge position guides a sheet P having been thermally fixed in the fixing unit 23 toward the intermediate sheet discharge roller 48. The flapper 47 positioned at the re-conveyance position guides a sheet P having been reversed by the switchback roller 50 toward the reverse conveyance unit 6 formed below the sheet discharge unit 5.

A path in which a sheet P having been fed to the sheet feeding roller 14 is conveyed to the conveying roller 16, and passes through the image forming unit 4, and is conveyed to the switchback roller 50 of the sheet discharge unit 5 is referred to as a primary conveyance path 52.

(5) Reverse Conveyance Unit

The reverse conveyance unit 6 is configured to convey a sheet P from the rear side to front side of the main body casing 2. The reverse conveyance unit 6 is formed to extend from the lower side of the flapper 47 and passes under the sheet feeding unit 3 and join the upstream side from the image forming unit 4 of the primary conveyance path 52 in the conveyance direction of the sheet P, specifically, the upstream side from the conveying roller 16 in the conveyance direction of the sheet P. The reverse conveyance unit 6 includes reverse conveyance rollers 55.

A plurality of pairs of reverse conveyance rollers 55, that is, three pairs of reverse conveyance rollers 55 are provided below the sheet feeding unit 3, at intervals in the front-rear direction.

In a case of forming images on both sides of a sheet P, the sheet P passes through the fixing unit 23, and after the rear end portion of the sheet P passes the flapper 47 positioned at the sheet discharge position, the sheet P is conveyed toward the sheet discharge tray 51 and then is returned into the main body casing 2. Thereafter, the sheet P passes the flapper 47 positioned in the re-conveyance position, and is conveyed from the rear side toward the front side in the reverse conveyance unit 6 by the plurality of reverse conveyance rollers 55.

Thereafter, the sheet P having passed the plurality of reverse conveyance rollers 55 is conveyed upward from the front side of the sheet feeding tray 12 and is conveyed into the primary conveyance path 52. The sheet P having been conveyed into the primary conveyance path 52 is re-conveyed toward the image forming unit 4 by the conveying roller 16, and an image is formed on a side having an image not formed yet, and the sheet P is discharged onto the sheet discharge tray 51.

A path in which a sheet P having been switched by the switchback roller 50 is conveyed from the sheet discharge unit 5 toward the reverse conveyance unit 6, and joins the primary conveyance path 52 by the reverse conveyance unit 6 is referred to as a secondary conveyance path 56.

2. Main Motor and Process Motor

The printer 1 further includes as an example of a driving source, a main motor 68 and a process motor 69 inside the main body casing 2.

Figure 2B:
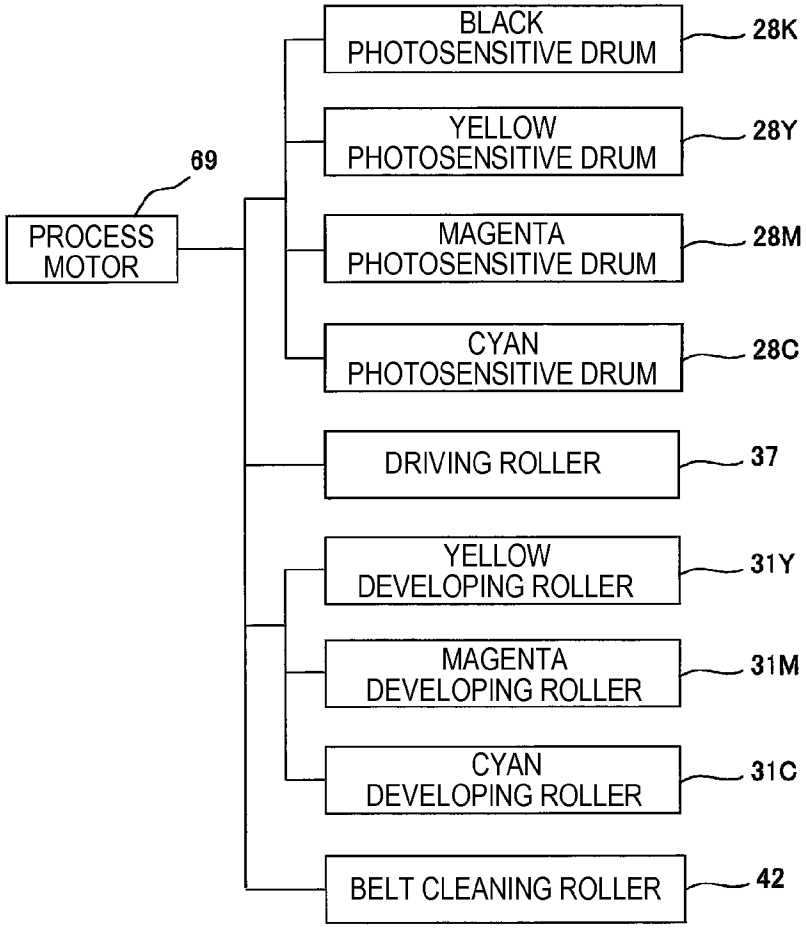
Figure 2A:
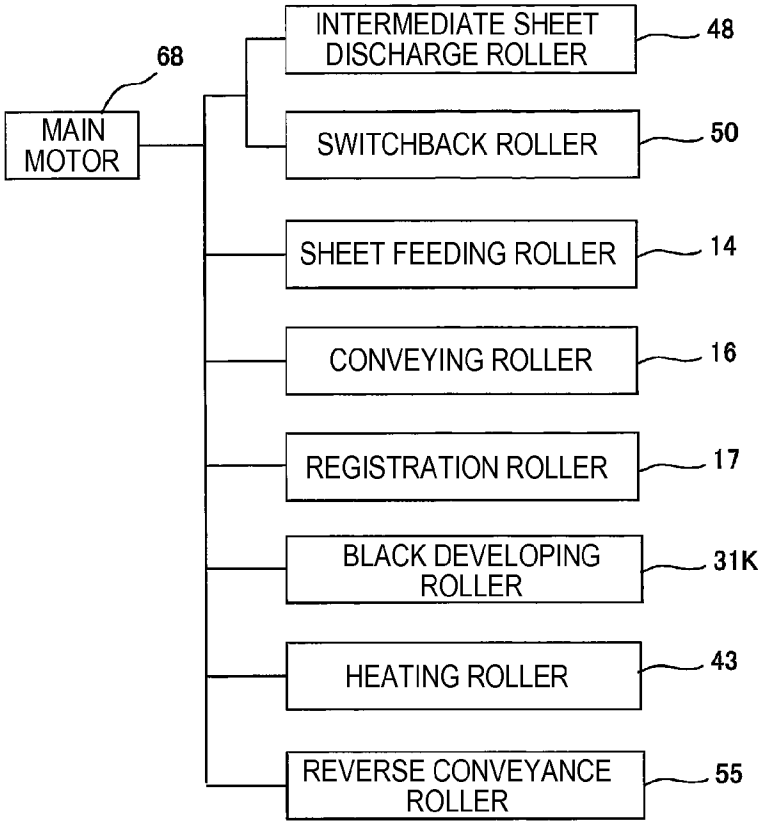

The main motor 68 is positioned at a rear portion on the left side at the substantial center of the main body casing 2 in the vertical direction. The main motor 68 is configured to generate one-direction rotational driving force when driven. As shown in FIG. 2A, the main motor 68 is configured to transmit the rotational driving force to the intermediate sheet discharge roller 48, the switchback roller 50, the sheet feeding roller 14, the conveying roller 16, the registration roller 17, the black developing roller 31K, the heating roller 43, and the reverse conveyance rollers 55, respectively. The main motor 68 is configured to generate driving force for reversal rotation when a sheet P is jammed inside the main body casing 2, thereby rotating the conveying roller 16, the registration roller 17, the reverse conveyance rollers 55, and the like in a reverse direction.

As shown in FIG. 1, the process motor 69 is positioned at the substantially center portion on the left side of the main body casing 2 in the vertical direction and the front-rear direction. The process motor 69 is configured to generate one-direction rotational driving force when driven. As shown in FIG. 2B, the process motor 69 is configured to transmit the rotational driving force to the black photosensitive drum 28K, the yellow photosensitive drum 28Y, the magenta photosensitive drum 28M, the cyan photosensitive drum 28C, the driving roller 37, the yellow developing roller 31Y, the magenta developing roller 31M, the cyan developing roller 31C, and the belt cleaning roller 42, respectively.

3. Configuration of Driving-Force Transmission Mechanism

The printer 1 includes a driving-force transmission mechanism 76 capable of switching the rotation direction of each of the switchback roller 50 and the intermediate sheet discharge roller 48 between a normal rotation direction and a reverse rotation direction, in order to form images on both sides of a sheet P, that is, one side and the other side of the sheet P.

The normal rotation direction of the switchback roller 50 and the intermediate sheet discharge roller 48 is the rotation direction for conveying a sheet P toward the sheet discharge tray 51 as described above, and the reverse rotation direction of the switchback roller 50 and the intermediate sheet discharge roller 48 is the rotation direction for conveying a sheet P from the discharge opening 49 toward the reverse conveyance unit 6 as described above.

Figure 4:
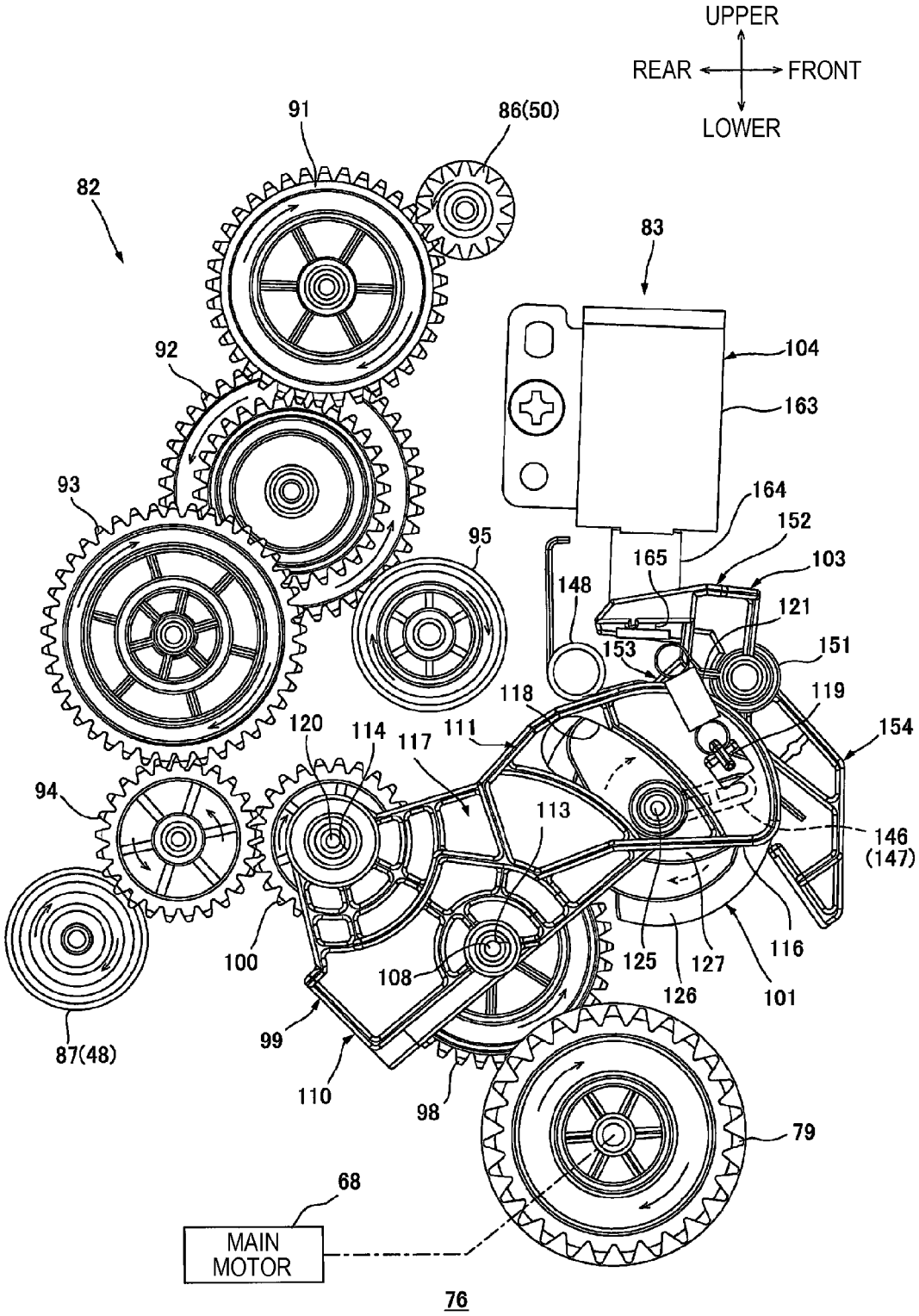
FIG. 4 is a side view showing the driving-force transmission mechanism of FIG. 3 in a first mode.
Figure 9:
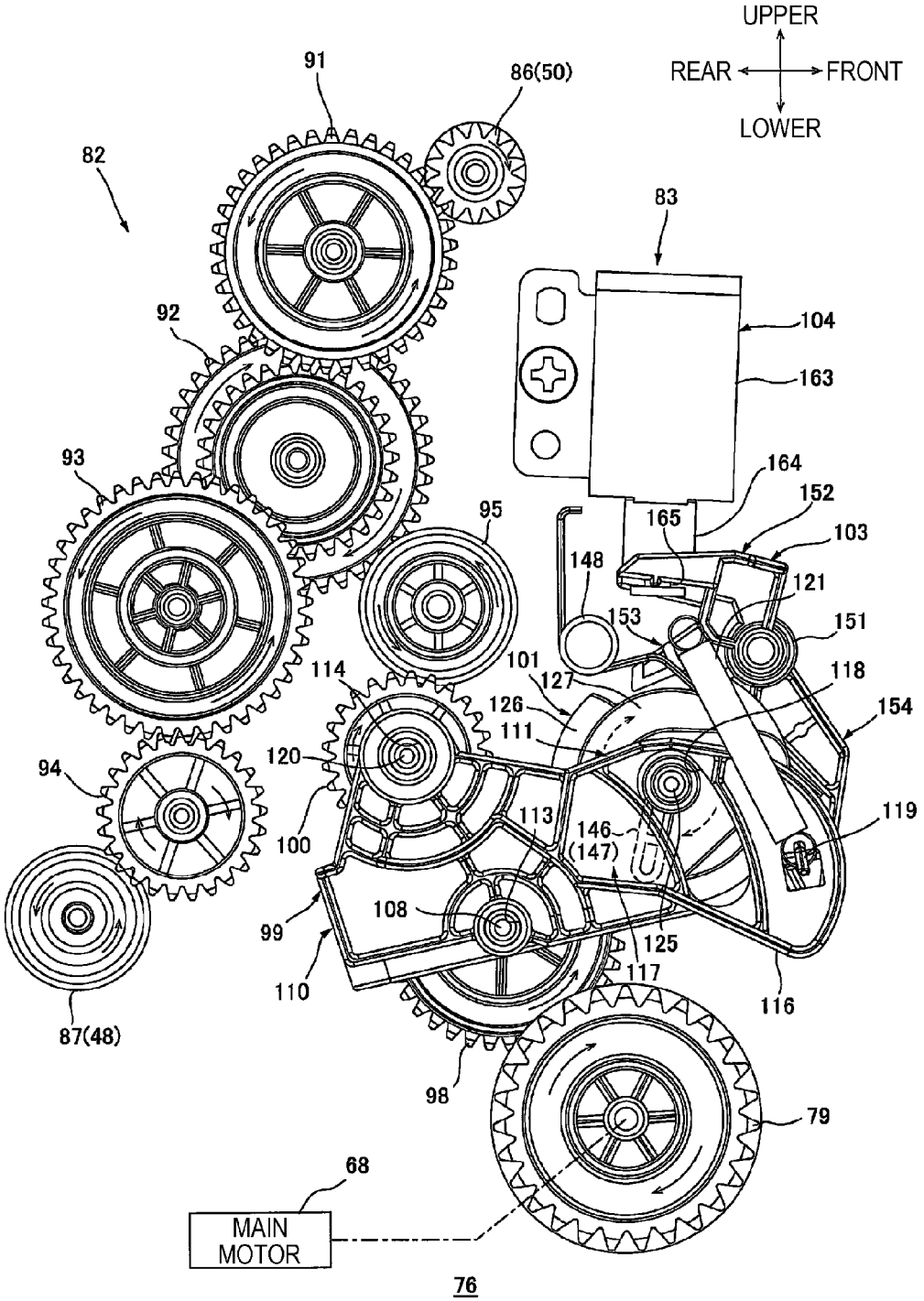
FIG. 9 is a side view showing the driving-force transmission mechanism of FIG. 3 in a second mode.

Specifically, as shown in FIG. 4, the switchback roller 50 is a driving roller which is disposed outside the conveyance path, and the normal rotation direction of the switchback roller 50 is a counterclockwise direction as seen in a left side view. The intermediate sheet discharge roller 48 is a driving roller which is disposed outside the conveyance path, and the normal rotation direction of the intermediate sheet discharge roller 48 is a clockwise direction as seen in a left side view. As shown in FIG. 9, the reverse rotation direction of the switchback roller 50 is a clockwise direction as seen in a left side view, and the reverse rotation direction of the intermediate sheet discharge roller 48 is a counterclockwise direction as seen in a left side view.

The rotation directions of each gear in a normal rotation mode and a reverse rotation mode (to be described below) are directions indicated by arrows shown in each drawing, and will not be described here.

Although not shown, the driving-force transmission mechanism 76 is positioned at a rear portion of the main body casing 2, and includes an input gear 79, a rotation-direction switchable gear train 82, and the switching unit 83.

(1) Input Gear

As shown in FIG. 4, the input gear 79 configures a lower portion of the driving-force transmission mechanism 76.

The input gear 79 is configured to receive the one-direction rotational driving force of the main motor 68 through a plurality of gears (not shown) of the inside of the main body casing 2, thereby rotating in a clockwise direction as seen in a left side view. The input gear 79 is a two-stage gear including a small-diameter gear and a large-diameter gear. The small-diameter gear is engaged with a drive gear 98 (to be described below), and the large-diameter gear is engaged with one of the plurality of gears (not shown) of the inside of the main body casing 2.

The rotational driving force which is generated from the main motor 68 is transmitted to gears provided at the left end portions of the sheet feeding roller 14, the conveying roller 16, the registration roller 17, the black developing roller 31K, the heating roller 43, and the reverse conveyance rollers 55, through the plurality of gears (not shown) of the main body casing 2, thereby rotating the sheet feeding roller 14, the conveying roller 16, the registration roller 17, the black developing roller 31K, the heating roller 43, and the reverse conveyance rollers 55.

(2) Rotation-Direction Switchable Gear Train

As shown in FIG. 4, the rotation-direction switchable gear train 82 configures an upper rear portion of the driving-force transmission mechanism 76. The rotation-direction switchable gear train 82 receives the one-direction rotational driving force of the main motor 68 through the input gear 79 and the switching unit 83. The rotation-direction switchable gear train 82 includes a switchback roller gear 86 which is positioned at an upper end portion of the rotation-direction switchable gear train 82, an intermediate sheet discharge roller gear 87 which is positioned at a lower end portion of the rotation-direction switchable gear train 82, and a first intermediate gear 91, a second intermediate gear 92, a third intermediate gear 93, a fourth intermediate gear 94, and a fifth intermediate gear 95 which are positioned between the switchback roller gear 86 and the intermediate sheet discharge roller gear 87.

Figure 3:
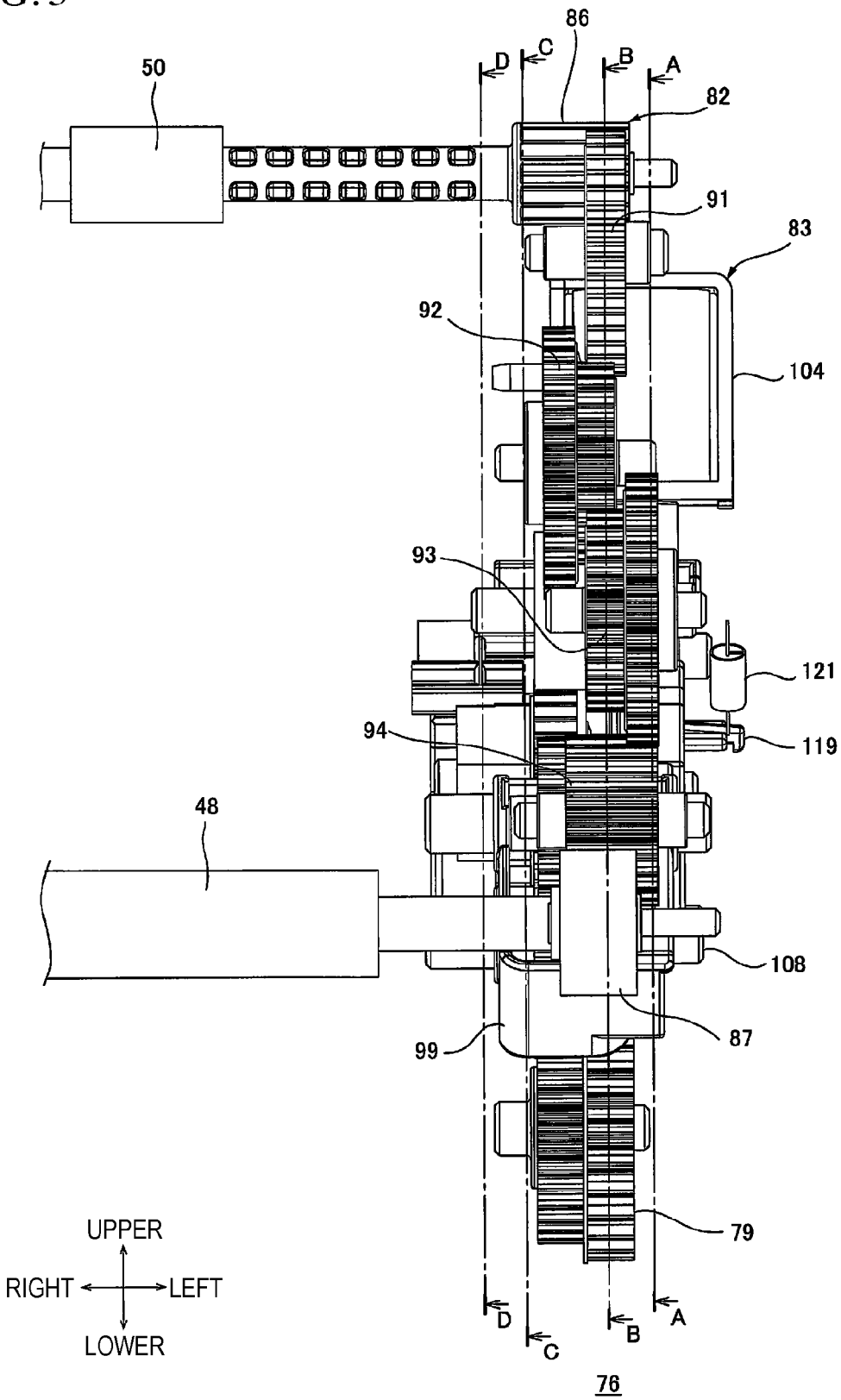
FIG. 3 is a rear view showing a driving-force transmission mechanism which is configured inside the printer shown in FIG. 1.

As shown in FIG. 3, the switchback roller gear 86 is provided at a left end portion of the switchback roller 50 so as to rotate integrally with the switchback roller 50. The switchback roller gear 86 is engaged with the first intermediate gear 91 (to be described below).

As shown in FIG. 4, the first intermediate gear 91 is positioned on the lower rear side of the switchback roller gear 86, and is rotatably supported with respect to the left wall of the main body casing 2. The first intermediate gear 91 is engaged with the switchback roller gear 86 and the second intermediate gear 92 (to be described below).

The second intermediate gear 92 is positioned below the first intermediate gear 91, and is rotatably supported with respect to the left wall of the main body casing 2. The second intermediate gear 92 is a two-stage gear including a small-diameter gear and a large-diameter gear. The small-diameter gear is engaged with the first intermediate gear 91 and the third intermediate gear 93 (to be described below), and the large-diameter gear is engaged with the fifth intermediate gear 95 (to be described below).

The third intermediate gear 93 is positioned on the lower rear side of the second intermediate gear 92, and is rotatably supported with respect to the left wall of the main body casing 2. The third intermediate gear 93 is a two-stage gear including a small-diameter gear and a large-diameter gear. The small-diameter gear is engaged with the second intermediate gear 92, and the large-diameter gear is engaged with the fourth intermediate gear 94 (to be described below).

The fourth intermediate gear 94 is positioned below the third intermediate gear 93 and on the upper front side of the intermediate sheet discharge roller gear 87 (to be described below), and is rotatably supported with respect to the left wall of the main body casing 2. The fourth intermediate gear 94 is engaged with the third intermediate gear 93 and the intermediate sheet discharge roller gear 87 (to be described below). As will be described below in detail, the fourth intermediate gear 94 is configured such that the rotational driving force generated from the main motor 68 is transmitted through the switching unit 83.

The fifth intermediate gear 95 is positioned on the lower front side of the second intermediate gear 92, and is rotatably supported with respect to the left wall of the main body casing 2. The fifth intermediate gear 95 is engaged with the second intermediate gear 92. As will be described below in detail, the fifth intermediate gear 95 is configured such that the rotational driving force generated from the main motor 68 is transmitted through the switching unit 83.

The intermediate sheet discharge roller gear 87 is provided at a left end portion of the intermediate sheet discharge roller 48, so as to rotate integrally with the intermediate sheet discharge roller 48. The intermediate sheet discharge roller gear 87 is engaged with the fourth intermediate gear 94.

(3) Switching Unit

The switching unit 83 configures a portion of the driving-force transmission mechanism 76 between the input gear 79 and the rotation-direction switchable gear train 82. The switching unit 83 includes the drive gear 98, a holder 99, a pendulum gear 100, a sector gear 101 (an example of a switching gear), a lever 103 (an example of an engaging member), and a solenoid switch 104 (an example of a switching element).

(3-1) Drive Gear, Holder, and Pendulum Gear

The drive gear 98 is positioned on the upper rear side of the input gear 79, and a drive support shaft 108 of the drive gear 98 is supported on the left wall of the main body casing 2, whereby the drive gear 98 is rotatably supported with respect to the main body casing 2. The drive support shaft 108 of the drive gear 98 is inserted through a drive gear shaft insertion hole 113 of the holder 99 (to be described below), whereby the drive gear 98 supports the holder 99 such that the holder 99 is rotatable. The drive gear 98 is engaged with the input gear 79 and the pendulum gear 100 (to be described below).

The holder 99 includes a gear supporting unit 110 and a switching-power receiving unit 111. The following description will be made with reference to directions referring to the posture of the holder 99 in the normal rotation mode, specifically, the following description will be made with reference to the directions shown in FIG. 4.

Figure 6:
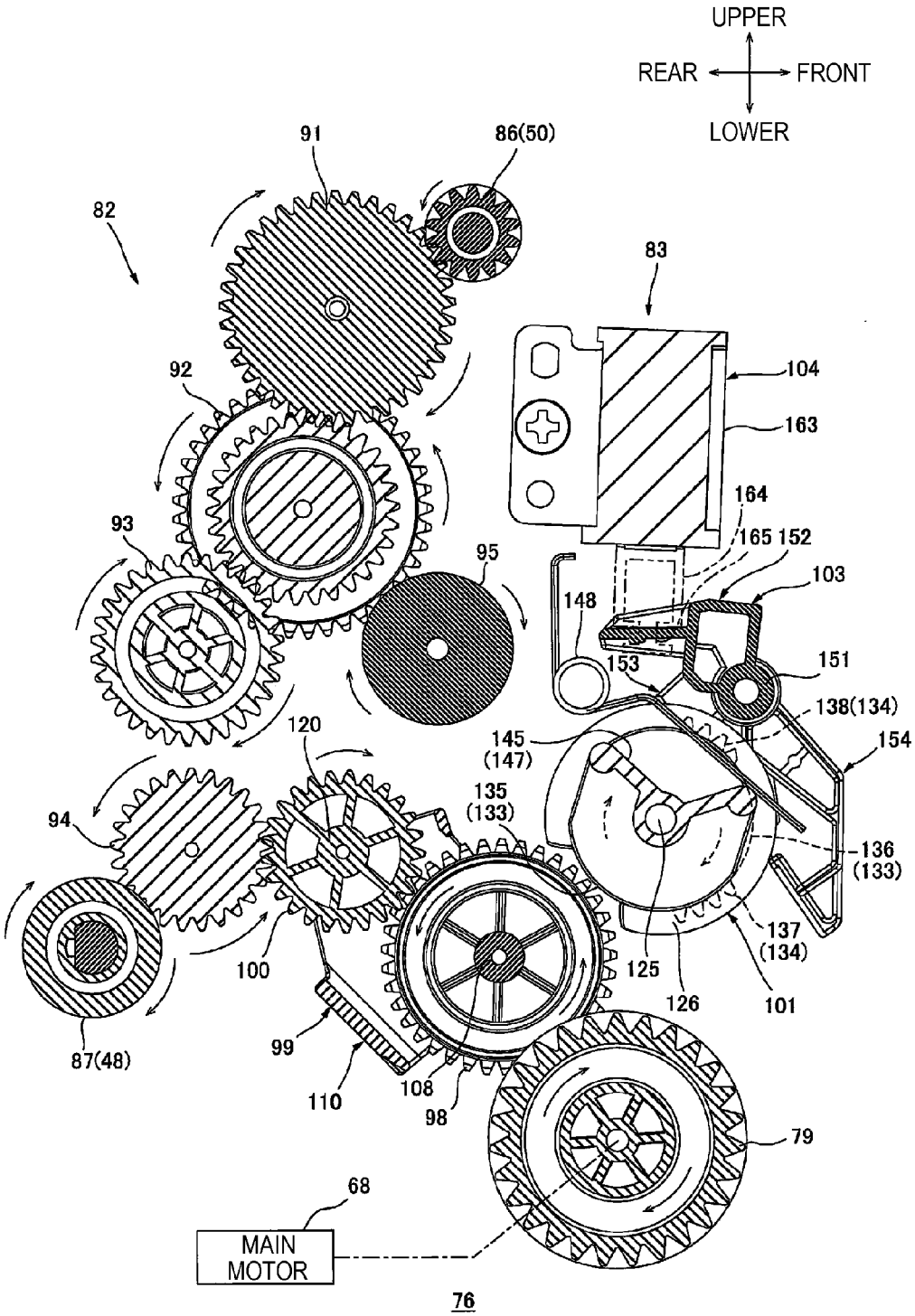
FIG. 6 is a cross-sectional view of the driving-force transmission mechanism of FIG. 3 in the first mode as taken along a line B-B.

The gear supporting unit 110 configures a rear portion of the holder 99, and is formed in a flat plate shape which has a substantially rectangular shape as seen in a side view and has substantially a letter "U" shape as seen in a plan view, so as to sandwich the pendulum gear 100 (to be described below) from both outer sides in the left-right direction, as shown in FIGS. 4 and 6. As shown in FIG. 4, the gear supporting unit 110 includes the drive gear shaft insertion hole 113 and a pendulum gear shaft insertion hole 114.

The drive gear shaft insertion hole 113 is formed in the left-right direction on the lower side of the substantially center portion of the gear supporting unit 110 in the front-rear direction such that the drive support shaft 108 of the drive gear 98 can be inserted therethrough.

The pendulum gear shaft insertion hole 114 is formed in the left-right direction at an upper rear end portion of the gear supporting unit 110 such that a pendulum gear shaft 120 of the pendulum gear 100 can be inserted therethrough.

The switching-power receiving unit 111 configures a front portion of the holder 99. The switching-power receiving unit 111 includes a frame portion 116 and a cover portion 117.

Figure 5:
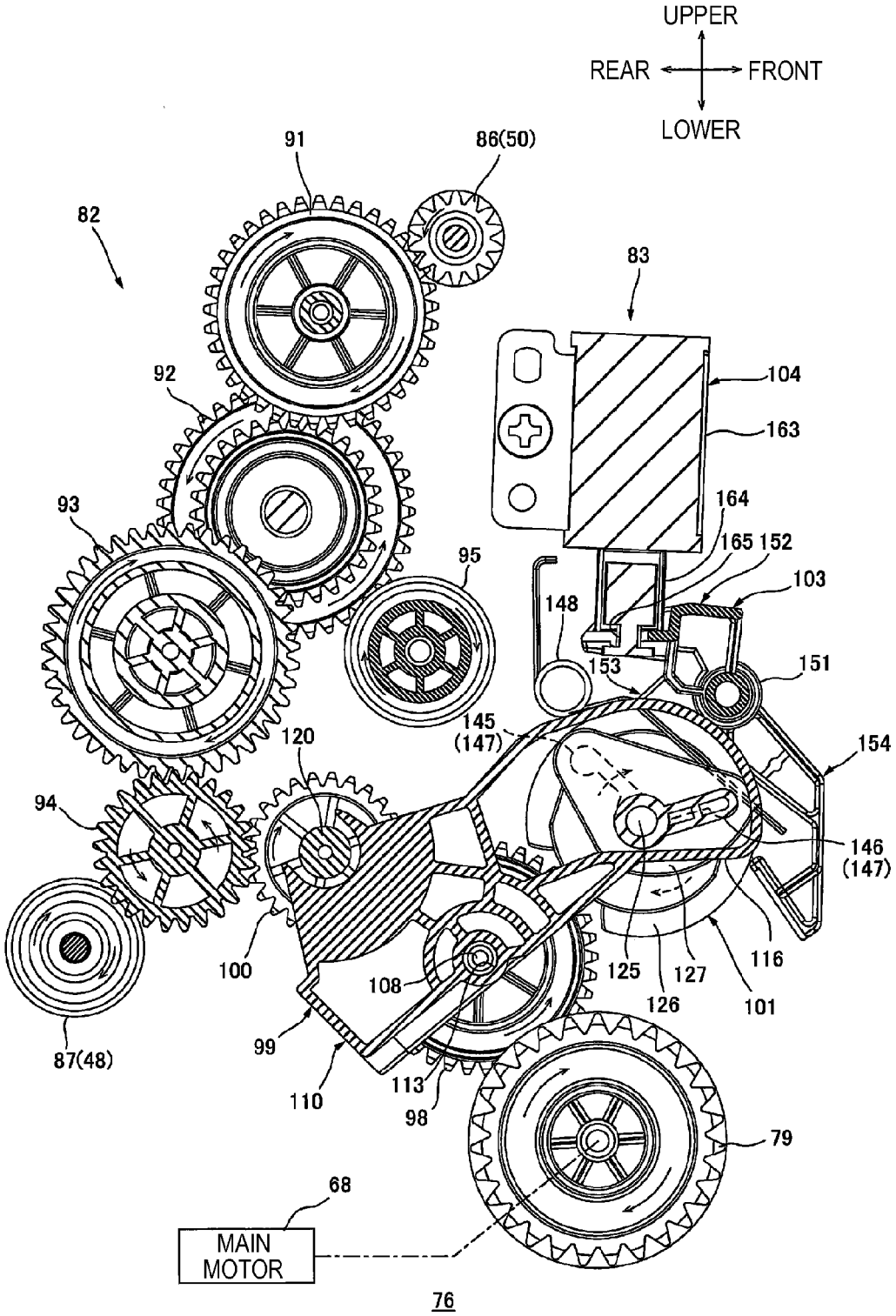
FIG. 5 is a cross-sectional view of the driving-force transmission mechanism of FIG. 3 in the first mode as taken along a line A-A.

As shown in FIG. 5, the frame portion 116 extends continuously from a front end portion of the gear supporting unit 110 toward the front side, and has substantially a rectangular frame shape having a hole formed in the left-right direction, as seen in a side view.

As shown in FIG. 4, the cover portion 117 is formed in a thin plate shape to close the left end portion of the frame portion 116. The cover portion 117 has a long hole 118 and a hook 119.

The long hole 118 is formed in the left-right direction from an upper rear end portion of the cover portion 117 to a substantially center portion of the cover portion 117 in the front-rear direction as seen in a side view, along an arc having a center at the drive gear shaft insertion hole 113 of the gear supporting unit 110.

The hook 119 is positioned at a portion of the cover portion 117 at the front side of the long hole 118. As shown in FIG. 3, the hook 119 has substantially a claw shape protruding from the left surface of the cover portion 117 toward the left side and bent toward the lower front side.

The pendulum gear shaft 120 of the pendulum gear 100 is supported in the pendulum gear shaft insertion hole 114 of the holder 99, whereby the pendulum gear 100 is rotatably supported with respect to the holder 99. The pendulum gear 100 is always engaged with the drive gear 98. The pendulum gear 100 is configured to be selectively engaged with the fourth intermediate gear 94 or the fifth intermediate gear 95, by swinging of the holder 99 around the drive support shaft 108.

Specifically, as shown in FIG. 4, if the holder 99 is rotated around the drive support shaft 108 in a counterclockwise direction as seen in a left side view, the pendulum gear 100 is positioned at a first engagement position where the pendulum gear 100 is engaged with the fourth intermediate gear 94 from the front side. Therefore, the one-direction rotational driving force of the main motor 68 is transmitted to the switchback roller 50 through the input gear 79, the drive gear 98, the pendulum gear 100, the fourth intermediate gear 94, the third intermediate gear 93, the second intermediate gear 92, the first intermediate gear 91, and the switchback roller gear 86. As a result, the switchback roller 50 rotates in the normal rotation direction. Also, the one-direction rotational driving force of the main motor 68 is transmitted to the intermediate sheet discharge roller 48 through the input gear 79, the drive gear 98, the pendulum gear 100, the fourth intermediate gear 94, and the intermediate sheet discharge roller gear 87. As a result, the intermediate sheet discharge roller 48 rotates in the normal rotation direction.

The gear arrangement of the fourth intermediate gear 94, the third intermediate gear 93, the second intermediate gear 92, the first intermediate gear 91, and the switchback roller gear 86 which transmit the rotational driving force from the pendulum gear 100 for rotating the switchback roller 50 in the normal rotation direction in a case where the holder 99 is rotated in a counterclockwise direction as seen in a left side view is considered as an example of a first gear train. A state in which the pendulum gear 100 of the switching unit 83 is held at the first engagement position where the pendulum gear 100 is engaged with the first gear train, such that the one-direction rotational driving force of the main motor 68 is transmitted to the first gear train and the switchback roller 50 and the intermediate sheet discharge roller 48 rotate in their normal rotation directions is referred to as a normal rotation mode (an example of a first mode of the switching unit 83).

Also, if the holder 99 is rotated around the drive support shaft 108 in a clockwise direction as seen in a left side view, the pendulum gear 100 is positioned at a second engagement position where the pendulum gear is engaged with the fifth intermediate gear 95 from the lower side, as shown in FIG. 9. As a result, the one-direction rotational driving force of the main motor 68 is transmitted to the switchback roller 50 through the input gear 79, the drive gear 98, the pendulum gear 100, the fifth intermediate gear 95, the second intermediate gear 92, the first intermediate gear 91, and the switchback roller gear 86. As a result, the switchback roller 50 rotates in the reverse rotation direction. Also, the one-direction rotational driving force of the main motor 68 is transmitted to the intermediate sheet discharge roller 48 through the input gear 79, the drive gear 98, the pendulum gear 100, the fifth intermediate gear 95, the second intermediate gear 92, the third intermediate gear 93, the fourth intermediate gear 94, and the intermediate sheet discharge roller gear 87. As a result, the intermediate sheet discharge roller 48 rotates in the reverse rotation direction.

The gear arrangement of the fifth intermediate gear 95, the second intermediate gear 92, the first intermediate gear 91, and the switchback roller gear 86 which transmit the rotational driving force from the pendulum gear 100 for rotating the switchback roller 50 in the reverse rotation direction in a case where the holder 99 is rotated in a clockwise direction as seen in a left side view is considered as an example of a second gear train. A state in which the pendulum gear 100 of the switching unit 83 is held at the second engagement position where the pendulum gear 100 is engaged with the second gear train, such that the one-direction rotational driving force of the main motor 68 is transmitted to the second gear train and the switchback roller 50 and the intermediate sheet discharge roller 48 rotate in their reverse rotation directions is referred to as a reverse rotation mode (an example of a second mode of the switching unit 83).

Figure 13:
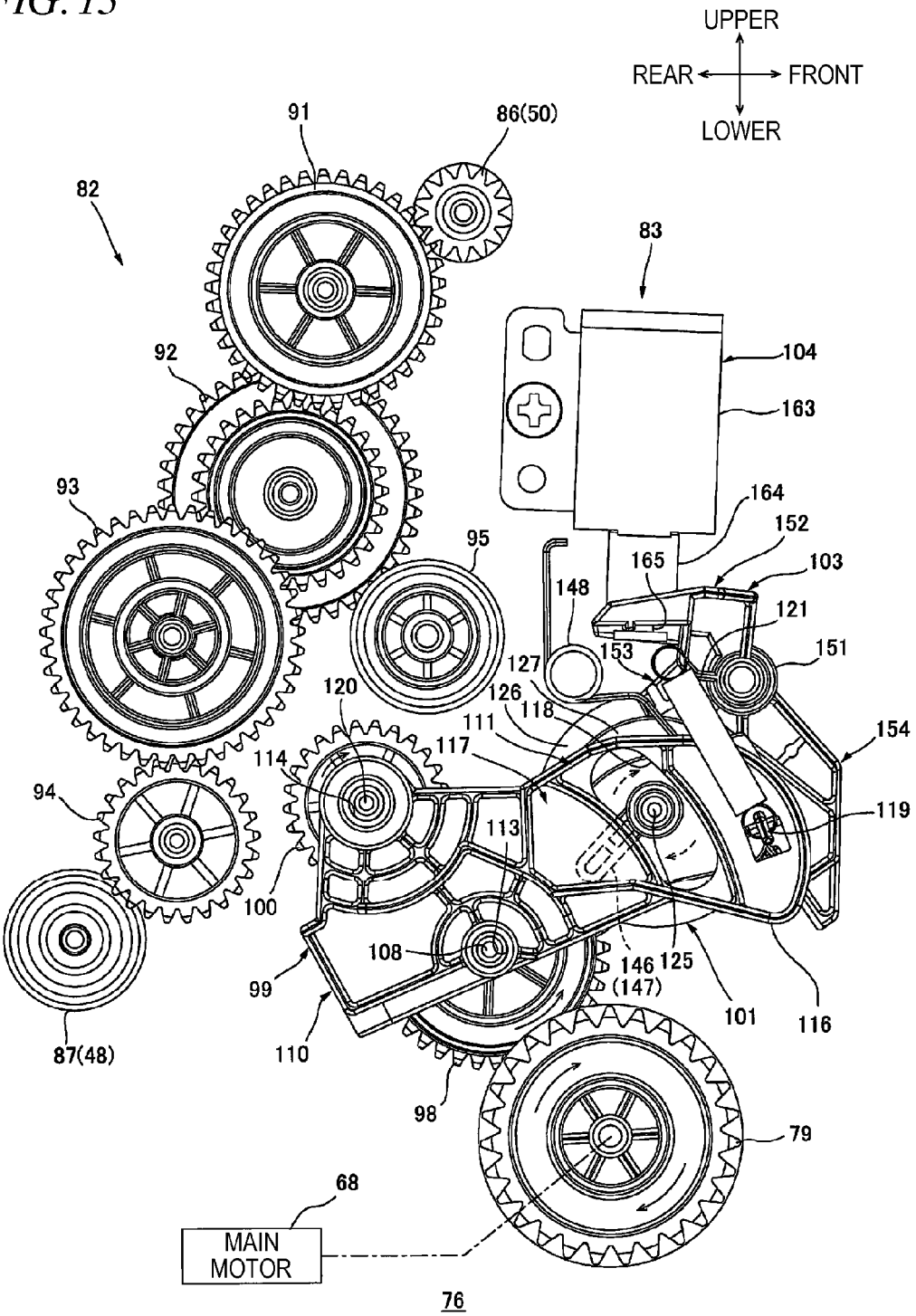
FIG. 13 is a side view showing the driving-force transmission mechanism of FIG. 3 in a third mode.

The pendulum gear 100 is rotated around the drive support shaft 108 so as to be positioned at a middle position between the fourth intermediate gear 94 and the fifth intermediate gear 95, as shown in FIG. 13, thereby being positioned at a disengagement position where the pendulum gear 100 is not engaged with any of the fourth intermediate gear 94 and the fifth intermediate gear 95. A state in which the pendulum gear 100 of the switching unit 83 is held at the disengagement position where the pendulum gear 100 is not engaged with any of the first gear train and the second gear train, such that the one-direction rotational driving force of the main motor 68 is not transmitted to any of the first gear train and the second gear train and the switchback roller 50 and the intermediate sheet discharge roller 48 do not rotate is referred to as a stack mode (an example of a third mode of the switching unit 83).

Further, in the main body casing 2, a tension spring 121 is positioned so as to connect the hook 119 of the holder 99, and a hook (not shown) which is provided at a portion of the holder 99 on the rear side from the hook 119.

Therefore, the holder 99 is always biased by the biasing force of the tension spring 121, such that the holder 99 rotates around the drive support shaft 108 in a counterclockwise direction, that is, the pendulum gear 100 is positioned at the first engagement position where the pendulum gear is engaged with the fourth intermediate gear 94, as shown in FIG. 4.

(3-2) Sector Gear

The sector gear 101 is positioned on the upper front side of the drive gear 98, and is rotatably supported with respect to the left wall of the main body casing 2. As shown in FIGS. 8A to 8D, the sector gear 101 includes a sector gear shaft 125, a first partition plate 126, a partially toothed gear 130, a cylindrical unit 131 (an example of a regulating member), a V-shaped cam 145 (an example of a second cam), a second partition plate 127, and an I-shaped cam 146 (an example of a first cam). The following description will be made with reference to directions referring to the posture of the sector gear 101 in the normal rotation mode, specifically, the following description will be made with reference to the directions shown in FIGS. 8A to 8D.

The sector gear shaft 125 is formed at a center portion of the sector gear 101 as seen in a side view so as to extend in a substantially columnar shape in the left-right direction. As shown in FIG. 4, the left end portion of the sector gear shaft 125 is inserted through the long hole 118 of the holder 99.

As shown in FIGS. 8A to 8D, the first partition plate 126 is at a substantially center portion of the sector gear shaft 125 in the left-right direction and has a flat plate shape having a substantially circular shape having a diameter larger than the diameter of the sector gear shaft 125, as seen in a side view.

The partially toothed gear 130 has a substantially cylindrical shape extending from the right surface of the first partition plate 126 toward the right side. The partially toothed gear 130 has non-tooth portions 133 and toothed portions 134.

The non-tooth portions 133 include a first non-tooth portion 135 which is in a range of about 45° on the outer periphery of a lower rear portion of the partially toothed gear 130 and has no gear teeth, and a second non-tooth portion 136 which is at a position deviated in a clockwise direction from the first non-tooth portion 135 by about 90° as seen in a right side view, that is, in a range of about 90° on the outer periphery of a front portion of the partially toothed gear 130 and has gear teeth.

The toothed portions 134 are portions where gear teeth are formed, except for the non-tooth portions 133 of the partially toothed gear 130. Specifically, the toothed portions 134 include a first toothed portion 137 which is adjacent to the first non-tooth portion 135 in a clockwise direction as seen in the right side view of the first non-tooth portion 135, and is adjacent to the second non-tooth portion 136 in a counterclockwise direction as seen in the right side view of the second non-tooth portion 136, and a second toothed portion 138 which is adjacent to the second non-tooth portion 136 in a clockwise direction as seen in the right side view of the second non-tooth portion 136, and is adjacent to the first non-tooth portion 135 in a counterclockwise direction as seen in the right side view of the first non-tooth portion 135.

The cylindrical unit 131 is formed in a substantially cylindrical shape extending from the right surface of the first partition plate 126 positioned on the inner side than the partially toothed gear 130, toward the right side, as seen in a side view. The cylindrical unit 131 has a diameter smaller than that of the partially toothed gear 130, and is positioned such that the right end portion of the cylindrical unit 131 is positioned between the right end portion of the partially toothed gear 130 and the right end portion of the sector gear shaft 125. The cylindrical unit 131 has protruding portions 140.

The protruding portions 140 include a first protruding portion 141 which is at an upper rear portion of the outer periphery of the cylindrical unit 131 and protrudes toward the outside in a radial direction, and a second protruding portion 142 which is at a lower portion of the outer periphery of the cylindrical unit 131 and protrudes toward the outside in the radial direction.

The first protruding portion 141 has a substantially triangular shape protruding from the outer circumferential surface of the cylindrical unit 131 toward the outside in the radial direction of the cylindrical unit 131, as seen in a side view. A surface of the first protruding portion 141 extending along the radial direction of the cylindrical unit 131 is defined as a first engagement surface 143. The first engagement surface 143 is a surface of the cylindrical unit 131, which faces a counterclockwise direction in a circumferential direction as seen in a right side view. The first protruding portion 141 is formed from the right end portion of the partially toothed gear 130 to the right end portion of the cylindrical unit 131 as seen in a front view, such that the tip end of the first protruding portion overlaps a portion of the second toothed portion 138 of the partially toothed gear 130 as seen in a side view.

The second protruding portion 142 is at a position of the outer periphery of the cylindrical unit 131 deviated from the first protruding portion 141 in a clockwise direction by 150° as seen in a right side view, and has a substantially triangular shape protruding from the outer circumferential surface of the cylindrical unit 131 toward the outside in the radial direction of the cylindrical unit 131, as seen in a side view. A surface of the second protruding portion 142 extending along the radial direction of the cylindrical unit 131 is defined as a second engagement surface 144. The second engagement surface 144 is a surface of the cylindrical unit 131, which faces a counterclockwise direction in a circumferential direction as seen in a right side view. The second protruding portion 142 is formed over a range from the right end portion of the partially toothed gear 130 to a middle position between the right end portion of the partially toothed gear 130 and the right end portion of the cylindrical unit 131 as seen in a front view, such that the tip end of the second protruding portion overlaps a portion of the first toothed portion 137 of the partially toothed gear 130 as seen in a side view. That is, the first protruding portion 141 has a portion which overlaps the second protruding portion 142 when the first protruding portion 141 is projected in the circumferential direction of the cylindrical unit 131, and a portion which does not overlap the second protruding portion 142 when the first protruding portion 141 is projected in the circumferential direction of the cylindrical unit 131

The V-shaped cam 145 extends from the left surface of the first partition plate 126 toward the left side. As shown in FIG. 6, the V-shaped cam 145 is formed in a substantial rod shape having substantially a V shape extending in a radial direction from the outer circumferential surface of the sector gear shaft 125 as seen in a side view. Specifically, the V-shaped cam 145 is formed such that one end portion of the V-shaped cam extends from the sector gear shaft 125 toward the second non-tooth portion 136, and the other end portion of the V-shaped cam extends from the sector gear shaft 125 toward the second toothed portion 138. The tip ends of the one end portion and the other end portion of the V-shaped cam 145 have substantially circular shapes as seen in a side view.

The second partition plate 127 is positioned on the left side of the V-shaped cam 145 with a gap in a left direction from the first partition plate 126, and the right surface of the second partition plate 127 is connected to the V-shaped cam 145. The second partition plate 127 has a substantially flat plate shape larger than the diameter of the sector gear shaft 125. Specifically, the second partition plate 127 has a substantially triangular shape having the sector gear shaft 125, one end portion of the V-shaped cam 145, and the vicinity of the other end portion of the V-shaped cam 145 as vertexes as seen in a side view. Each of the vertexes of the second partition plate 127 has a substantially semi-circular shape as seen in a side view. The second partition plate 127 has such a size that the second partition plate 127 falls in the first partition plate 126 and the V-shaped cam 145 falls in the second partition plate 127.

The I-shaped cam 146 is formed on the left side from the second partition plate 127, in a substantial rod shape extending from the outer circumferential surface of the sector gear shaft 125 toward the outside in a radial direction. The right surface of the I-shaped cam 146 is connected to the second partition plate 127. The I-shaped cam 146 extends toward the upper front vertex of the second partition plate 127. That is, the I-shaped cam 146 overlaps one end portion of the V-shaped cam 145 extending toward the second non-tooth portion 136 when projected in the left-right direction. The I-shaped cam 146 extends in a direction of about two o'clock from the sector gear shaft 125 as seen in a left side view, in the normal rotation mode (to be described below). The tip end of the I-shaped cam 146 has a substantially circular shape as seen in a side view.

The second partition plate 127, the V-shaped cam 145, and the I-shaped cam 146 are configured as a cam 147.

(3-3) Lever and Solenoid Switch

Figure 7A:
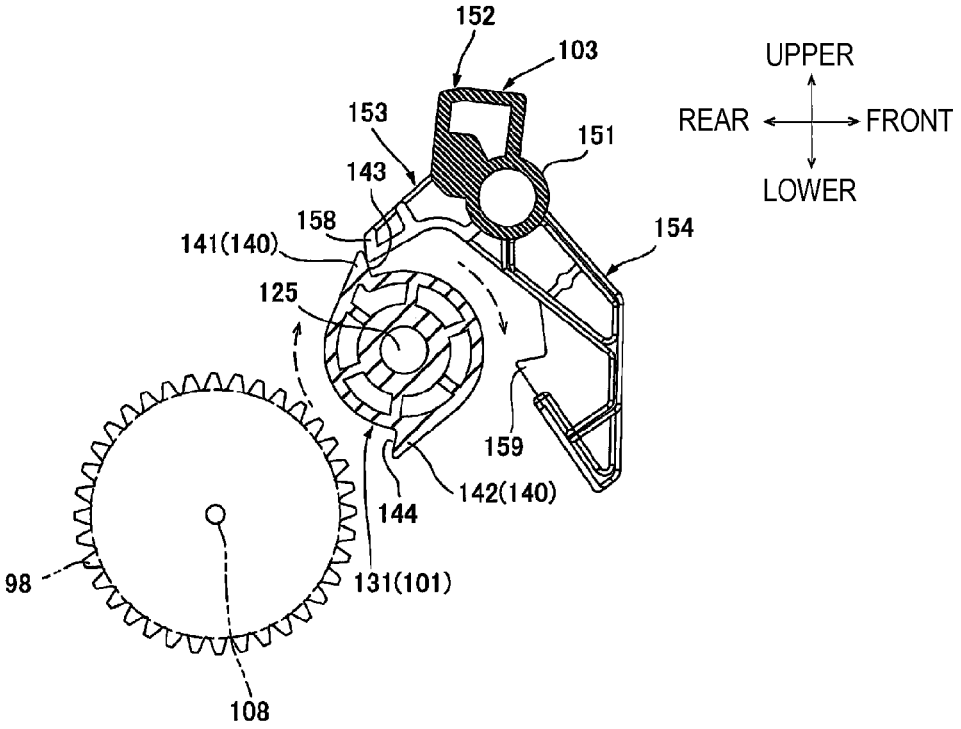
Figure 7B:
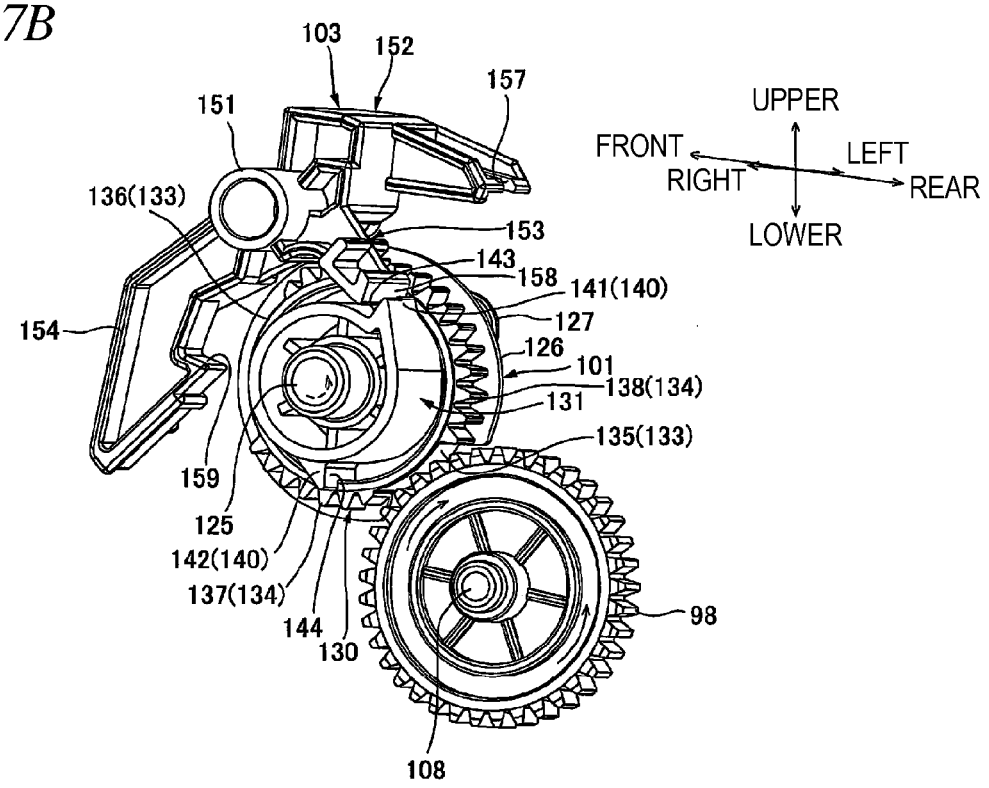
Figures 8A, 8B, 8C, 8D:
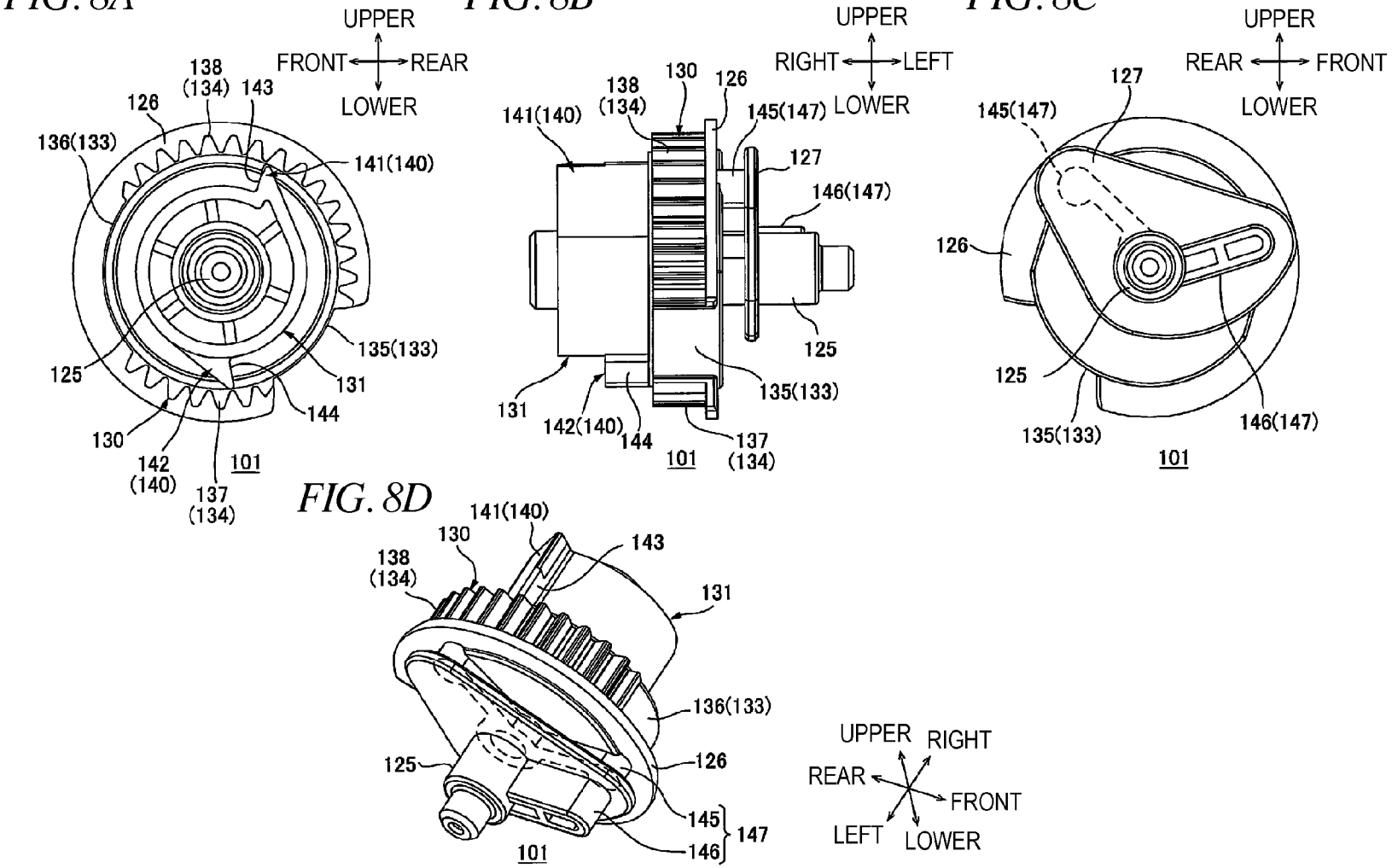

As shown in FIG. 4, the lever 103 is positioned on the upper front side of the sector gear 101, and is supported so as to be able to swing with respect to the left wall of the main body casing 2. As shown in FIGS. 7A and 7B, the lever 103 includes a lever shaft 151, a connection portion 152, a first engagement portion 153, and a second engagement portion 154. The following description will be made with reference to directions referring to the state of the lever 103 in the normal rotation mode, specifically, the following description will be made with reference to the directions shown in FIGS. 7A and 7B.

The lever shaft 151 is formed in a substantially cylindrical shape extending in the left-right direction.

The connection portion 152 is formed in a substantial claw shape protruding from the outer circumferential surface of an upper portion of the lever shaft 151 toward the upper rear side, and a hook portion 165 of the solenoid switch 104 (to be described below) is fit therein.

The first engagement portion 153 has a shape protruding from the outer circumferential surface of a lower rear portion of the lever shaft 151 toward the lower rear side. The first engagement portion 153 has a first engaging claw 158.

The first engaging claw 158 configures a lower rear end portion of the first engagement portion 153, and is formed in a substantially prismatic shape having a substantially rectangular shape as seen in a side view. The first engaging claw 158 is disposed so as to overlap the first protruding portion 141 and the second protruding portion 142 in the axial direction of the cylindrical unit 131, that is, in the left-right direction. In other words, the first engaging claw 158 is disposed so as to overlap the first protruding portion 141 and the second protruding portion 142 when the cylindrical unit 131 is projected in the circumferential direction.

The second engagement portion 154 is formed to protrude from the outer circumferential surface of a lower front portion of the lever shaft 151 toward the lower front side. The second engagement portion 154 has a second engaging claw 159.

The second engaging claw 159 configures a lower front end portion of the second engagement portion 154, and is formed in a claw shape bent toward the rear side. The second engaging claw 159 is disposed so as not to overlap the second protruding portion 142 and so as to overlap the first protruding portion 141, in the axial direction of the cylindrical unit 131, that is, in the left-right direction. In other words, the second engaging claw 159 is disposed such that the second engaging claw does not overlap the second protruding portion 142 and overlaps the first protruding portion 141 when the cylindrical unit 131 is projected in the circumferential direction.

Further, a shaft (not shown) of the main body casing 2 on the upper front side of the sector gear 101 is inserted through the lever shaft 151, whereby the lever 103 is supported to be able to swing with respect to the left wall of the main body casing 2. The lever 103 can swing between a first engagement position where the first engaging claw 158 is close to the cylindrical unit 131 of the sector gear 101 and the second engaging claw 159 is separated from the cylindrical unit 131 of the sector gear 101, as shown in FIGS. 7A, 7B, 16A, and 16B, and a second engagement position where the first engaging claw 158 is relatively separated from the cylindrical unit 131 of the sector gear 101, and the second engaging claw 159 is relatively close to the cylindrical unit 131 of the sector gear 101, as shown in FIGS. 12A and 12B.

That is, the lever 103 can move between the first engagement position where the first engagement portion 153 can be engaged with the first protruding portion 141 and the second protruding portion 142, and the second engagement portion 154 is not engaged with the first protruding portion 141 and the second protruding portion 142, and the second engagement position where the second engagement portion 154 can be engaged with the first protruding portion 141, and the first engagement portion 153 is not engaged with the first protruding portion 141 and the second protruding portion 142.

Figure 12A:
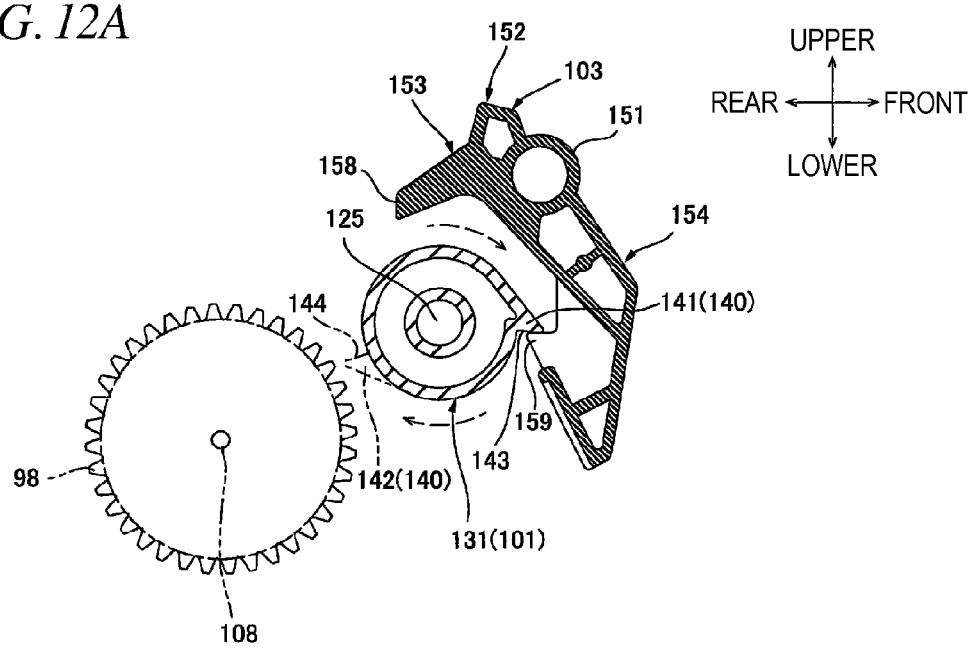
Figure 12B:
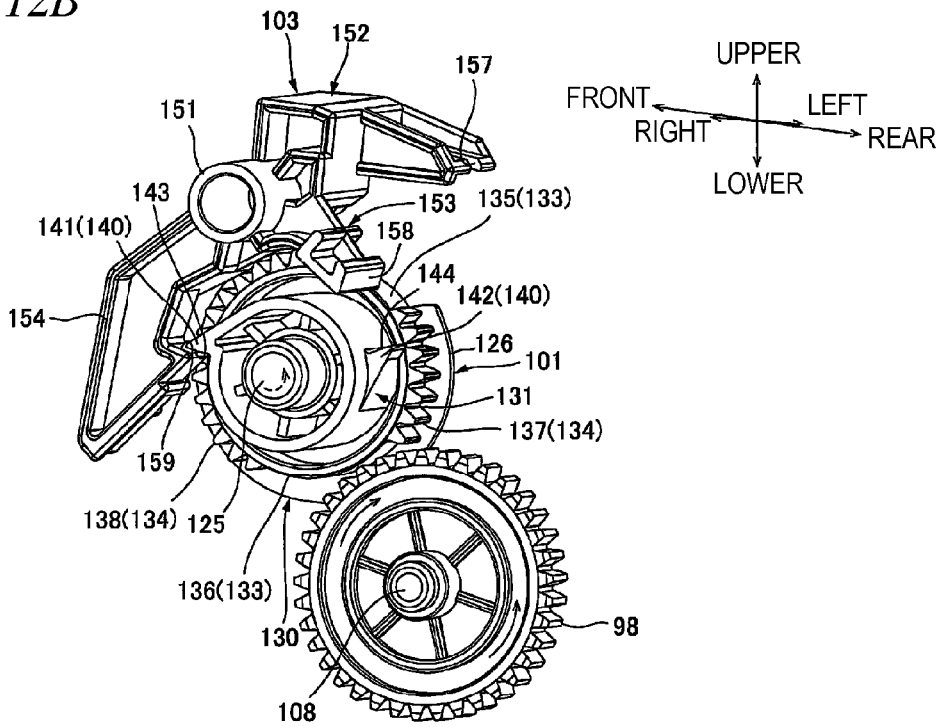

The solenoid switch 104 is positioned on the lever 103 as shown in FIG. 4 so as to switch the lever 103 between the first engagement position shown in FIGS. 7A, 7B, 16A, and 16B and the second engagement position shown in FIGS. 12A and 12B, and is fixed with respect to the left wall of the main body casing 2. The solenoid switch 104 receives a signal from a CPU 72 (to be described below), thereby being switched between an excited state (an example of a second state) in which a current flows, and a non-excited state (an example of a first state) in which no current flows. The solenoid switch 104 includes a main body portion 163, and an advance/retreat portion 164.

The main body portion 163 is formed in a substantial box shape having an open lower side, and includes an electromagnet (not shown) and a compression spring (not shown) therein.

The advance/retreat portion 164 is formed in a substantially cylindrical shape protruding downward from the open portion of the main body portion 163. The advance/retreat portion 164 has the hook portion 165.

The hook portion 165 is at the lower end portion of the advance/retreat portion 164, and has a groove shape depressed from the circumferential surface of the advance/retreat portion 164 toward the center of the advance/retreat portion 164. The hook portion 165 is fit with respect to the connection portion 152 of the lever 103.

When the solenoid switch 104 is in the non-excited state, the advance/retreat portion 164 advances by biasing force of the compression spring (not shown) of the inside of the main body portion 163 such that the hook portion 165 is relatively separated from the main body portion 163, whereby the lever 103 is held at the first engagement position shown in FIGS. 7A, 7B, 16A, and 16B. When the solenoid switch 104 is in the excited state, a current flows in the electromagnet (not shown) of the inside of the main body portion 163, whereby the electromagnet is magnetized, and the upper portion of the advance/retreat portion 164 is pulled further toward the upper side of the main body portion 163 by the magnetic force, whereby the advance/retreat portion 164 retreats against the biasing force of the compression spring (not shown) of the inside of the main body portion 163 such that the hook portion 165 relatively approaches the main body portion 163, whereby the lever 103 is held at the second engagement position shown in FIGS. 12A and 12B.

As shown in FIG. 6, the switching unit 83 includes a torsion spring 148 (an example of a biasing member) for biasing the V-shaped cam 145 of the sector gear 101 from the upper front side toward the lower rear side. As a result, the torsion spring 148 biases the sector gear 101 by its biasing force such that the sector gear 101 rotates in a clockwise direction as seen in a left side view.

Meanwhile, the solenoid switch 104 is set to the non-excited state or the excited state, whereby the lever 103 is positioned at the first engagement position or the second engagement position such that the first engaging claw 158 of the first engagement portion 153 or the second engaging claw 159 of the second engagement portion 154 is engaged with the protruding portion 140 of the cylindrical unit 131, whereby the lever 103 and the solenoid switch 104 regulate rotation of the above-described sector gear 101 by the biasing force of the torsion spring 148 in a clockwise direction as seen in a left side view. When rotation of the sector gear 101 is regulated, a non-tooth portion 133 (the first non-tooth portion 135 or the second non-tooth portion 136) of the partially toothed gear 130 faces the drive gear 98.

Accordingly, the above-described sector gear 101 is configured such that even though the drive gear 98 always rotates, the toothed portion 134 of the partially toothed gear 130 is engaged with the drive gear 98, thereby receiving the one-direction rotational driving force of the main motor 68, and is configured to cause the non-tooth portion 133 of the partially toothed gear 130 face the drive gear 98 such that the driving force generated from the main motor 68 is not transmitted.

Specifically, in the normal rotation mode, while the torsion spring 148 biases one end portion of the V-shaped cam 145 from the upper front side toward the lower rear side as shown in FIG. 6, thereby rotating the sector gear 101 in a clockwise direction as seen in a left side view, the solenoid switch 104 is set to the non-excited state and the lever 103 is positioned at the first engagement position such that the first engaging claw 158 of the first engagement portion 153 is engaged with the first engagement surface 143 of the first protruding portion 141 of the cylindrical unit 131, as shown in FIGS. 7A and 7B, whereby the lever 103 and the solenoid switch 104 hold the sector gear 101 against the biasing force of the torsion spring 148 such that the first non-tooth portion 135 of the partially toothed gear 130 faces the drive gear 98 as shown in FIG. 4.

Figure 11:
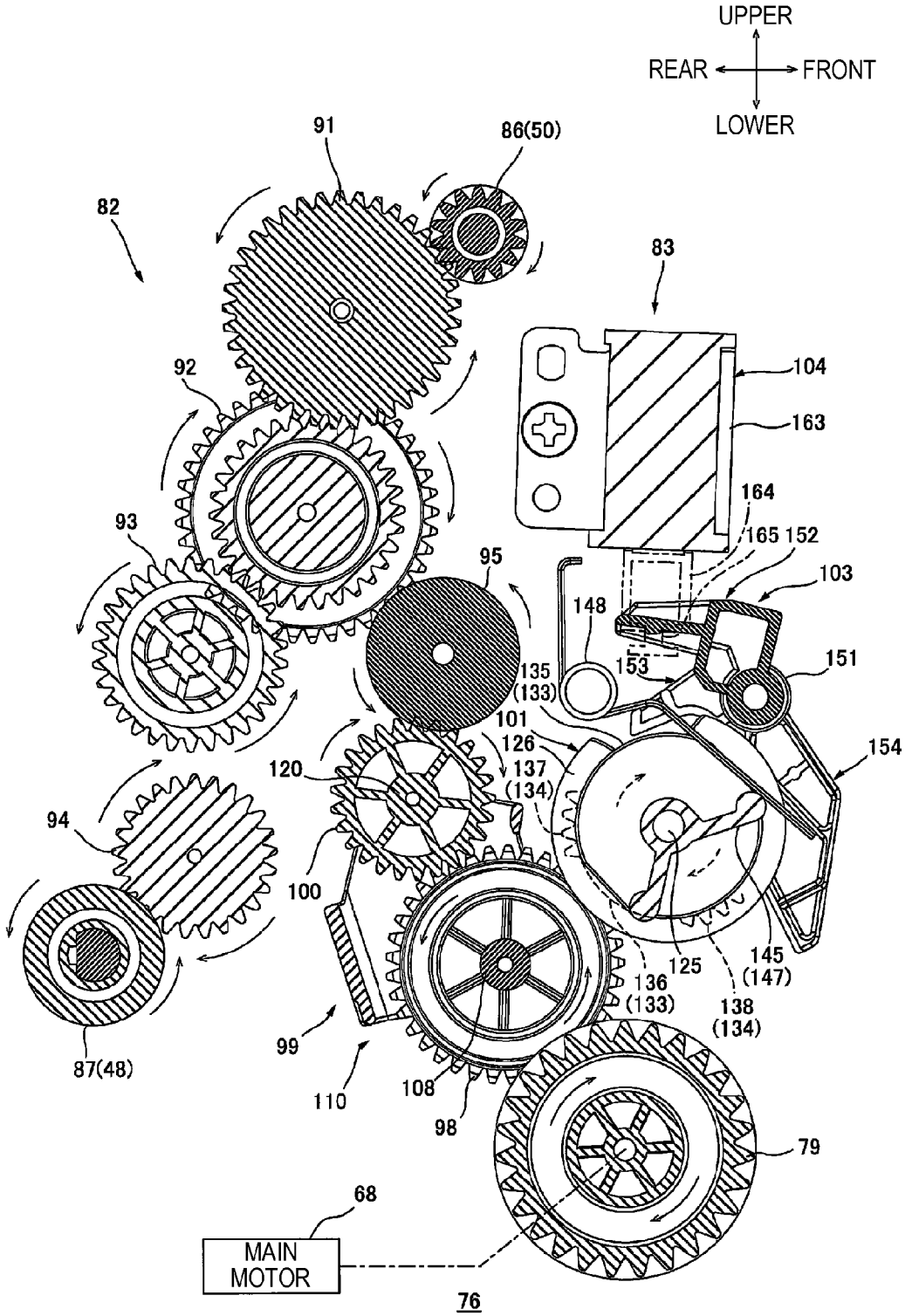
FIG. 11 is a cross-sectional view showing the driving-force transmission mechanism of FIG. 3 in the second mode as taken along the line B-B.

In the reverse rotation mode, while the torsion spring 148 biases the other end portion of the V-shaped cam 145 from the upper front side toward the lower rear side as shown in FIG. 11, thereby rotating the sector gear 101 in a clockwise direction as seen in a left side view, the solenoid switch 104 is set to the excited state and the lever 103 is positioned at the second engagement position such that the second engaging claw 159 of the second engagement portion 154 is engaged with the first engagement surface 143 of the first protruding portion 141 of the cylindrical unit 131, as shown in FIGS. 12A and 12B, whereby the lever 103 and the solenoid switch 104 hold the sector gear 101 against the biasing force of the torsion spring 148 such that a portion of the second non-tooth portion 136 of the partially toothed gear 130 on the downstream side in the rotation direction faces the drive gear 98 as shown in FIG. 9.

Figure 15:
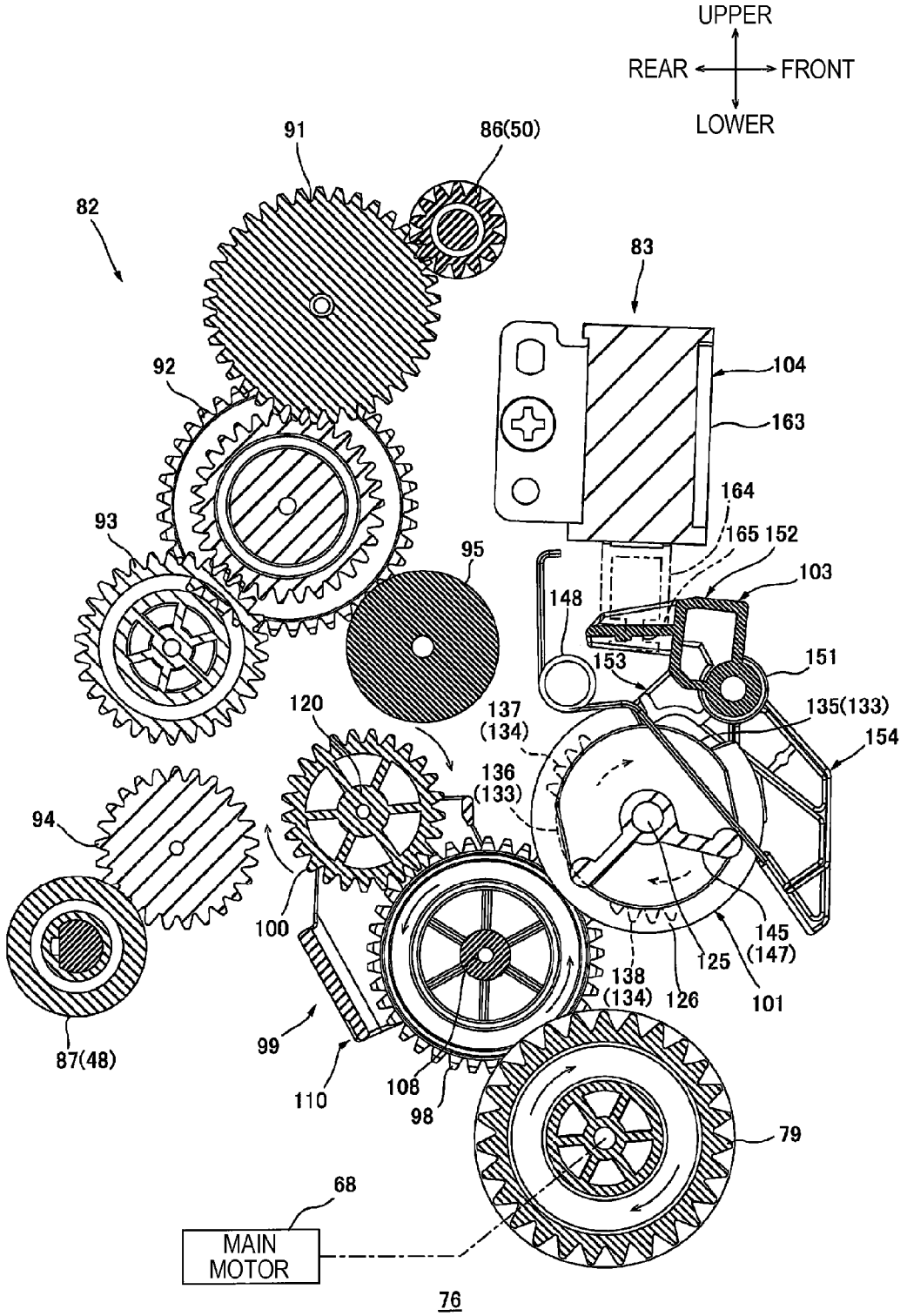
FIG. 15 is a cross-sectional view showing the driving-force transmission mechanism of FIG. 3 in the third mode as taken along the line B-B.
Figure 16A:
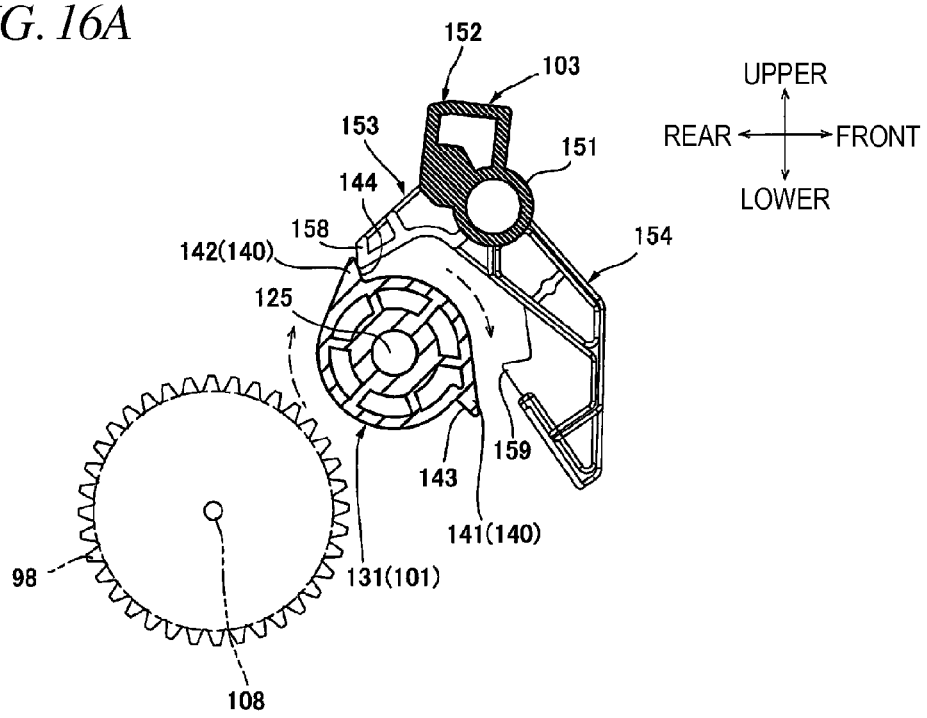
Figure 16B:
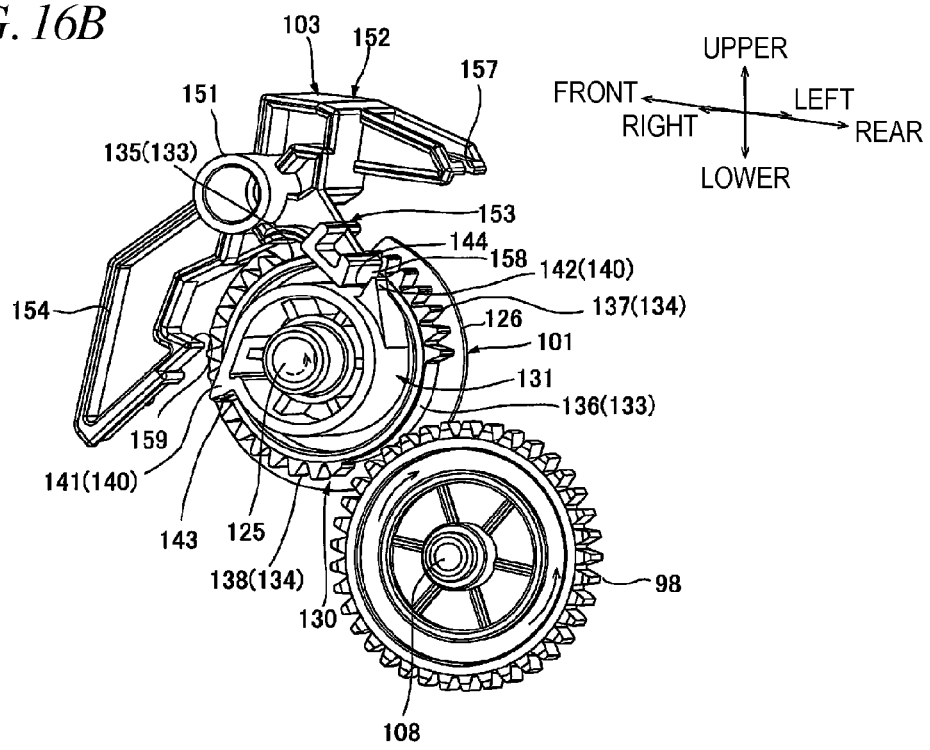

In the stack mode, while the torsion spring 148 biases the other end portion of the V-shaped cam 145 from the upper front side toward the lower rear side as shown in FIG. 15, thereby rotating the sector gear 101 in a clockwise direction as seen in a left side view, the solenoid switch 104 is set to the excited state and the lever 103 is positioned at the first engagement position such that the first engaging claw 158 of the first engagement portion 153 is engaged with the second engagement surface 144 of the second protruding portion 142 of the cylindrical unit 131, as shown in FIGS. 16A and 16B, whereby the lever 103 and the solenoid switch 104 hold the sector gear 101 against the biasing force of the torsion spring 148 such that a portion of the second non-tooth portion 136 of the partially toothed gear 130 on the upstream side in the rotation direction faces the drive gear 98 as shown in FIG. 13.

The lever 103, the solenoid switch 104, and the cylindrical unit 131 of the sector gear 101 are configured as an example of a locking unit.

4. Mode Switching Operation of Switching Unit

As described above, the switching unit 83 switches the solenoid switch 104 between the excited state and the non-excited state, thereby performing switching among the normal rotation mode, the reverse rotation mode, and the stack mode.

The following description will be made on the assumption that the main motor 68 is always driven, whereby the input gear 79 is rotated in one direction.

(1) Switching Operation from Normal Rotation Mode to Reverse Rotation Mode

Subsequently, a switching operation from the normal rotation mode to the reverse rotation mode will be described.

In order to switch the switching unit 83 from the normal rotation mode to the reverse rotation mode, the solenoid switch 104 is switched from the non-excited state in the normal rotation mode as shown in FIG. 4 to the excited state as shown in FIG. 9.

As a result, the lever 103 swings in a clockwise direction as seen in a left side view, thereby moving from the first engagement position to the second engagement position.

As a result, contact of the first engaging claw 158 and the first engagement surface 143 of the first protruding portion 141 is released, and as shown in FIG. 11, the sector gear 101 rotates in a clockwise direction as seen in a left side view by the biasing force of the torsion spring 148 on one end portion of the V-shaped cam 145.

If the sector gear 101 rotates, the first toothed portion 137 of the partially toothed gear 130 moves to a position facing the drive gear 98. As a result, the first toothed portion 137 is engaged with the drive gear 98, and the sector gear 101 rotates with rotation of the drive gear 98.

Figure 10:
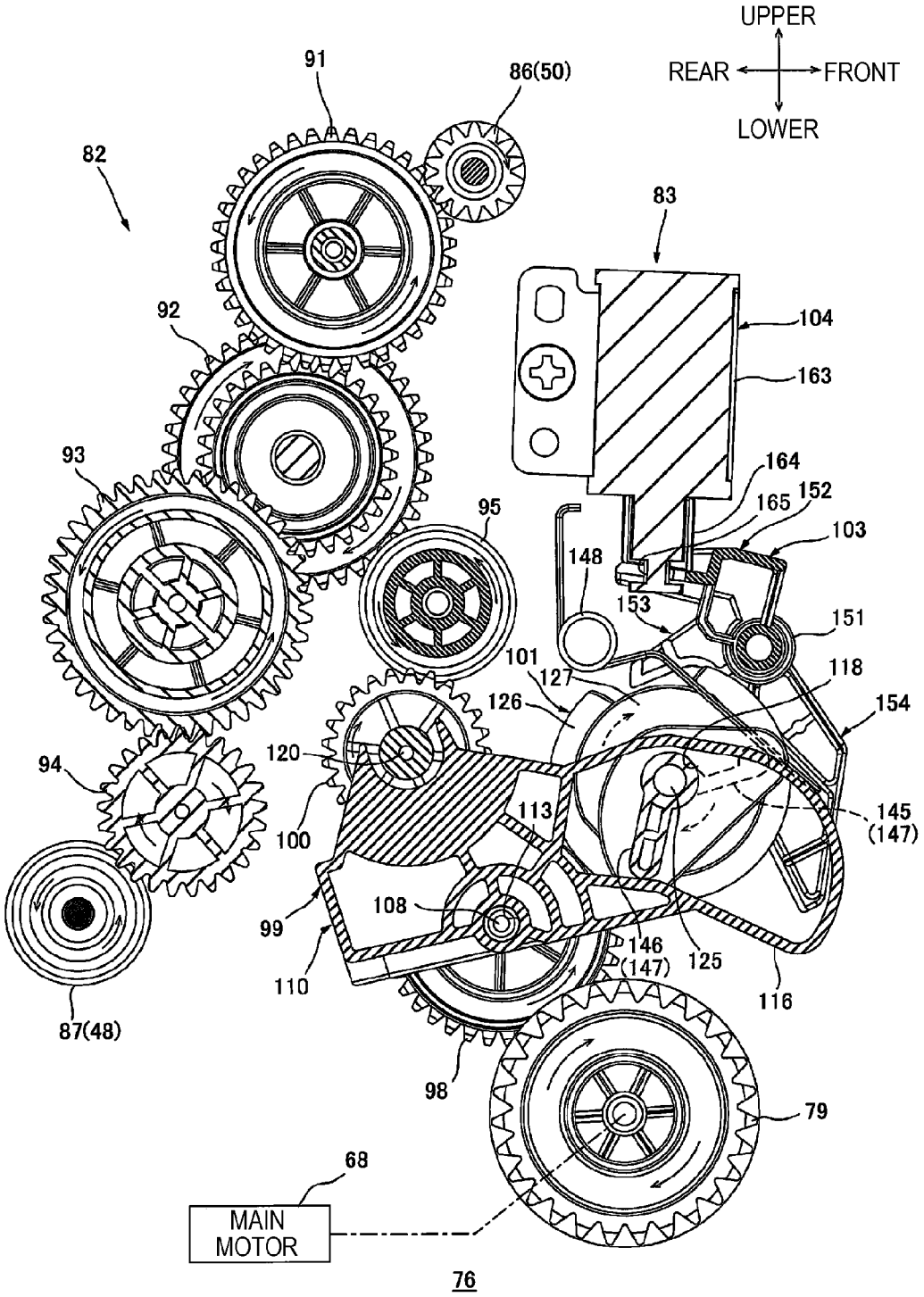
FIG. 10 is a cross-sectional view showing the driving-force transmission mechanism of FIG. 3 in the second mode as taken along the line A-A.

At this time, the I-shaped cam 146 rotates with rotation of the sector gear 101 as shown in FIG. 10. As the first toothed portion 137 is engaged with the drive gear 98, the I-shaped cam 146 is rotated in a clockwise direction as seen in a left side view and comes into contact with the frame portion 116 of the holder 99 from the upper side. The sector gear 101 keeps rotating even after the I-shaped cam 146 and the frame portion 116 have come into contact with each other, and thus the I-shaped cam 146 rotates while pressing the frame portion 116 downward.

If the frame portion 116 of the holder 99 is pressed downward, the holder 99 rotates around the drive support shaft 108 in a clockwise direction as seen in a left side view. The rotation of holder 99 causes the pendulum gear 100 pivotally supported on the holder 99 to move from the first engagement position toward the second engagement position. Also, if the pendulum gear 100 moves to the second engagement position, the I-shaped cam 146 becomes a state in which the I-shaped cam extends in a direction of about six o'clock as seen in a left side view and presses the frame portion 116 such that the frame portion 116 is the lowest.

While the sector gear 101 rotates such that the pendulum gear 100 moves to the second engagement position, the second non-tooth portion 136 faces the drive gear 98 as shown in FIG. 11. At this time, the torsion spring 148 applies biasing force for rotating the sector gear 101 in a clockwise direction as seen in a left side view, to the other end portion of the V-shaped cam 145.

If the sector gear 101 rotates by biasing of the torsion spring 148 on the other end portion of the V-shaped cam 145, the second engaging claw 159 of the lever 103 positioned at the second engagement position comes into contact with the first protruding portion 141 of the sector gear 101, as shown in FIGS. 12A and 12B.

As a result, the rotation of the sector gear 101 is regulated, and the switching unit 83 is switched from the normal rotation mode to the reverse rotation mode.

(2) Switching Operation from Reverse Rotation Mode to Stack Mode

Subsequently, a switching operation from the reverse rotation mode to the stack mode will be described.

In order to switch the switching unit 83 from the reverse rotation mode to the stack mode, the solenoid switch 104 is switched from the excited state in the reverse rotation mode as shown in FIG. 9 to the non-excited state as shown in FIG. 13.

As a result, the lever 103 swings in a counterclockwise direction as seen in a left side view, thereby moving from the second engagement position to the first engagement position.

As a result, contact of the second engaging claw 159 and the first engagement surface 143 of the first protruding portion 141 is released, and the sector gear 101 rotates in a clockwise direction as seen in a left side view, by the biasing force of the torsion spring 148 on the other end portion of the V-shaped cam 145, as shown in FIG. 15.

At this time, the I-shaped cam 146 rotates with rotation of the sector gear 101. The I-shaped cam 146 rotates from the position of about six o'clock as seen in a left side view, in a clockwise direction as seen in a left side view. Since the pressing position of the I-shaped cam 146 on the frame portion 116 moves upward, the holder 99 rotates around the drive support shaft 108 in a counterclockwise direction as seen in a left side view, by upward biasing force of the tension spring 121 as shown in FIG. 13. The rotation of the holder 99 causes the pendulum gear 100 pivotally supported on the holder 99 to move from the second engagement position toward the first engagement position.

Further, while the sector gear 101 rotates by the biasing force of the torsion spring 148, as shown in FIGS. 16A and 16B, the second protruding portion 142 of the sector gear 101 comes into contact with the first engaging claw 158 of the lever 103 positioned at the first engagement position, from the rear side.

As a result, rotation of the sector gear 101 is regulated, and rotation of the sector gear 101 by the biasing force of the torsion spring 148 is regulated.

Figure 14:
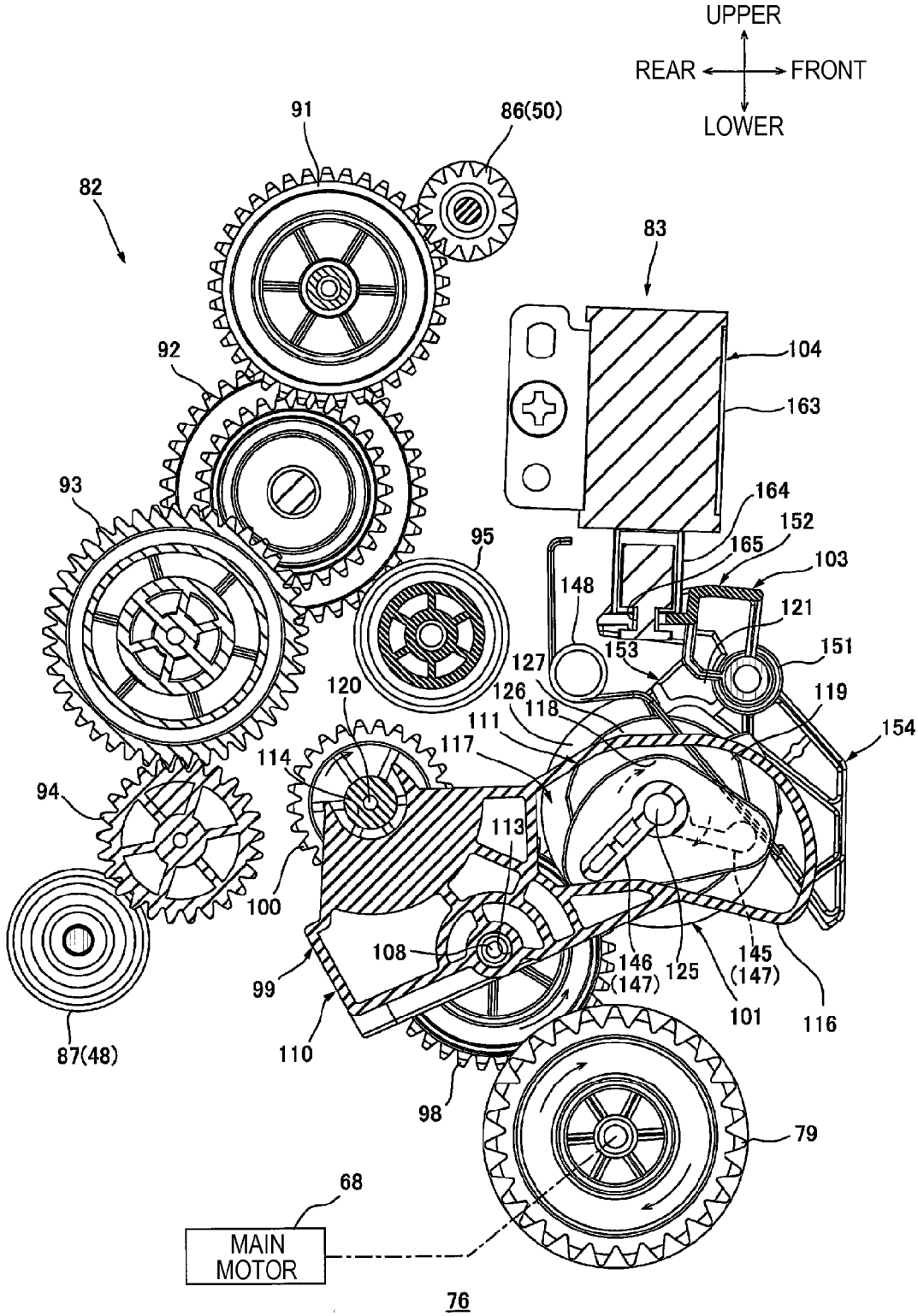
FIG. 14 is a cross-sectional view showing the driving-force transmission mechanism of FIG. 3 in the third mode as taken along the line A-A.

At this time, as shown in FIG. 14, the I-shaped cam 146 of the sector gear 101 is directed to about seven o'clock with respect to the sector gear shaft 125 as seen in a left side view. Since the rotation of the sector gear 101 is regulated in a state where the I-shaped cam 146 presses the frame portion 116, the pendulum gear 100 is held at the disengagement position where the pendulum gear is not engaged with any of the first gear train and the second gear train.

As a result, the switching unit 83 is switched from the reverse rotation mode to the stack mode.

(3) Switching Operation from Stack Mode to Normal Rotation Mode

A switching operation from the stack mode to the normal rotation mode will be described.

In order to switch the switching unit 83 from the stack mode to the normal rotation mode, the solenoid switch 104 in the stack mode is switched from the non-excited state to the excited state, and then is switched to the non-excited state again.

Therefore, the lever 103 swings in a clockwise direction as seen in a left side view, thereby moving from the first engagement position to the second engagement position, and then immediately swings in a counterclockwise direction as seen in a left side view, thereby moving from the second engagement position to the first engagement position.

As a result, contact of the first engaging claw 158 and the second engagement surface 144 of the second protruding portion 142 is released, and the sector gear 101 rotates in a clockwise direction as seen in a left side view, by the biasing force of the torsion spring 148 on the other end portion of the V-shaped cam 145, as shown in FIG. 6. According to the rotation of the sector gear 101, the second protruding portion 142 moves from a position where the second protruding portion 142 is engaged with the first engaging claw 158, and then the first engaging claw 158 is moved to the first engagement position again.

If the sector gear 101 rotates, the second toothed portion 138 of the partially toothed gear 130 moves a position where the second toothed portion 138 faces the drive gear 98. As a result, the second toothed portion 138 is engaged with the drive gear 98, and with rotation of the drive gear 98, the sector gear 101 rotates.

At this time, the I-shaped cam 146 rotates with rotation of the sector gear 101. The I-shaped cam 146 rotates from the position of about seven o'clock, in a clockwise direction as seen in a left side view, thereby being separated from the frame portion 116. If the I-shaped cam 146 is separated from the frame portion 116, the holder 99 rotates around the drive support shaft 108 in a counterclockwise direction as seen in a left side view, by the upward biasing force of the tension spring 121. The rotation of the holder 99 causes the pendulum gear 100 pivotally supported on the holder 99 to move from the disengagement position toward the first engagement position.

If the sector gear 101 rotates, the first non-tooth portion 135 faces the drive gear 98. At this time, the torsion spring 148 applies the biasing force to one end portion of the V-shaped cam 145, for rotating the sector gear 101 in a clockwise direction as seen in a left side view.

If the sector gear 101 rotates by biasing of the torsion spring 148 on one end portion of the V-shaped cam 145, the first engaging claw 158 of the lever 103 positioned at the first engagement position comes into contact with the first protruding portion 141 of the sector gear 101, as shown in FIGS. 7A and 7B.

As a result, the rotation of the sector gear 101 is regulated, and the switching unit 83 is switched from the stack mode to the normal rotation mode.

(4) Switching Operation from Stack Mode to Reverse Rotation Mode

Subsequently, a switching operation from the stack mode to the reverse rotation mode will be described.

In order to switch the switching unit 83 from the stack mode to the reverse rotation mode, the solenoid switch 104 in the stack mode is switched from the non-excited state as shown in FIG. 13 to the excited state as shown in FIG. 9, and is held in the excited state for a predetermined time period or more.

As a result, the lever 103 is swung in a clockwise direction as seen in a left side view, and is held in a state where the lever has been moved from the first engagement position to the second engagement position.

Then, contact of the first engaging claw 158 and the second engagement surface 144 of the second protruding portion 142 is released, and the sector gear 101 rotates in a clockwise direction as seen in a left side view, by the biasing force of the torsion spring 148 on the other end portion of the V-shaped cam 145, as shown in FIG. 6.

If the sector gear 101 rotates, the second toothed portion 138 of the partially toothed gear 130 is engaged with the drive gear 98, and with rotation of the drive gear 98, the sector gear 101 rotates.

At this time, the I-shaped cam 146 rotates with rotation of the sector gear 101 as shown in FIG. 5. The I-shaped cam 146 rotates from the position of about seven o'clock as seen in a left side view, in a clockwise direction as seen in a left side view, thereby being separated from the frame portion 116. If the I-shaped cam 146 is separated from the frame portion 116, the holder 99 is rotated around the drive support shaft 108 in a counterclockwise direction as seen in a left side view, by the upward biasing force of the tension spring 121. The rotation of the holder 99 causes the pendulum gear 100 pivotally supported on the holder 99 to move from the disengagement position toward the first engagement position.

If the sector gear 101 rotates, the first non-tooth portion 135 faces the drive gear 98 as shown in FIG. 6. At this time, the torsion spring 148 applies the biasing force to one end portion of the V-shaped cam 145, for rotating the sector gear 101 in a clockwise direction as seen in a left side view.

While the sector gear 101 rotates by biasing of the torsion spring 148 on one end portion of the V-shaped cam 145, the second protruding portion 142 of the sector gear 101 comes close to the second engaging claw 159 of the lever 103 positioned at the second engagement position. However, since the second engaging claw 159 and the second protruding portion 142 are at positions where they are deviated (do not overlap) in the left-right direction which is the axial direction of the cylindrical unit 131, the sector gear 101 keeps rotating, without engaging between the second engaging claw 159 and the second protruding portion 142.

Thereafter, although the pendulum gear 100 moves to the first engagement position by rotation of the sector gear 101, since the first engaging claw 158 is separated from the cylindrical unit 131, the sector gear 101 keeps rotating.

Therefore, the pendulum gear 100 is swung toward the second engagement position, without being held at the first engagement position.

The process after the pendulum gear 100 is swung from the first engagement position toward the second engagement position is the same as the switching operation from the normal rotation mode to the reverse rotation mode, and thus will not be described.

Accordingly, the rotation of the sector gear 101 is regulated, and the switching unit 83 is switched from the stack mode to the reverse rotation mode is performed.

5. Effects of Driving-Force Transmission Mechanism (1) According to the printer 1, the switching unit 83 has the normal rotation mode in which the switching unit 83 holds the pendulum gear 100 at the first engagement position where the pendulum gear 100 is engaged with the fourth intermediate gear 94 as shown in FIG. 4 and transmits the one-direction rotational driving force of the main motor 68 to the first gear train, thereby setting the rotation direction of the switchback roller 50 and the intermediate sheet discharge roller 48 into the normal rotation direction, the reverse rotation mode in which the switching unit 83 holds the pendulum gear 100 at the second engagement position where the pendulum gear 100 is engaged with the fifth intermediate gear 95 as shown in FIG. 9 and transmits the one-direction rotational driving force of the main motor 68 to the second gear train, thereby setting the rotation direction of the switchback roller 50 and the intermediate sheet discharge roller 48 into the reverse rotation direction, and the stack mode in which the switching unit 83 holds the pendulum gear 100 at the disengagement position between the fourth intermediate gear 94 and the fifth intermediate gear 95 as shown in FIG. 13, such that the one-direction rotational driving force of the main motor 68 is not transmitted to any of the first gear train and the second gear train, and thus the switchback roller 50 and the intermediate sheet discharge roller 48 do not rotate.

Accordingly, it is not necessary to switch the rotational driving force of the main motor 68 among the normal rotation direction, the reverse rotation direction and stop rotation in order to switch the rotation direction of the switchback roller 50 or stopping the switchback roller 50. Therefore, it is possible to use the main motor 68 not only as a motor for generating rotational driving force for rotating rotary bodies (the sheet feeding roller 14, the conveying roller 16, the registration roller 17, the black developing roller 31K, the heating roller 43, and the reverse conveyance rollers 55) which are in the printer 1 and rotate in one direction, but also as a motor for generating rotational driving force to be transmitted to the switchback roller 50 and the intermediate sheet discharge roller 48.

Therefore, it is possible to prevent the number of motors in the printer 1 from increasing, and while it is possible to reduce the cost and noise, it is possible to switch the rotation direction of the switchback roller 50 between the normal rotation direction and the reverse rotation direction, thereby forming images on one side and the other side of a sheet P.

(2) Further, according to the printer 1, as shown in FIGS. 5 and 10, the cam 147 presses the frame portion 116 of the holder 99 to swing the holder 99, so that the pendulum gear 100 rotatably supported on the holder 99 is moved.

Therefore, by pressing the holder 99 by the cam 147 such that the pendulum gear 100 is moved, it is possible to switch the pendulum gear 100 among the first engagement position, the second engagement position and the disengagement position.

(3) Further, according to the printer 1, as shown in FIGS. 5 and 10, by engaging the toothed portion 134 with the drive gear 98 such that the partially toothed gear 130 rotates with rotation of the drive gear 98, thereby moving the cam 147 to press the holder 99, it is possible to move the pendulum gear 100. Also, as shown in FIGS. 7A, 7B, 12A, and 12B, by causing the non-tooth portion 133 to face the drive gear 98 to prevent the partially toothed gear 130 from receiving the rotational driving force from the main motor 68, it is possible to stop the rotation of the partially toothed gear 130 such that the holder 99 is not pressed, thereby stopping movement of the pendulum gear 100.

Therefore, by engaging the toothed portion 134 with the drive gear 98 such that the partially toothed gear 130 rotates with rotation of the drive gear 98, it is possible to switch the pendulum gear 100 among the first engagement position, the second engagement position and the disengagement position. Then, by stopping the partially toothed gear 130 such that the non-tooth portion 133 faces the drive gear 98, it is possible to hold the pendulum gear 100 at each engaging portion, thereby holding the normal rotation mode, the reverse rotation mode and the stack mode.

(4) Further, according to the printer 1, as shown in FIGS. 7A and 7B, the first non-tooth portion 135 corresponds to the normal rotation mode whose use frequency is relatively high, and as shown in FIGS. 12A, 12B, 16A, and 16B, the second non-tooth portion 136 corresponds to the reverse rotation mode and the stack mode whose use frequencies are relatively low, and therefore, t is possible to make the non-tooth portion 133 correspond to each mode according to a use frequency. Therefore, it is possible to effectively suppress an increase in the size of the partially toothed gear 130.

(5) Further, according to the printer 1, as shown in FIGS. 6 and 11, while being in engagement with the drive gear 98 so as to be able to always transmit the one-direction rotational driving force, the pendulum gear 100 can move to the first engagement position of FIG. 4 where the pendulum gear 100 is engaged with the first gear train, the second engagement position of FIG. 9 where the pendulum gear 100 is engaged with the second gear train, and the disengagement position of FIG. 13 where the pendulum gear 100 is not engaged with any of the first gear train and the second gear train.

That is, as shown in FIGS. 6 and 11, while always rotating in one direction, the pendulum gear 100 can be switched among the first engagement position, the second engagement position and the disengagement position, thereby being capable of switching the switchback roller 50 among rotation in the normal rotation direction, rotation in the reverse rotation direction, and a non-rotating state.

(6) Further, according to the printer 1, as shown in FIGS. 6 and 11, since the locking unit (the lever 103, the solenoid switch 104, and the cylindrical unit 131 of the sector gear 101) causes the non-tooth portion 133 of the partially toothed gear 130 in the normal rotation mode, the reverse rotation mode and the stack mode to face the drive gear 98 against the biasing force of the torsion spring 148 biasing the partially toothed gear 130, it is possible to prevent the driving force from the main motor 68 from being transmitted to the partially toothed gear 130.

Therefore, it is possible to surely hold the normal rotation mode, the reverse rotation mode and the stack mode of the switching unit 83.

Meanwhile, in a case where facing of the non-tooth portion 133 and the drive gear 98 by the locking unit is released, since it is possible to bias the partially toothed gear 130 by the biasing force of the torsion spring 148 in a direction in which the partially toothed gear 130 is rotated by the drive gear 98, it is possible to surely transmit the rotational driving force from the main motor 68 to the partially toothed gear 130.

(7) Further, according to the printer 1, as shown in FIGS. 5 and 6, since the cam 147 has the I-shaped cam 146 for pressing the holder 99, and the V-shaped cam 145 which is biased by the torsion spring 148, it is possible to surely switch the mode of the switching unit 83.

(8) Further, according to the printer 1, as shown in FIGS. 8A to 8D, since the cam 147 and the partially toothed gear 130 are integrally formed, it is possible to reduce the number of components.

(9) Further, according to the printer 1, as shown in FIGS. 7A, 7B, 12A, and 12B, engaging of the lever 103 with the protruding portion 140 of the cylindrical unit 131 and releasing of the lever 103 from the protruding portion 140 are switched by the solenoid switch 104, and rotation of the partially toothed gear 130 is regulated by engaging of the lever 103 and the protruding portion 140, and the partially toothed gear 130 is rotated by releasing engaging of the lever 103 and the protruding portion 140.

Therefore, by switching of the solenoid switch 104, it is possible to switch the partially toothed gear 130 between a rotation regulated state and a rotating state.

(10) Further, according to the printer 1, as shown in FIGS. 7A, 7B, 12A, and 12B, if the lever 103 moves to the first engagement position and the second engagement position by switching of the solenoid switch 104, engaging of the first engagement portion 153 with the first protruding portion 141 is released and the partially toothed gear 130 rotates. However, the second engagement portion 154 is engaged with the first protruding portion 141, whereby rotation of the partially toothed gear 130 is regulated. That is, after engaging of the first engagement portion 153 with the first protruding portion 141 is released, the partially toothed gear 130 rotates until the second engagement portion 154 is engaged with the first protruding portion 141.

Also, as shown in FIGS. 12A, 12B, 16A, and 16B, if the lever 103 moves from the second engagement position to the first engagement position by switching of the solenoid switch 104, engaging of the second engagement portion 154 with the first protruding portion 141 is released and the partially toothed gear 130 rotates. However, the first engagement portion 153 is engaged with the second protruding portion 142, whereby rotation of the partially toothed gear 130 is regulated. That is, after engaging of the second engagement portion 154 with the first protruding portion 141 is released, the partially toothed gear 130 rotates until the first engagement portion 153 is engaged with the second protruding portion 142.

As described above, by switching the lever 103 between engaging with the protruding portion 140 and releasing from the protruding portion 140 by the solenoid switch 104, it is possible to repeat the rotation regulated state and rotating state of the partially toothed gear 130.

(11) Further, according to the printer 1, rotation of the partially toothed gear 130 is regulated at three positions, that is, a position where the first protruding portion 141 and the first engagement portion 153 are engaged with each other as shown in FIGS. 7A and 7B, a position where the first protruding portion 141 and the second engagement portion 154 are engaged with each other as shown in FIGS. 12A and 12B, and a position where the second protruding portion 142 and the first engagement portion 153 are engaged with each other as shown in FIGS. 16A and 16B.

That is, since the three positions correspond to the normal rotation mode, the reverse rotation mode and the stack mode, respectively, switching to each mode becomes possible.

(12) Further, according to the printer 1, as shown in FIGS. 12A, 12B, 16A, and 16B, since the second protruding portion 142 and the second engagement portion 154 are disposed at positions where they are deviated (do not overlap) in the axial direction of the cylindrical unit 131 formed at the sector gear 101, it is possible to surely prevent the second protruding portion 142 and the second engagement portion 154 from being engaged with each other.

(13) Further, according to the printer 1, as shown in FIGS. 10 and 14, by switching the lever 103 between the first engagement position and the second engagement position by the solenoid switch 104, it is possible to switch the switching unit 83 from the normal rotation mode to the reverse rotation mode, and from the reverse rotation mode to the stack mode.

(14) Further, according to the printer 1, in a case of direct switching from the stack mode to the reverse rotation mode, the pendulum gear 100 moves from the disengagement position shown in FIG. 13 to the first engagement position shown in FIG. 4, and moves from the first engagement position to the second engagement position shown in FIG. 9, whereby switching from the stack mode to the reverse rotation mode is performed.

However, while direct switching from the stack mode to the reverse rotation mode is performed, the pendulum gear 100 is not held at the first engagement position, and the switching unit 83 does not become the normal rotation mode. Therefore, even though the pendulum gear 100 passes the first engagement position, it is possible to surely perform switching from the stack mode to the reverse rotation mode.

(15) Further, according to the printer 1, as shown in FIGS. 8A to 8D, the partially toothed gear 130, the cylindrical unit 131, and the cam 147 are integrally configured as the sector gear 101.

Therefore, it is possible to integrally configure various components for switching among the normal rotation mode, the reverse rotation mode and the stack mode, as one sector gear 101.

As a result, it is possible to simplify configurations while reducing the number of components.

(16) Further, according to the printer 1, as shown in FIGS. 2A and 2B, it is possible to transmit the one-direction rotational driving force of the main motor 68 to each of the rotary bodies (the sheet feeding roller 14, the conveying roller 16, the registration roller 17, the black developing roller 31K, the heating roller 43, and the reverse conveyance rollers 55) and each of the switchback roller 50 and the intermediate sheet discharge roller 48.

Further, while it is possible to always rotate each rotary body in one direction by the one-direction rotational driving force of the main motor 68, it is possible to switch the rotation direction of each of the switchback roller 50 and the intermediate sheet discharge roller 48 between the normal rotation direction and the reverse rotation direction.

6. Initial Control of Switching Unit by CPU

Figure 17:
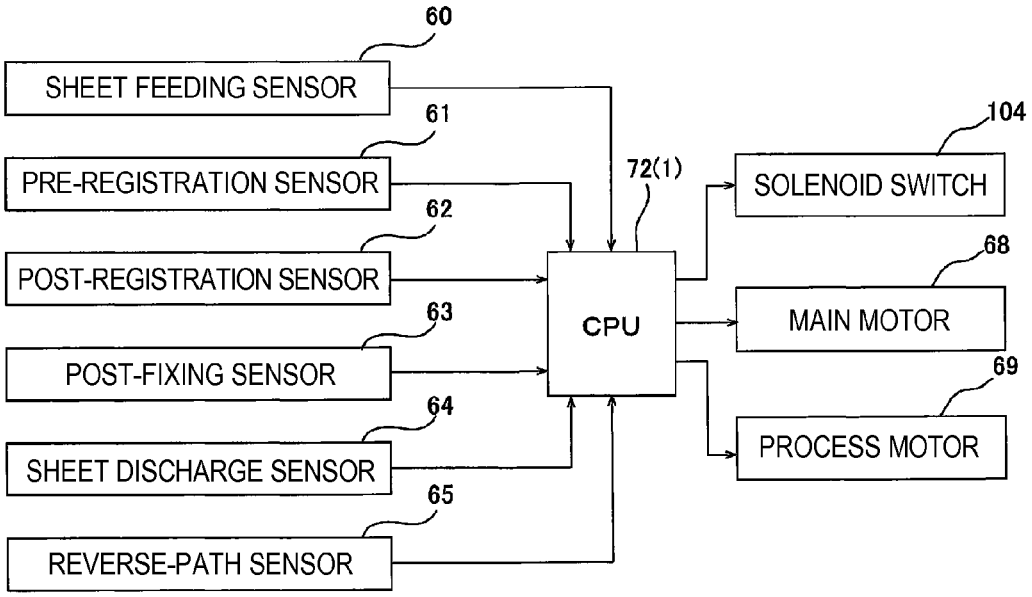
FIG. 17 is a block diagram showing a flow of control in the printer shown in FIG. 1.

As shown in FIG. 17, the printer 1 includes the CPU 72 (an example of a controller) for controlling the solenoid switch 104 such that the solenoid switch 104 is switched between the excited state and the non-excited state as described above.

The CPU 72 can perform first control to control the solenoid switch 104 to hold the non-excited state for a first time period, second control to control the solenoid switch 104 to hold the excited state for a second time period, and third control to control the solenoid switch 104 to hold the excited state for a third time period.

Here, the first time period is 0.12 sec or more, and is a time period longer than a longer time period between a time period while the sector gear 101 rotates to a position where the first protruding portion 141 comes into contact with the first engagement portion 153 after contact of the first engagement portion 153 and the second engagement surface 144 is released and a time period while the sector gear 101 rotates to a position where the second engagement surface 144 comes into contact with the first engaging claw 158 after contact of the first engaging claw 158 and the first engagement surface 143 is released.

The second time period is 0.13 sec or more, and is a time period longer than a time period while the sector gear 101 rotates to a position where the first engagement surface 143 comes into contact with the second engaging claw 159 after contact of the first engaging claw 158 and the second engagement surface 144 is released.

The third time period is 0.01 sec to 0.05 sec, and is a time period which is longer than a time period while it is possible to surely release contact of the first engaging claw 158 and the second engagement surface 144 and which is shorter than a time period while the sector gear 101 rotates to a position where the first engagement surface 143 comes into contact with the first engaging claw 158 after contact of the first engaging claw 158 and the second engagement surface 144 is released. That is, the third time period is shorter than the second time period.

The CPU 72 performs control to switch the solenoid switch 104 between the excited state and the non-excited state for performing a double-sided image forming process on a sheet P, separately from the first control, the second control, and the third control.

(1) Discharging of Sheet Remaining in Main Body Casing at Power-on

Immediately after power-on, in the printer 1, the solenoid switch 104 is always controlled by the CPU 72 to become the non-excited state.

After the printer 1 is powered on, first, the main motor 68 is driven.

Therefore, the main motor 68 transmits the one-direction rotational driving force to the input gear 79 through the plurality of gears (not shown) of the main body casing 2.

Then, the one-direction rotational driving force having been transmitted to the input gear 79 is transmitted to the pendulum gear 100 through the drive gear 98.

At this time, since the solenoid switch 104 is controlled to become the non-excited state, the switching unit 83 becomes any one mode of the normal rotation mode in which the pendulum gear 100 is held at the first engagement position and the stack mode in which the pendulum gear 100 is held at the disengagement position.

Figure 18:
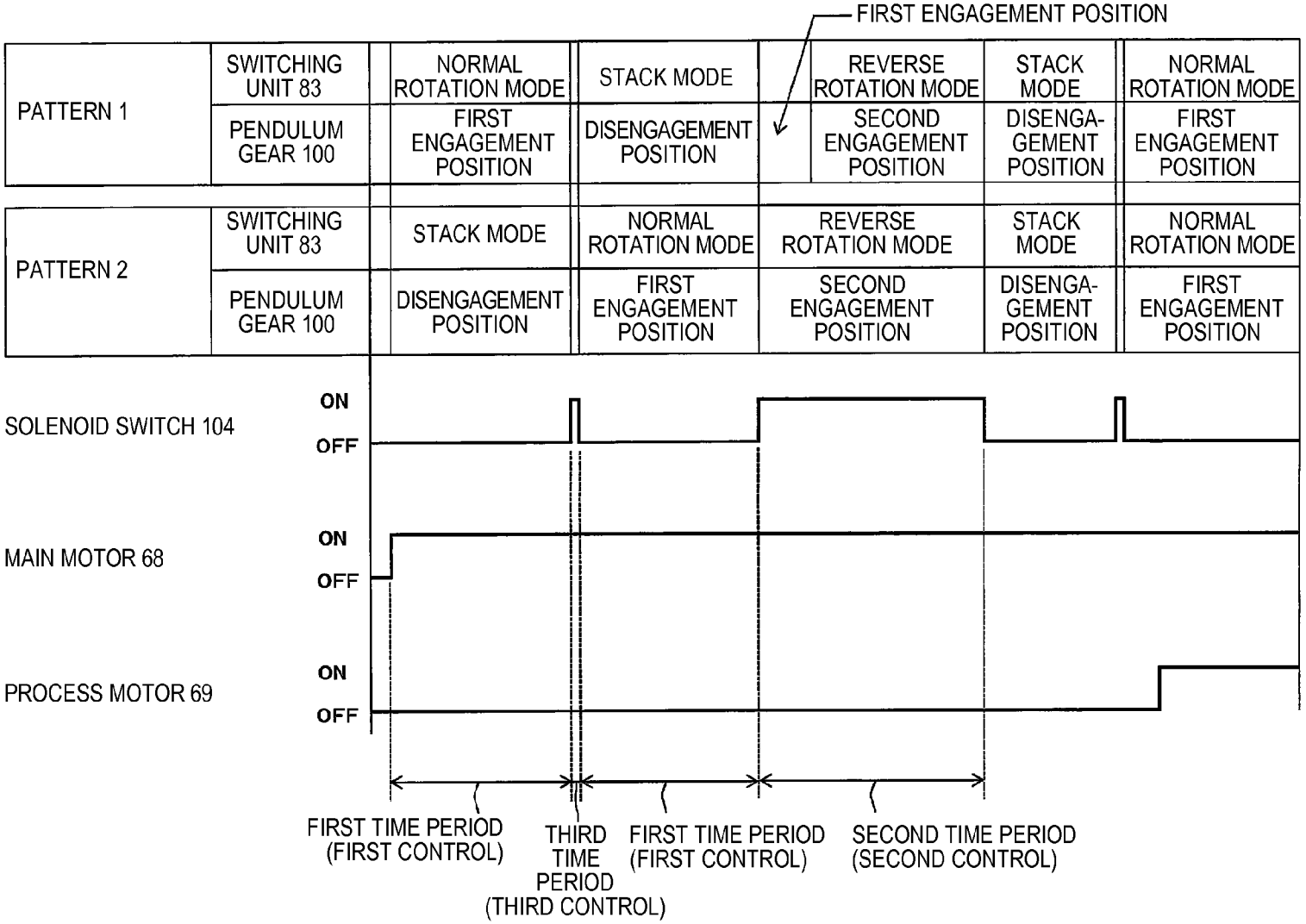

As shown in FIG. 18, after the printer 1 is powered on, the CPU 72 performs the first control to hold the solenoid switch 104 in the non-excited state for the first time period. The first time period in the first control after the printer 1 is powered on is longer than a time period while a sheet P is discharged from a post-fixing sensor 63 onto the sheet discharge tray 51. Incidentally, the first control of this illustrative embodiment may include control to issue an instruction for the solenoid switch 104 to hold the non-excited state, or control not to issue an instruction for the solenoid switch 10 to the excited state.

Therefore, in a case where the switching unit 83 is in the normal rotation mode at power-on of the printer 1, the intermediate sheet discharge roller 48 and the switchback roller 50 rotate in their normal rotation directions, such that even when a sheet P having not been detected by the post-fixing sensor 63 and a sheet discharge sensor 64 remains between the post-fixing sensor 63 and the sheet discharge sensor 64 (to be described below) inside of the main body casing 2, the sheet P is discharged. A case where a sheet P cannot be detected may include a case where the length of a sheet P is shorter than a distance between the post-fixing sensor 63 and the sheet discharge sensor 64.

In a case where the switching unit 83 is in the stack mode at power-on of the printer 1, the intermediate sheet discharge roller 48 and the switchback roller 50 do not rotate not only in their normal rotation directions but also in their reverse rotation directions. Therefore, when there is a remaining sheet P which cannot be detected, the sheet P is not conveyed to anywhere and continues to remain in the main body casing 2.

Subsequently, the CPU 72 performs the third control to control the solenoid switch 104 to hold the excited state for the third time period.

As a result, engaging of the first engaging claw 158 of the lever 103 with the protruding portion 140 is released, and the partially toothed gear 130 rotates. More specifically, in a case where the switching unit 83 is in the normal rotation mode at power-on of the printer 1, as shown in FIGS. 7A and 7B, engaging of the first engaging claw 158 of the lever 103 with the first engagement surface 143 of the first protruding portion 141 is released, and the sector gear 101 rotates. Also, in a case where the switching unit 83 is in the stack mode at power-on of the printer 1, as shown in FIGS. 16A and 16B, engaging of the first engaging claw 158 of the lever 103 with the second engagement surface 144 of the second protruding portion 142 is released, and the sector gear 101 rotates.

Subsequently, the CPU 72 performs the first control to control the solenoid switch 104 to hold the excited state for the first time period, again.

Since the third time period of the third control is a short time from 0.01 sec to 0.05 sec, as shown in FIGS. 7A, 7B, 16A, and 16B, as seen in a left side view, if the pendulum gear 100 rotates, immediately after the protruding portion 140 engaged with the first engaging claw 158 passes under the first engaging claw 158, the first engaging claw 158 is positioned at the first engagement position, again.

Therefore, in a case where the switching unit 83 is in the stack mode immediately after power-on, the sector gear 101 rotates by about 210° such that the first engaging claw 158 is engaged with the first engagement surface 143 of the first protruding portion 141, whereby the switching unit 83 is switched to the normal rotation mode.

Then, the intermediate sheet discharge roller 48 and the switchback roller 50 rotate in their normal rotation directions, and a sheet P having not been discharged in the stack mode is discharged.

Also, in a case where the switching unit 83 is in the normal rotation mode immediately after power-on, the sector gear 101 rotates by about 150° such that the first engaging claw 158 is engaged with the second engagement surface 144 of the second protruding portion 142, whereby the switching unit 83 is switched to the stack mode. At this time, the sheet P has been already discharged.

Subsequently, the CPU 72 performs a start-up process of the printer 1.

(2) Mode Detection

As described above and shown in FIG. 18, at power-on of the printer 1, and/or after discharging of a sheet P remaining in the main body casing, the CPU 72 performs detection on the mode of the switching unit 83 to determine whether the switching unit 83 is in the normal rotation mode or in the stack mode.

In order to perform mode detection, after discharging of a sheet P remaining in the main body casing 2 at power-on, the CPU 72 performs the second control to control the solenoid switch 104 to hold the excited state for the second time period.

Therefore, in a case where the switching unit 83 is in the normal rotation mode immediately before the second control is performed, the switching unit 83 is switched to the reverse rotation mode.

Also, in a case where the switching unit 83 is in the stack mode immediately before the second control is performed, as shown in FIGS. 16A and 16B, the sector gear 101 rotates from a state where the second protruding portion 142 of the cylindrical unit 131 faces the lower front side, specifically, a direction of about four o'clock as seen in a left side view, by about 330° in a clockwise direction as seen in a left side view, such that the first engagement surface 143 of the first protruding portion 141 is engaged with the second engaging claw 159, whereby the switching unit 83 is switched to the reverse rotation mode.

Incidentally, in a case where the switching unit 83 is switched from the stack mode to the reverse rotation mode, since the second protruding portion 142 overlaps the second engaging claw 159 of the lever 103 as seen in a left side view in the middle of rotation of the sector gear 101, and the second protruding portion 142 and the second engaging claw 159 are deviated from each other in the left-right direction so as not to overlap as seen from a direction perpendicular to the rotation axis direction of the cylindrical unit 131, the second protruding portion 142 and the second engaging claw 159 are not engaged with each other, and the sector gear 101 receives the rotational driving force of the drive gear 98, thereby rotating. Also, as seen in a left side view in the middle of rotation of the sector gear 101, the first protruding portion 141 passes under the first engaging claw 158. At this time, as shown in FIG. 5, as seen in a left side view, the I-shaped cam 146 of the sector gear 101 is directed to about three o'clock with respect to the sector gear shaft 125. Therefore, the holder 99 is biased in a counterclockwise direction as seen in a left side view by the biasing force of the tension spring 121, whereby the pendulum gear 100 is positioned at the first engagement position, and the intermediate sheet discharge roller 48 and the switchback roller 50 are simultaneously rotated in their normal rotation directions.

Therefore, after the switching unit 83 is switched to the reverse rotation mode, the solenoid switch 104 is switched to the non-excited state by the CPU 72, whereby the switching unit 83 is switched to the stack mode.

As a result, detection on the mode of the switching unit 83 by the CPU 72 is completed.

7. Effects of Control of CPU on Switching Unit (1) According to the printer 1, as shown in FIGS. 4 and 9, since it is unnecessary to switch the rotation direction of the rotational driving force of the main motor 68 for switching the rotation directions of the switchback roller 50 and the intermediate sheet discharge roller 48, it is possible to use the main motor 68 not only as a motor for generating rotational driving force for rotating the rotary bodies (the sheet feeding roller 14, the conveying roller 16, the registration roller 17, the black developing roller 31K, the heating roller 43, and the reverse conveyance rollers 55) which are in the printer 1 and rotate in one direction, but also as a motor for generating rotational driving force to be transmitted to the switchback roller 50.

Meanwhile, according to the printer 1, the solenoid switch 104 can be selectively switched between the non-excited state allowing switching of the switching unit 83 to the normal rotation mode or the stack mode, and the excited state allowing switching of the switching unit 83 to the reverse rotation mode. The CPU 72 controls the switching of the solenoid switch 104 between the non-excited state and the excited state.

Therefore, there may be problems in which the CPU 72 cannot determine whether the switching unit 83 is in the normal rotation mode or in the stack mode, only by switching the solenoid switch 104 to the non-excited state, and before switching the switching unit 83 to the reverse rotation mode such that the switchback roller 50 is rotated in the reverse rotation direction, the CPU 72 cannot switch the switching unit 83 to the normal rotation mode such that the switchback roller 50 is rotated in the normal rotation direction, whereby a sheet P is discharged to the outside of the printer 1.

Accordingly, in the printer 1, as shown in FIG. 18, the CPU 72 can perform the first control to control the solenoid switch 104 to hold the non-excited state for the first time period, the second control to control the solenoid switch 104 to hold the excited state for the second time period, and the third control to control the solenoid switch 104 to hold the excited state for the third time period shorter than the second time.

As a result, by performing the third control on the switching unit 83 having been switched to the normal rotation mode or the stack mode by the first control of the CPU 72, it is possible to interchange the normal mode and the stack mode.

Accordingly, if the first control and the third control are performed before the second control is performed, it is possible to necessarily perform the normal rotation mode before performance of the reverse rotation mode.

Therefore, while it is possible to use the main motor 68 not only as a motor for generating the one-direction rotational driving force for rotating the switchback roller 50 and the intermediate sheet discharge roller 48 but also as a motor for generating rotational driving force for rotating the rotary bodies which are in the printer 1 and rotate in one direction, thereby reducing the cost and noise, it is possible to surely switch the switching unit 83 to the normal rotation mode before the reverse rotation mode such that the switchback roller 50 and the intermediate sheet discharge roller 48 are rotated in their normal rotation directions, whereby a sheet P is discharged.

(2) Further, according to the printer 1, as shown in FIG. 18, immediately after power-on of the printer 1, it is possible to switch the switching unit 83 to the normal rotation mode such that the switchback roller 50 is rotated in the normal rotation direction, whereby a sheet P is discharged.

Therefore, immediately after power-on of the printer 1, even when there is a remaining sheet P in the printer 1, it is possible to forcedly discharge the sheet P.

(3) Further, according to the printer 1, as shown in FIG. 1, in a case where it is possible to detect whether there is a remaining sheet P by the post-fixing sensor 63 in the middle of conveyance path from the image forming unit 4 to the discharge opening 49, an appropriate process for discharging the sheet P is performed, it is possible to perform the second control, thereby switching the switching unit 83 to the reverse rotation mode, and then perform a double-sided image forming process.

Meanwhile, there may be a problem in which when there is a remaining sheet P on the downstream side from the post-fixing sensor 63 in the conveyance direction in the middle of conveyance path from the image forming unit 4 to the discharge opening 49 of the primary conveyance path 52, it is not possible to detect existence or non-existence of the sheet P by the post-fixing sensor 63.

However, in the printer 1, regardless of detection of the sheet P by the post-fixing sensor 63, before the second control, it is possible to perform the normal rotation mode for the first time period longer than the conveyance time of the sheet P while the sheet P is conveyed from the post-fixing sensor 63 to the discharge opening 49.

Therefore, before switching the switching unit 83 to the reverse rotation mode, it is possible to surely discharge the sheet P.

(4) Also, according to the printer 1, as shown in FIGS. 4 and 9, since the solenoid switch 104 is used as the switching element, it is possible to selectively switch the switching unit 83 between the non-excited state and the excited state by a simple configuration.

Therefore, a switching element having a complicated configuration is not necessary, and thus, it is possible to reduce the cost.

(5) Further, according to the printer 1, as shown in FIG. 1, in the printer 1, in a case of forming an image only on one side of a sheet P, since it is not necessary to switch the switchback roller 50 to the reverse rotation direction, it is possible to form the image on the sheet P only in the normal rotation mode without switching the switching unit 83 to the reverse rotation mode.

Further, according to the printer 1, since the normal rotation mode corresponds to the non-excited state of the solenoid switch 104, it is possible to suppress consumption of electric power which is applied to the solenoid switch 104 in a case of forming an image only on one side of the sheet P.

(6) Further, according to the printer 1, as shown in FIG. 17, it is possible to control the CPU 72 such that the solenoid switch 104 becomes the non-excited state, whereby the switching unit 83 is switched to the normal rotation mode, and it is possible to control the CPU 72 such that the solenoid switch 104 becomes the excited state, whereby the switching unit 83 is switched from the normal rotation mode to the reverse rotation mode, and it is possible to control the CPU 72 such that the solenoid switch 104 becomes the non-excited state, whereby the switching unit 83 is switched from the reverse rotation mode to the stack mode.

Accordingly, by a simple operation of controlling the CPU 72 such that the solenoid switch 104 becomes the non-excited state or the excited state, it is possible to perform switching among the normal rotation mode, the reverse rotation mode and the stack mode.

(7) According to the printer 1, as shown in FIGS. 4 and 9, since it is not necessary to switch the rotation direction of the rotational driving force of the main motor 68 for switching the rotation direction of the switchback roller 50, it is possible to use the main motor 68 not only as a motor for generating rotational driving force for rotating the rotary bodies (the sheet feeding roller 14, the conveying roller 16, the registration roller 17, the black developing roller 31K, the heating roller 43, and the reverse conveyance rollers 55) which are in the printer 1 and rotate in one direction, but also as a motor for generating rotational driving force to be transmitted to the switchback roller 50.

The CPU 72 performs control such that the solenoid switch 104 is selectively switched between the non-excited state allowing switching of the switching unit 83 to the normal rotation mode or the stack mode, and the excited state allowing switching of the switching unit 83 to the reverse rotation mode.

Further, as shown in FIG. 18, since the switching unit 83 can be switched from the reverse rotation mode only to the stack mode, in a case where the control unit 70 controls the switching unit 83, thereby performing an image forming operation, first, the switching unit 83 is switched to the reverse rotation mode. Then, if the switching unit 83 is switched from the reverse rotation mode to the stack mode, it is possible to set an initial mode using the timing of the switching as the reference of control.

As a result, while it is possible to reduce the cost and noise, it is possible to perform the image forming operation using switching of the switching unit 83 from the reverse rotation mode to the stack mode as the reference of control.

(8) Further, according to the printer 1, as shown in FIG. 18, after the printer 1 is powered up and before an image is formed on a sheet P, it is possible to switch the switching unit 83 from the reverse rotation mode to the stack mode, and set the reference of control.

8. Double-Sided Image Forming Process

A double-sided image forming process of the CPU 72 on a plurality of sheets P will be described with reference to FIG. 19.

As shown in FIG. 1, the main body casing 2 includes, in the primary conveyance path 52, a sheet feeding sensor 60, a pre-registration sensor 61, a post-registration sensor 62, the post-fixing sensor 63 and the sheet discharge sensor 64, and further includes a reverse-path sensor 65 in the secondary conveyance path 56.

The sheet feeding sensor 60 is positioned in the vicinity of the sheet feeding roller 14 in the main body casing 2.

The pre-registration sensor 61 is positioned on the downstream side from the conveying roller 16 in the conveyance direction of the sheets P and on the upstream side from the registration roller 17 in the conveyance direction of the sheets P, in the primary conveyance path 52 of the main body casing 2.

The post-registration sensor 62 is positioned on the downstream side from the registration roller 17 in the conveyance direction of the sheets P and on the upstream side from a section between the foremost photosensitive drum 28 and the conveyor belt 39 in the conveyance direction of the sheets P, in the primary conveyance path 52 of the main body casing 2.

The post-fixing sensor 63 is positioned on the downstream side from the fixing unit 23 in the conveyance direction of the sheets P and on the upstream side from the intermediate sheet discharge roller 48 in the conveyance direction of the sheets P, in the primary conveyance path 52 of the main body casing 2.

The sheet discharge sensor 64 is positioned in the vicinity of the switchback roller 50 on the upstream side from the switchback roller 50 in the conveyance direction of the sheets P, in the primary conveyance path 52 of the main body casing 2.

The reverse-path sensor 65 is positioned in the vicinity of the rearmost reverse conveyance roller 55 in the main body casing 2.

Further, each of the sheet feeding sensor 60, the pre-registration sensor 61, the post-registration sensor 62, the post-fixing sensor 63, the sheet discharge sensor 64, and the reverse-path sensor 65 is configured to have an actuator capable of swinging such that the actuator is inclined and turned on by contact with a sheet P, and is turned off by separation from a sheet P. Further, each sensor is configured to transmit a detection signal of ON/OFF of a corresponding actuator to the CPU 72.

The double-sided image forming process of the CPU 72 on the plurality of sheets P is performed with a set of two sheets.

Of two sheets P of one set, a sheet P on which an image is formed first is referred to as a preceding sheet P1 (an example of a first recording medium), and a sheet P on which an image is formed second is referred to as a succeeding sheet P2 (an example of a second recording medium).

In the each of the preceding sheet P1 and the succeeding sheet P2, a side on which an image is formed first is earlier to as one side, and a side on which an image is formed later is referred to as the other side.

The CPU 72 performs a first step of holding the normal rotation mode such that the preceding sheet P1 is fed from the sheet feeding unit 3 to the primary conveyance path 52 by the conveying roller 16, an image is formed on one side of the preceding sheet P1 by the image forming unit 4, and the preceding sheet P1 is conveyed to the switchback roller 50.

Specifically, before performing the first step, mode detection is completed, the start-up process is completed, and then the process motor 69 is driven.

Subsequently, the CPU 72 performs control so as to hold the switching unit 83 in the normal rotation mode.

Figure 20C:
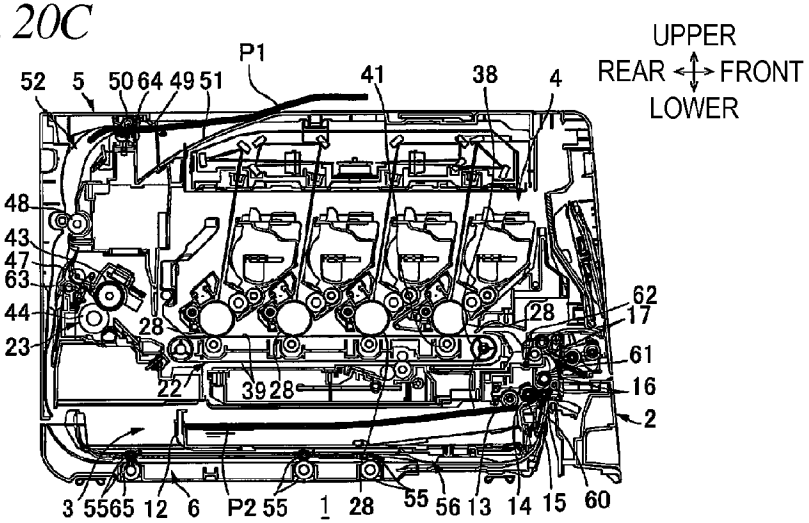
FIGS. 20A to 20D are explanatory views for explaining sheet conveyance in the double-sided image forming process, wherein FIG. 20A corresponds to a timing A of FIG. 19, and FIG. 20B corresponds to a timing B of FIG. 19, and FIG. 20C corresponds to a timing C of FIG. 19, and FIG. 20D corresponds to a timing D of FIG. 19.
Figure 20D:
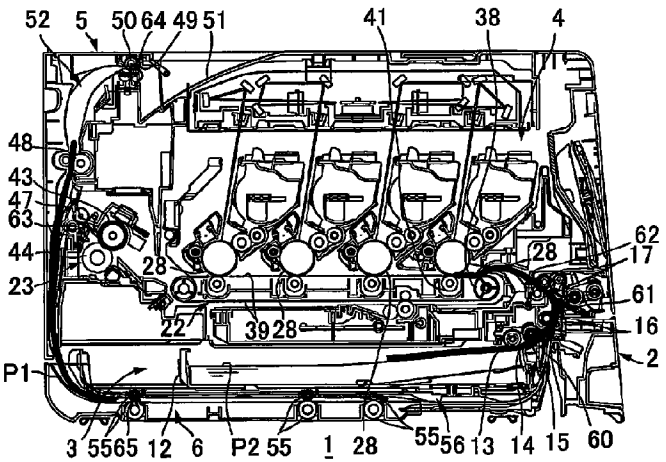
Figure 20A:
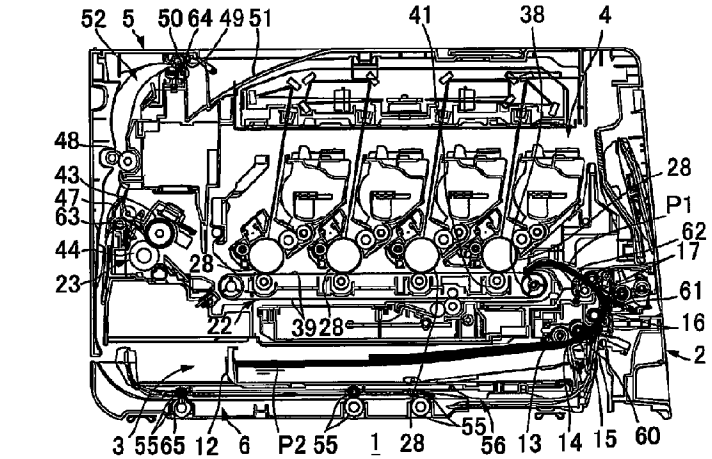

Then, as shown in FIG. 20A, the preceding sheet P1 on the sheet feeding tray 12 of the sheet feeding unit 3 is conveyed toward between the photosensitive drums 28 and the conveyor belt 39 as described above.

At this time, the succeeding sheet P2 is stacked on the sheet feeding tray 12 of the sheet feeding unit 3.

Figure 19:
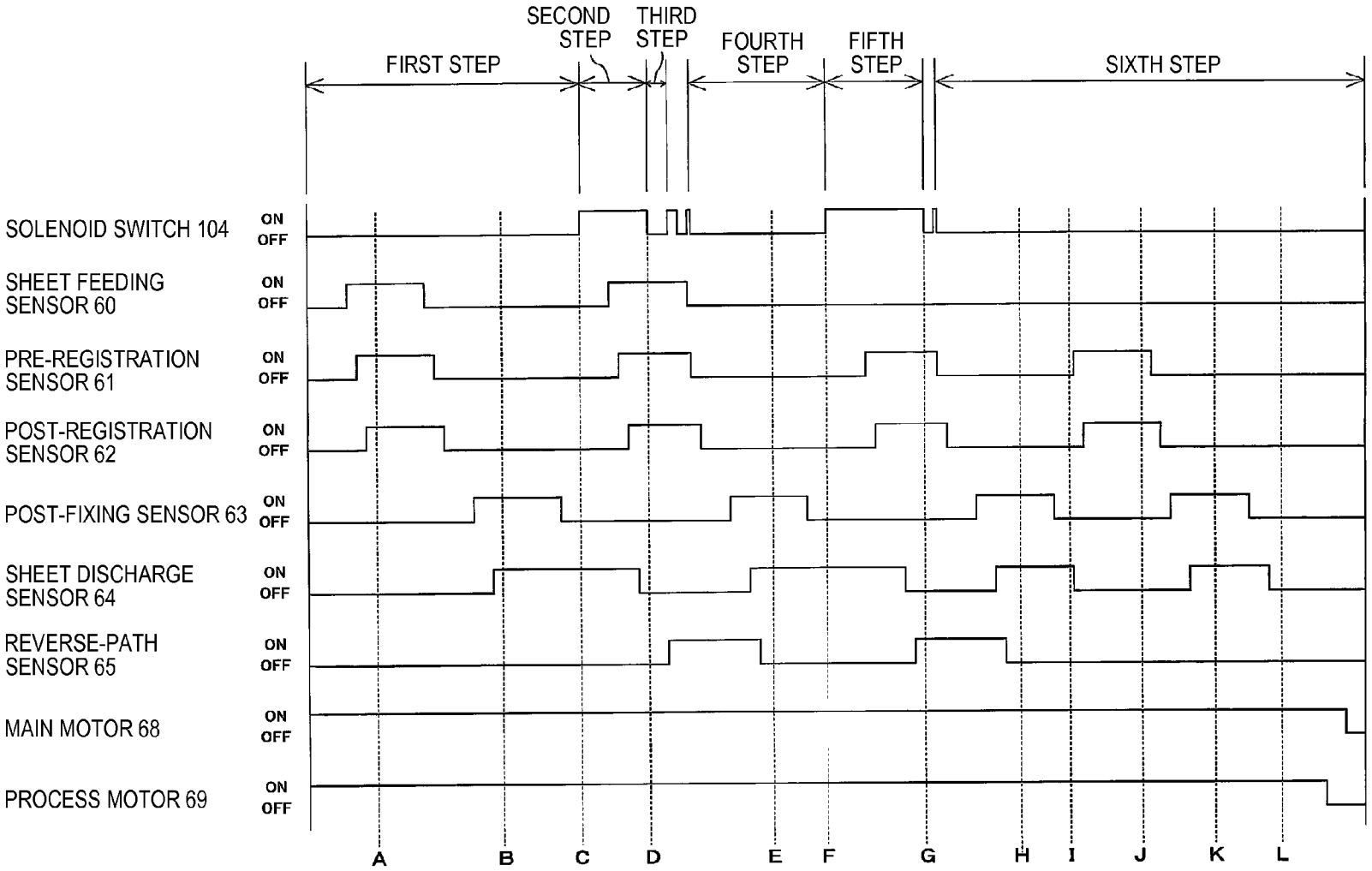
FIG. 19 is a timing chart for explaining a double-sided image forming process.

Therefore, as shown at a timing A in FIG. 19, the sheet feeding sensor 60, the pre-registration sensor 61, and the post-registration sensor 62 are turned on.

Figure 20B:
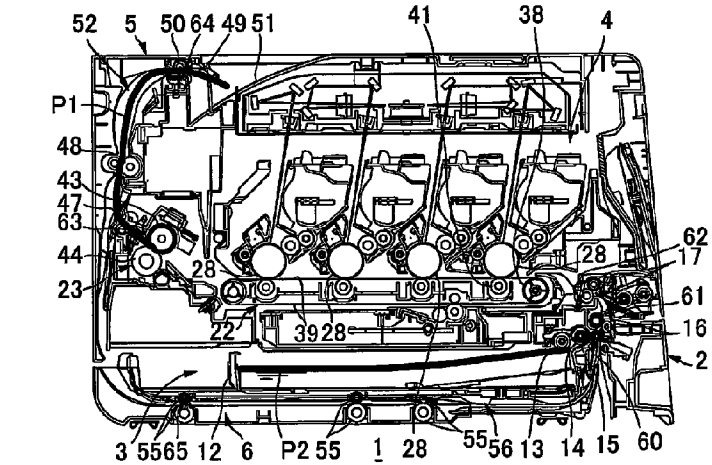

Next, while the preceding sheet P1 is conveyed in the primary conveyance path 52, as shown in FIG. 20B, an image is formed on one side of the preceding sheet P1 by the image forming unit 4 as described above. The preceding sheet P1 passes through the fixing unit 23 and is conveyed by the intermediate sheet discharge roller 48 and the switchback roller 50 such that the leading end of the preceding sheet P1 (an end portion on the upstream side in the conveyance direction in the primary conveyance path 52) is positioned in the vicinity of the discharge opening 49.

At this time, the succeeding sheet P2 is stacked on the sheet feeding tray 12 of the sheet feeding unit 3.

As a result, as shown at a timing B in FIG. 19, the sheet feeding sensor 60, the pre-registration sensor 61, and the post-registration sensor 62 are turned off, and the post-fixing sensor 63 and the sheet discharge sensor 64 are turned on.

Next, as shown in FIG. 20C, the preceding sheet P1 is conveyed to a position where the trailing end of the preceding sheet (an end portion on the downstream side in the conveyance direction in the primary conveyance path 52) is in the vicinity of the discharge opening 49.

At this time, the succeeding sheet P2 is stacked on the sheet feeding tray 12 of the sheet feeding unit 3.

Therefore, as shown at a timing C in FIG. 19, the sheet discharge sensor 64 is maintained in the ON state, and the post-fixing sensor 63 is turned off.

Then, if a predetermined time period elapses from turning on of the sheet discharge sensor 64 due to the preceding sheet P1, the CPU 72 performs a second step of holding the reverse rotation mode such that the preceding sheet P1 is conveyed into the secondary conveyance path 56.

Specifically, in order to perform the second step, at a timing when 1.00 sec elapses from turning on of the sheet discharge sensor 64, the CPU 72 performs control such that the switching unit 83 is switched from the normal rotation mode to the reverse rotation mode.

As a result, the preceding sheet P1 is reversed and is conveyed toward the secondary conveyance path 56.

Then, as shown in FIG. 20D, the preceding sheet P1 is conveyed such that the leading end of the preceding sheet (an end portion on the downstream side in the conveyance direction in the secondary conveyance path 56) is positioned in the vicinity of the rearmost reverse conveyance roller 55.

After the switching unit 83 is switched from the normal rotation mode to the reverse rotation mode, when a predetermined time period elapses, the CPU 72 drives the sheet feeding roller 14. Therefore, after the predetermined time period elapses, the succeeding sheet P2 is conveyed toward between the photosensitive drums 28 and the conveyor belt 39.

Then, as shown at a timing D in FIG. 19, the sheet discharge sensor 64 is turned off, and the sheet feeding sensor 60, the pre-registration sensor 61, and the post-registration sensor 62 are turned on.

The CPU 72 performs a third step of holding the stack mode so as to keep the preceding sheet P1 in the secondary conveyance path 56 such that the preceding sheet P1 which is conveyed in the secondary conveyance path 56 does not catch up with the succeeding sheet P2 in the middle of the second step.

Specifically, although the switching unit 83 has been switched to the reverse rotation mode by the second step, after the succeeding sheet P2 passes the post-registration sensor 62, the switching unit 83 is switched to the stack mode such that the preceding sheet P1 is kept in the secondary conveyance path 56, until a predetermined time period elapses. After the post-registration sensor 62 is turned on due to the succeeding sheet P2, if a predetermined time elapses, the CPU 72 switches the switching unit 83 from the stack mode to the reverse rotation mode.

Further, after the post-registration sensor 62 is turned on due to the succeeding sheet P2, when a predetermined time period elapses, the CPU 72 performs a fourth step of holding the normal rotation mode such that the succeeding sheet P2 is conveyed to the switchback roller 50.

Specifically, in performing the fourth step, since the preceding sheet P1 has been conveyed toward the secondary conveyance path 56, and when a predetermined time period has elapsed from turning on of the reverse-path sensor 65, the entire preceding sheet P1 has entered the secondary conveyance path 56, and has passed the intermediate sheet discharge roller 48, the CPU 72 performs control such that the switching unit 83 is switched from the reverse rotation mode to the normal rotation mode through the stack mode.

Accordingly, an image is formed on one side of the succeeding sheet P2, which is conveyed toward the discharge opening 49 by the intermediate sheet discharge roller 48 rotating in the normal rotation direction.

Figure 21G:
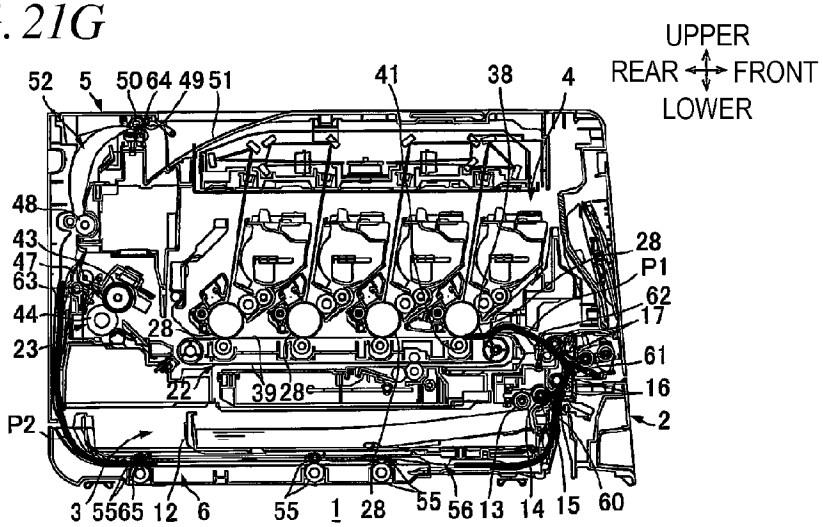
FIGS. 21E to 21H are explanatory views for explaining the sheet conveyance in the double-sided image forming process subsequent to FIGS. 20A to 20D, wherein FIG. 21E corresponds to a timing E of FIG. 19, and FIG. 21F corresponds to a timing F of FIG. 19, and FIG. 21G corresponds to a timing G of FIG. 19, and FIG. 21H corresponds to a timing H of FIG. 19.
Figure 21E:
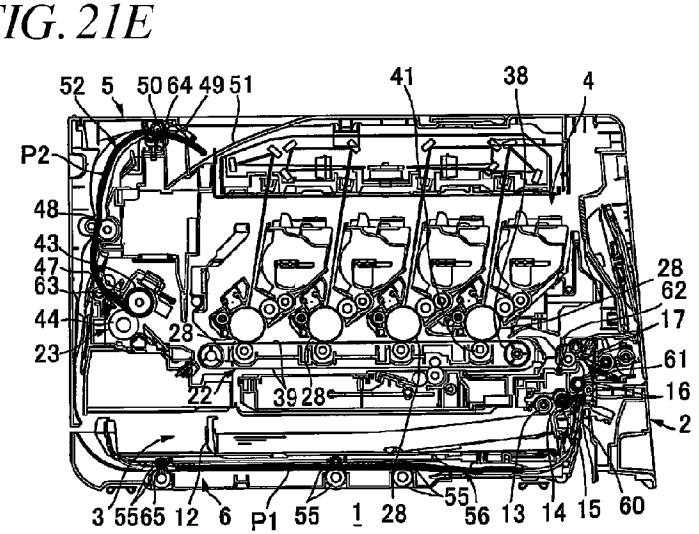

Then, as shown in FIG. 21E, the preceding sheet P1 is conveyed to a position where the trailing end of the preceding sheet (an end portion on the upstream side in the conveyance direction in the secondary conveyance path 56) exceeds the rearmost reverse conveyance roller 55.

The succeeding sheet P2 is conveyed to a position by the intermediate sheet discharge roller 48 and the switchback roller 50 48 rotating in their normal rotation directions such that the leading end of the succeeding sheet (an end portion on the downstream side in the conveyance direction in the primary conveyance path 52) is positioned in the vicinity of the discharge opening 49.

Then, as shown at a timing E in FIG. 19, the reverse-path sensor 65 is turned off, and the post-fixing sensor 63 and the sheet discharge sensor 64 are turned on.

Figure 21H:
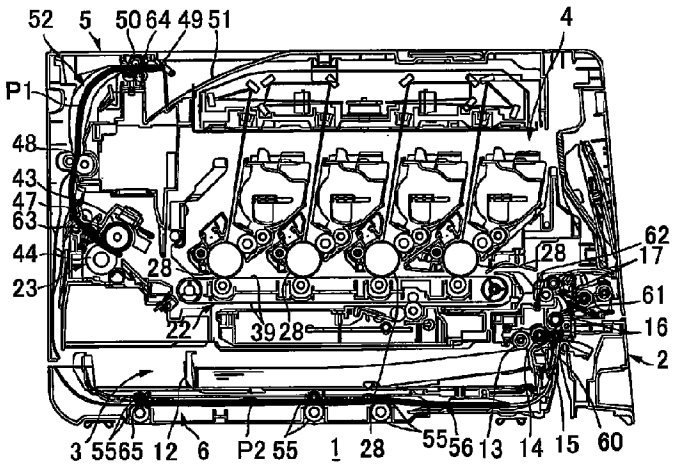
Figure 21F:
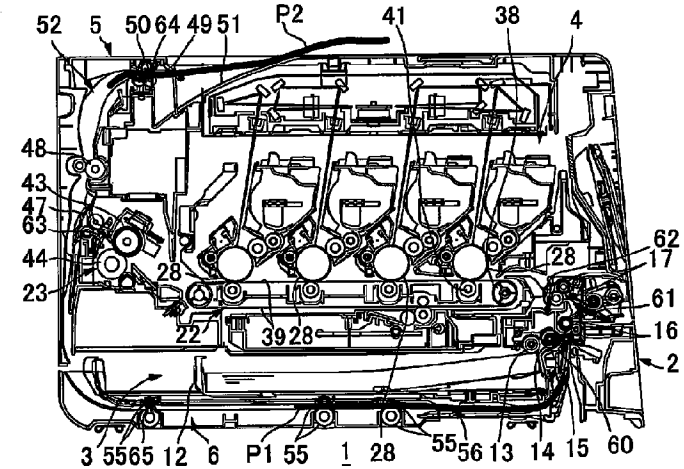

Next, as shown in FIG. 21F, the preceding sheet P1 is conveyed such that the leading end of the preceding sheet (an end portion on the downstream side in the conveyance direction in the secondary conveyance path 56) is positioned in the vicinity of the conveying roller 16.

The succeeding sheet P2 is conveyed such that the trailing end of the succeeding sheet (an end portion on the downstream side in the conveyance direction in the primary conveyance path 52) is positioned in the vicinity of the discharge opening 49.

At this time, as shown at a timing F in FIG. 19, the sheet discharge sensor 64 is maintained in the ON state, and the post-fixing sensor 63 is turned off.

Next, the CPU 72 performs a fifth step of holding the reverse rotation mode such that the succeeding sheet P2 is conveyed into the secondary conveyance path 56.

Specifically, in performing the fifth step, when 1.00 sec elapses from turning on of the sheet discharge sensor 64, the CPU 72 performs control such that the switching unit 83 is switched from the normal rotation mode to the reverse rotation mode.

Therefore, the succeeding sheet P2 is reversed, and is conveyed toward the secondary conveyance path 56.

Then, as shown in FIG. 21G, the succeeding sheet P2 is conveyed such that the leading end of the succeeding sheet (an end portion on the downstream side in the conveyance direction in the secondary conveyance path 56) is positioned in the vicinity of the rearmost reverse conveyance roller 55.

The preceding sheet P1 is conveyed into the primary conveyance path 52 again by rotation of the conveying roller 16, and is conveyed toward between the photosensitive drums 28 and the conveyor belt 39.

Therefore, as shown at a timing G in FIG. 19, the sheet discharge sensor 64 is turned off, and the reverse-path sensor 65 and the post-registration sensor 62 are turned on.

Then, when a predetermined time period elapses from the turning on of the reverse-path sensor 65 due to the succeeding sheet P2, the CPU 72 performs a sixth step of holding the normal rotation mode. The preceding sheet P1 in the primary conveyance path 52 is discharged from the main body casing 2 through the discharge opening 49, and the succeeding sheet P2 is conveyed from the secondary conveyance path 56 into the primary conveyance path 52 by the conveying roller 16, an image is formed on the other side of the succeeding sheet P2 by the image forming unit 4, and the succeeding sheet P2 is discharged from the main body casing 2 through the discharge opening 49.

Specifically, in performing the sixth step, since the succeeding sheet P2 has been conveyed toward the secondary conveyance path 56, and when a predetermined time period has elapsed from turning on of the reverse-path sensor 65, the entire succeeding sheet P2 has entered the secondary conveyance path 56, and has passed the intermediate sheet discharge roller 48, the CPU 72 performs control such that the switching unit 83 is switched from the reverse rotation mode to the normal rotation mode through the stack mode.

Therefore, an image is formed on the other side of the preceding sheet P1 having been conveyed to the sheet discharge unit 5, and the preceding sheet P1 is conveyed toward the discharge opening 49 by the intermediate sheet discharge roller 48 rotating in the normal rotation direction.

Then, as shown in FIG. 21H, the preceding sheet P1 is conveyed by the intermediate sheet discharge roller 48 and the switchback roller 50 rotating in their normal rotation directions such that the leading end of the preceding sheet P1 (an end portion on the downstream side in the conveyance direction in the primary conveyance path 52) is positioned in the vicinity of the discharge opening 49.

The succeeding sheet P2 is conveyed to a position where the trailing end of the succeeding sheet (on the upstream side in the conveyance direction in the secondary conveyance path 56) exceeds the rearmost reverse conveyance roller 55.

Then, as shown at a timing H in FIG. 19, the reverse-path sensor 65 is turned off, and the post-fixing sensor 63 and the sheet discharge sensor 64 are turned on.

Figure 22K:
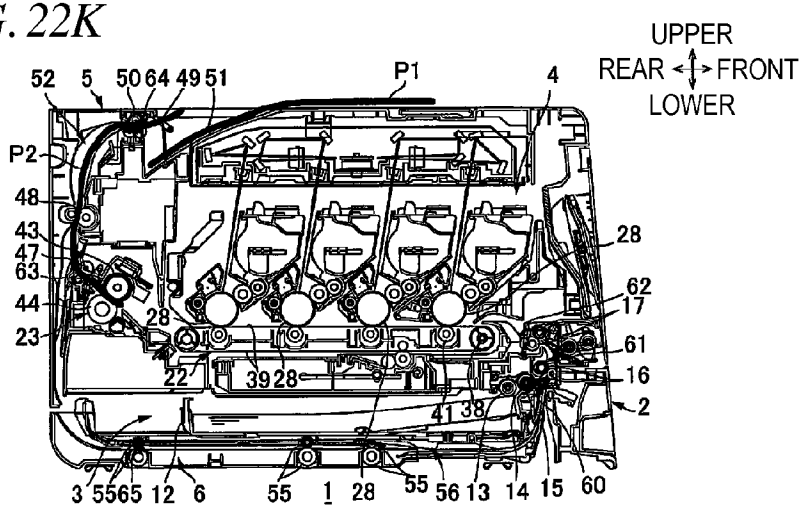
FIGS. 22I to 22L are explanatory views for explaining the sheet conveyance in the double-sided image forming process subsequent to FIGS. 21E to 21H, wherein FIG. 22I corresponds to a timing I of FIG. 19, and FIG. 22J corresponds to a timing J of FIG. 19, and FIG. 22K corresponds to a timing K of FIG. 19, and FIG. 22L corresponds to a timing L of FIG. 19.
Figure 22L:
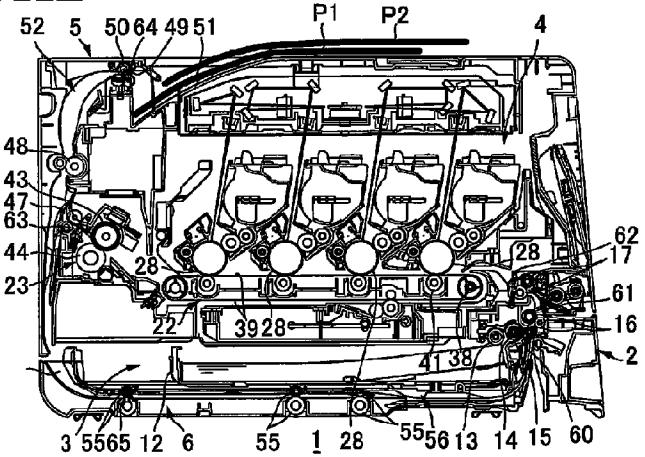
Figure 22I:
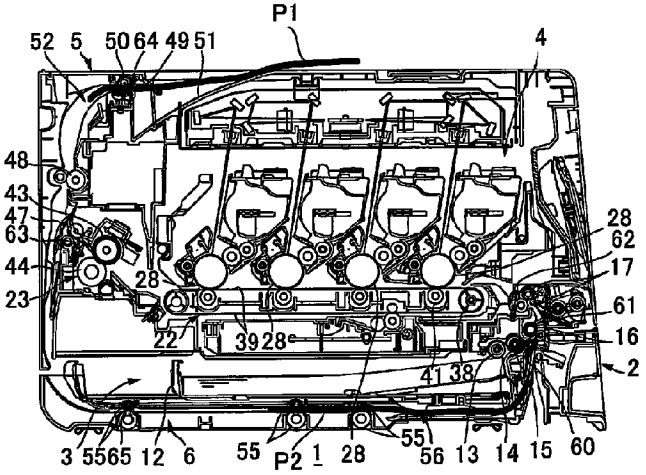

Next, as shown in FIG. 22I, the preceding sheet P1 is conveyed such that the trailing end of the preceding sheet (an end portion on the downstream side in the conveyance direction in the primary conveyance path 52) is positioned in the vicinity of the discharge opening 49.

The succeeding sheet P2 is conveyed such that the leading end of the succeeding sheet (an end portion on the downstream side in the conveyance direction in the secondary conveyance path 56) is positioned in the vicinity of the conveying roller 16.

At this time, as shown at a timing I in FIG. 19, the sheet discharge sensor 64 is maintained in the ON state, and the post-fixing sensor 63 is turned off.

Figure 22J:
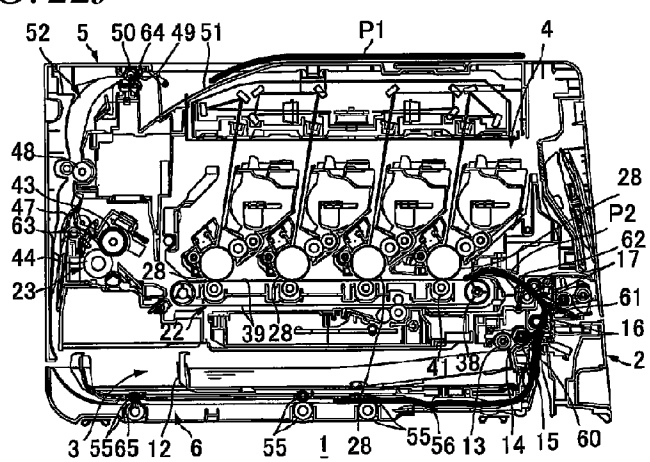

Next, as shown in FIG. 22J, the preceding sheet P1 is discharged from the discharge opening 49 onto the sheet discharge tray 51.

The succeeding sheet P2 is conveyed into the primary conveyance path 52 again by rotation of the conveying roller 16, and is conveyed toward between the rearmost photosensitive drum 28 and the conveyor belt 39.

At this time, as shown at a timing J in FIG. 19, the sheet discharge sensor 64 is turned off, and the pre-registration sensor 61 and the post-registration sensor 62 are turned on.

Further, as shown in FIG. 22K, the preceding sheet P1 is loaded on the sheet discharge tray 51.

Next, the succeeding sheet P2 is conveyed by the intermediate sheet discharge roller 48 and the switchback roller 50 rotating in their normal rotation directions such that the leading end of the succeeding sheet (on the downstream side in the conveyance direction in the primary conveyance path 52) is positioned in the vicinity of the discharge opening 49.

Therefore, as shown at a timing K in FIG. 19, the post-fixing sensor 63 and the sheet discharge sensor 64 are turned on.

At this time, as shown in FIG. 22L, the preceding sheet P1 is loaded on the sheet discharge tray 51.

Next, the succeeding sheet P2 is discharged from the discharge opening 49 onto the sheet discharge tray 51, so as to be loaded on the preceding sheet P1.

Therefore, as shown at a timing L in FIG. 19, the post-fixing sensor 63 and the sheet discharge sensor 64 are turned off.

As described above, the double-sided image forming process on two sheets P of the first set is completed.

In a case of subsequently performing the double-sided image forming process on the second and subsequent sets, at the timing K of FIG. 19, as shown in FIG. 20A, a preceding sheet P1 of the second set is conveyed from the sheet feeding tray 12 toward between the photosensitive drums 28 and the conveyor belt 39.

Then, when the preceding sheet P1 and the succeeding sheet P2 of the first set are loaded on the sheet discharge tray 51 as shown in FIG. 22L, as shown in FIG. 20B, an image is formed on one side of the preceding sheet P1 of the second set by the image forming unit 4. The preceding sheet P1 passes through the fixing unit 23 and is conveyed by the intermediate sheet discharge roller 48 and the switchback roller 50 such that the leading end of the preceding sheet (an end portion on the upstream side in the conveyance direction in the primary conveyance path 52) is positioned in the vicinity of the discharge opening 49.

Thereafter, on the sheets P, images are formed by the similar process to the double-sided image forming process on the preceding sheet P1 and succeeding sheet P2 of the first set.

In a case where the number of the plurality of sheets P is odd, after an image is formed on one side of the final one sheet P, at a timing when the trailing end of the sheet P (an end portion on the upstream side in the conveyance direction in the primary conveyance path 52) reaches the sheet discharge sensor 64, the switching unit 83 is switched from the normal rotation mode to the reverse rotation mode, and the sheet P is conveyed toward the secondary conveyance path 56.

Thereafter, the leading end of the sheet P (an end portion on the upstream side in the conveyance direction in the secondary conveyance path 56) reaches the rearmost reverse conveyance roller 55, whereby the reverse-path sensor 65 is turned on. Thereafter, when a predetermined time period elapses, the switching unit 83 is switched to the stack mode.

Then, while the sheet P is conveyed into the primary conveyance path 52 again, an image is formed on the other side of the sheet P and the sheet P reaches the fixing unit 23, the switching unit 83 is switched from the stack mode to the normal rotation mode.

Thereafter, the sheet P is discharged onto the sheet discharge tray 51 through the discharge opening 49 by the intermediate sheet discharge roller 48 and the switchback roller 50 rotating in their normal rotation directions.

As a result, the double-sided image forming process on both sides of each of the plurality of sheets P is completed.

9. Effects of Double-Sided Image Forming Process

According to the printer 1, as shown in FIGS. 20A to 20D, FIGS. 21E to 21H and 22I to 22L, image forming on one side and the other side of each of a preceding sheet P1 and a succeeding sheet P2 is performed in order of one side of the preceding sheet P1, one side of the succeeding sheet P2, the other side of the preceding sheet P1, and the other side of the succeeding sheet P2.

Therefore, as compared to a process of forming images on one side and the other side of the preceding sheet P1 and then forming images on one side and the other side of the succeeding sheet P2, it is possible to form images on the preceding sheet P1 and the succeeding sheet P2 in a shorter time.

As a result, while it is possible to reduce the cost and noise, it is possible to efficiently form images on one side and the other side of each of the plurality of sheets P.

10. Other Illustrative Embodiments

As an example of the switchback roller, the switchback roller 50 for conveying a sheet P toward the sheet discharge tray 51 has been described. However, the present invention is not limited thereto. The intermediate sheet discharge roller 48 for switching the conveyance direction of a sheet P in the main body casing 2 may be taken as an example of the switchback roller.

In that case, a gear arrangement of the fourth intermediate gear 94 and the intermediate sheet discharge roller gear 87 for transmitting rotational driving force for rotating the intermediate sheet discharge roller 48 in the normal rotation direction may be taken as an example of the first gear train, and a gear arrangement of the fifth intermediate gear 95, the second intermediate gear 92, the third intermediate gear 93, the fourth intermediate gear 94, and the intermediate sheet discharge roller gear 87 may be taken as an example of the second gear train.

What is claimed is:

1. An image forming apparatus comprising:

a driving source configured to generate a one-direction rotational driving force;

a switchback roller configured to be switched between a normal rotation direction and a reverse rotation direction for switching a conveyance direction of a recording medium having an image formed thereon by an image forming unit;

a first gear train configured to transmit the one-direction rotational driving force of the driving source to the switchback roller such that a rotation direction of the switchback roller becomes the normal rotation direction;

a second gear train configured to transmit the one-direction rotational driving force of the driving source to the switchback roller such that the rotation direction of the switchback roller becomes the reverse rotation direction;

a switching mechanism configured to be switchable among a first mode for transmitting the one-direction rotational driving force of the driving source to the first gear train, a second mode for transmitting the one-direction rotational driving force of the driving source to the second gear train, and a third mode for not transmitting the one-direction rotational driving force of the driving source to any of the first gear train and the second gear train;

a switching element configured to selectively change between a first state allowing switching of the switching mechanism into the first mode or the third mode, and a second state allowing switching of the switching mechanism into the second mode; and a controller configured to control a state change of the switching element between the first state and the second state, wherein the switching mechanism is configured to be switched from the second mode only to the third mode, wherein the controller is configured to perform:

first control to control the switching element to hold the first state for a first time period; and second control to control the switching element to hold the second state for a second time period, and wherein the controller is configured to, after performing the second control to cause the switching mechanism to switch into the second mode, switch to perform the first control.

2. The image forming apparatus according to claim 1, wherein the controller is configured to perform the second control after power-on of the image forming apparatus by a time when an image is formed on a recording medium.

3. The image forming apparatus according to claim 1, wherein the controller is further configured to perform third control to control the switching element to hold the second state for a third time period shorter than the second time period, and wherein the switching mechanism is configured to interchange the first mode and the third mode before and after the third control of the controller.

4. The image forming apparatus according to claim 3, further comprising:

a discharge opening, through which a recording medium having an image formed thereon is discharged; and a sensor provided in a middle of a conveyance path from the image forming unit to the discharge opening and configured to detect a recording medium, wherein the first time period of the first control is a time period longer than a conveyance time of a recording medium conveyed from the sensor to the discharge opening.

5. The image forming apparatus according to claim 3, wherein the switching mechanism includes:

a pendulum gear which is selectively positioned at a first gear train engagement position where the pendulum gear is engaged with the first gear train, a second gear train engagement position where the pendulum gear is engaged with the second gear train, and a disengagement position where the pendulum gear is not engaged with any of the first gear train and the second gear train;

a holder configured to support the pendulum gear to be rotatable;

a cam configured to come into contact with the holder to move the holder;

a drive gear configured to receive the rotational driving force from the driving source;

a partially toothed gear including a toothed portion which is engaged with the drive gear, and a non-tooth portion which is configured to face the drive gear in each of the first mode, the second mode and the third mode; and a locking unit configured to hold a state where the non-tooth portion and the drive gear face each other in each of the first mode, the second mode and the third mode, wherein the locking unit includes:

a regulating member configured to be rotatable in conjunction with the partially toothed gear, and including a protruding portion formed at an outer periphery thereof; and an engaging member including a first engagement portion and a second engagement portion which are configured to be engaged with the protruding portion to regulate rotation of the partially toothed gear, the engaging member being configured to be movable between a first engagement position where the first engagement portion is engaged with the protruding portion and the second engagement portion is not engaged with the protruding portion, and a second engagement position where the second engagement portion is engaged with the protruding portion and the first engagement portion is not engaged with the protruding portion, wherein the protruding portion includes:

a first protruding portion configured to be able to engage with the first engagement portion and the second engagement portion; and a second protruding portion configured to be able to engage with the first engagement portion and unable to engage with the second engagement portion, wherein the engaging member is positioned at the first engagement position and the first engagement portion is engaged with the first protruding portion, whereby the switching mechanism is switched to the first mode, wherein the engaging member is positioned at the second engagement position and the second engagement portion is engaged with the first protruding portion, whereby the switching mechanism is switched from the first mode to the second mode, wherein the engaging member is positioned at the first engagement position and the first engagement portion is engaged with the second protruding portion, whereby the switching mechanism is switched from the second mode to the third mode, wherein the switching element is configure to:

in the first state, cause the engaging member to position at the first engagement position; and in the second state, cause the engaging member to position at the second engagement position.

6. The image forming apparatus according to claim 1, wherein the switching element includes a solenoid switch configured to be switched between an excited state and a non-excited state, and wherein one of the excited state and the non-excited state corresponds to the first state, and the other of the excited state and the non-excited state corresponds to the second state.

7. The image forming apparatus according to claim 6, wherein the non-excited state of the solenoid switch corresponds to the first state, and the excited state of the solenoid switch corresponds to the second state.

8. The image forming apparatus according to claim 1, further comprising:

the image forming unit disposed on an upstream side of the switchback roller in the conveyance direction;

a conveying roller disposed on an upstream side of the image forming unit in the conveyance direction, and configured to receive the rotational driving force from the driving source;

a sheet feeding unit configured to load thereon a recording medium;

a primary conveyance path along which a recording medium is conveyed by the conveying roller and reaches the switchback roller through the image forming unit; and a secondary conveyance path along which a recording medium is conveyed from the switchback roller and join the primary conveyance path at an upstream side of the image forming unit in the conveyance direction, wherein the controller is configured to perform a double-sided image forming process for forming images on recording media, wherein the double-sided image forming process is a process of forming images on both sides of each of a first recording medium and a second recording medium, and wherein the double-sided image forming process includes:

a first step of holding the first mode such that the first recording medium is fed from the sheet feeding unit into the primary conveyance path by the conveying roller, an image is formed on one side of the first recording medium by the image forming unit, and the first recording medium is conveyed to the switchback roller;

a second step of holding the second mode such that the first recording medium is conveyed into the secondary conveyance path;

a third step of holding the third mode to stop conveyance of the first recording medium in the secondary conveyance path;

a fourth step of holding the first mode such that the second recording medium is conveyed to the switchback roller;

a fifth step of holding the second mode such that the second recording medium is conveyed into the secondary conveyance path; and a sixth step of holding the first mode such that the first recording medium in the primary conveyance path is discharged from a discharge opening, the second recording medium is conveyed from the secondary conveyance path into the primary conveyance path by the conveying roller, an image is formed on the other side of the second recording medium, and the second recording medium is discharged from the discharge opening.

9. An image forming apparatus comprising:

a driving source configured to generate a one-direction rotational driving force;

a switchback roller configured to be switched between a normal rotation direction and a reverse rotation direction for switching a conveyance direction of a recording medium having an image formed thereon by an image forming unit;

a first gear train configured to transmit the one-direction rotational driving force of the driving source to the switchback roller such that a rotation direction of the switchback roller becomes the normal rotation direction;

a second gear train configured to transmit the one-direction rotational driving force of the driving source to the switchback roller such that the rotation direction of the switchback roller becomes the reverse rotation direction;

a switching mechanism configured to be switchable among a first mode for transmitting the one-direction rotational driving force of the driving source to the first gear train, a second mode for transmitting the one-direction rotational driving force of the driving source to the second gear train, and a third mode for not transmitting the one-direction rotational driving force of the driving source to any of the first gear train and the second gear train;

a switching element configured to selectively change between a first state allowing switching of the switching mechanism into the first mode or the third mode, and a second state allowing switching of the switching mechanism into the second mode; and a controller configured to control a state change of the switching element between the first state and the second state, wherein the controller is configured to perform:

first control to control the switching element to hold the first state for a first time period;

second control to control the switching element to hold the second state for a second time period;

third control to control the switching element to hold the second state for a third time period shorter than the second time period, wherein the switching mechanism is configured to:

selectively hold the first mode or the third mode based on the first control of the controller;

hold the second mode based on the second control of the controller; and interchange the first mode and the third mode before and after the third control of the controller.

10. The image forming apparatus according to claim 9, wherein the controller is configured to perform the first control immediately after power-on of the image forming apparatus, then perform the third control, and gain perform the first control.

11. The image forming apparatus according to claim 9, further comprising:

a discharge opening, through which a recording medium having an image formed thereon is discharged; and a sensor provided in a middle of a conveyance path from the image forming unit to the discharge opening and configured to detect a recording medium, wherein the first time period of the first control is a time period longer than a conveyance time of a recording medium conveyed from the sensor to the discharge opening.

12. The image forming apparatus according to claim 9, wherein the switching element includes a solenoid switch configured to be switched between an excited state and a non-excited state, and wherein one of the excited state and the non-excited state corresponds to the first state, and the other of the excited state and the non-excited state corresponds to the second state.

13. The image forming apparatus according to claim 12, wherein the non-excited state of the solenoid switch corresponds to the first state, and the excited state of the solenoid switch corresponds to the second state.

14. The image forming apparatus according to claim 9, wherein the switching mechanism includes:

a pendulum gear which is selectively positioned at a first gear train engagement position where the pendulum gear is engaged with the first gear train, a second gear train engagement position where the pendulum gear is engaged with the second gear train, and a disengagement position where the pendulum gear is not engaged with any of the first gear train and the second gear train;

a holder configured to support the pendulum gear to be rotatable;

a cam configured to come into contact with the holder to move the holder;

a drive gear configured to receive the rotational driving force from the driving source;

a partially toothed gear including a toothed portion which is engaged with the drive gear, and a non-tooth portion which is configured to face the drive gear in each of the first mode, the second mode and the third mode; and a locking unit configured to hold a state where the non-tooth portion and the drive gear face each other in each of the first mode, the second mode and the third mode, wherein the locking unit includes:

a regulating member configured to be rotatable in conjunction with the partially toothed gear, and including a protruding portion formed at an outer periphery thereof; and an engaging member including a first engagement portion and a second engagement portion which are configured to be engaged with the protruding portion to regulate rotation of the partially toothed gear, the engaging member being configured to be movable between a first engagement position where the first engagement portion is engaged with the protruding portion and the second engagement portion is not engaged with the protruding portion, and a second engagement position where the second engagement portion is engaged with the protruding portion and the first engagement portion is not engaged with the protruding portion, wherein the protruding portion includes:

a first protruding portion configured to be able to engage with the first engagement portion and the second engagement portion; and a second protruding portion configured to be able to engage with the first engagement portion and unable to engage with the second engagement portion, wherein the engaging member is positioned at the first engagement position and the first engagement portion is engaged with the first protruding portion, whereby the switching mechanism is switched to the first mode, wherein the engaging member is positioned at the second engagement position and the second engagement portion is engaged with the first protruding portion, whereby the switching mechanism is switched from the first mode to the second mode, wherein the engaging member is positioned at the first engagement position and the first engagement portion is engaged with the second protruding portion, whereby the switching mechanism is switched from the second mode to the third mode, wherein the switching element is configure to:

in the first state, cause the engaging member to position at the first engagement position; and in the second state, cause the engaging member to position at the second engagement position.

15. The image forming apparatus according to claim 9, further comprising:

the image forming unit disposed on an upstream side of the switchback roller in the conveyance direction;

a conveying roller disposed on an upstream side of the image forming unit in the conveyance direction, and configured to receive the rotational driving force from the driving source;

a sheet feeding unit configured to load thereon a recording medium;

a primary conveyance path along which a recording medium is conveyed by the conveying roller and reaches the switchback roller through the image forming unit; and a secondary conveyance path along which a recording medium is conveyed from the switchback roller and join the primary conveyance path at an upstream side of the image forming unit in the conveyance direction, wherein the controller is configured to perform a double-sided image forming process for forming images on recording media, wherein the double-sided image forming process is a process of forming images on both sides of each of a first recording medium and a second recording medium, and wherein the double-sided image forming process includes:

a first step of holding the first mode such that the first recording medium is fed from the sheet feeding unit into the primary conveyance path by the conveying roller, an image is formed on one side of the first recording medium by the image forming unit, and the first recording medium is conveyed to the switchback roller;

a second step of holding the second mode such that the first recording medium is conveyed into the secondary conveyance path;

a third step of holding the third mode to stop conveyance of the first recording medium in the secondary conveyance path;

a fourth step of holding the first mode such that the second recording medium is conveyed to the switchback roller;

a fifth step of holding the second mode such that the second recording medium is conveyed into the secondary conveyance path; and a sixth step of holding the first mode such that the first recording medium in the primary conveyance path is discharged from a discharge opening, the second recording medium is conveyed from the secondary conveyance path into the primary conveyance path by the conveying roller, an image is formed on the other side of the second recording medium, and the second recording medium is discharged from the discharge opening.

* * * * *